US011951366B2

(12) United States Patent
Andrews et al.

(10) Patent No.: US 11,951,366 B2
(45) Date of Patent: Apr. 9, 2024

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Matthew T. Andrews, Scottsdale, AZ (US); Bradley D. Schweigert, Cave Creek, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 51 days.

(21) Appl. No.: 17/824,074

(22) Filed: May 25, 2022

(65) Prior Publication Data

US 2022/0280846 A1 Sep. 8, 2022

Related U.S. Application Data

(63) Continuation-in-part of application No. 17/706,782, filed on Mar. 29, 2022, now Pat. No. 11,745,068, and (Continued)

(51) Int. Cl.
*A63B 53/06* (2015.01)
*A63B 53/04* (2015.01)
*A63B 60/02* (2015.01)

(52) U.S. Cl.
CPC ..... *A63B 53/0487* (2013.01); *A63B 53/065* (2013.01); *A63B 60/02* (2015.10); (Continued)

(58) Field of Classification Search
CPC ..... A63B 53/0491
(Continued)

(56) References Cited

U.S. PATENT DOCUMENTS 922,444 A 5/1909 Youds
1,133,129 A 3/1915 Govan
(Continued)

FOREIGN PATENT DOCUMENTS

CN 101028559 A * 9/2007 ..... A63B 53/0487
DE 202011000674 U1 * 7/2011 ..... A63B 53/02
(Continued)

OTHER PUBLICATIONS

TourSpecGolf (Gold's Factory Multi Weighted Custom Putter) [online]. Nov. 20, 2010 [retrieved May 8, 2019] Retrieved from the Internet:.

(Continued)

*Primary Examiner* — Alvin A Hunter

(57) ABSTRACT

Examples of golf club heads and methods to manufacture golf club heads are generally described herein. In one example, a putter-type golf club head may include a body portion. The body portion may include a toe portion, a heel portion, a front portion, a rear portion, a top portion, a sole portion, and a weight port. The weight port may have a threaded section and an unthreaded section. A first weight portion may be coupled to the unthreaded section by an epoxy or other adhesive. A second weight portion may be threadingly fastened to the threaded section. The first weight portion may include a central through-bore to provide at least one of air relief or relief for the epoxy or other adhesive. Other examples may be described and claimed.

20 Claims, 23 Drawing Sheets

Related U.S. Application Data a continuation-in-part of application No. 17/472,321, filed on Sep. 10, 2021, now Pat. No. 11,759,684, and a continuation-in-part of application No. 17/378,252, filed on Jul. 16, 2021, now Pat. No. 11,583,738, and a continuation-in-part of application No. 17/344,705, filed on Jun. 10, 2021, now Pat. No. 11,511,169, said application No. 17/378,252 is a continuation of application No. 17/232,401, filed on Apr. 16, 2021, now Pat. No. 11,090,535, application No. 17/824,074 is a continuation of application No. 17/123,325, filed on Dec. 16, 2020, now Pat. No. 11,369,849, said application No. 17/472,321 is a continuation of application No. 16/940,806, filed on Jul. 28, 2020, now Pat. No. 11,141,635, and a continuation-in-part of application No. 16/866,991, filed on May 5, 2020, now Pat. No. 11,173,361, said application No. 17/344,705 is a continuation of application No. 16/751,500, filed on Jan. 24, 2020, now Pat. No. 11,045,698, said application No. 17/706,782 is a continuation of application No. 16/674,332, filed on Nov. 5, 2019, now Pat. No. 11,311,781, said application No. 17/232,401 is a continuation of application No. 16/567,937, filed on Sep. 11, 2019, now Pat. No. 10,981,038, said application No. 16/866,991 is a continuation-in-part of application No. 16/400,128, filed on May 1, 2019, now Pat. No. 10,688,355, and a continuation of application No. 16/283,390, filed on Feb. 22, 2019, now Pat. No. 10,646,758, said application No. 16/674,332 is a continuation of application No. 16/275,883, filed on Feb. 14, 2019, now Pat. No. 10,493,331, said application No. 16/751,500 is a continuation-in-part of application No. 16/035,271, filed on Jul. 13, 2018, now Pat. No. 10,576,339, said application No. 16/940,806 is a continuation of application No. 16/006,055, filed on Jun. 12, 2018, now Pat. No. 10,737,153, and a continuation-in-part of application No. 15/987,731, filed on May 23, 2018, now Pat. No. 10,821,341, which is a continuation-in-part of application No. 15/922,506, filed on Mar. 15, 2018, now abandoned, and a continuation-in-part of application No. 15/831,151, filed on Dec. 4, 2017, now Pat. No. 10,478,680, said application No. 16/400,128 is a continuation of application No. 15/816,517, filed on Nov. 17, 2017, now Pat. No. 10,315,080, said application No. 15/987,731 is a continuation-in-part of application No. 15/489,366, filed on Apr. 17, 2017, now Pat. No. 10,124,221, and a continuation-in-part of application No. 15/188,661, filed on Jun. 21, 2016, now Pat. No. 10,441,858, said application No. 15/816,517 is a continuation of application No. 15/150,006, filed on May 9, 2016, now Pat. No. 10,258,845, said application No. 15/489,366 is a continuation of application No. 15/078,749, filed on Mar. 23, 2016, now Pat. No. 9,649,540, said application No. 16/283,390 is a continuation of application No. 14/962,953, filed on Dec. 8, 2015, now Pat. No. 10,258,844, said application No. 15/188,661 is a continuation of application No. 14/812,212, filed on Jul. 29, 2015, now Pat. No. 9,387,375, said application No. 14/962,953 is a continuation of application No. 14/686,466, filed on Apr. 14, 2015, now Pat. No. 9,233,283, said application No. 15/150,006 is a continuation-in-part of application No. 14/586,720, filed on Dec. 30, 2014, now Pat. No. 9,440,124.

(60) Provisional application No. 62/949,064, filed on Dec. 17, 2019, provisional application No. 62/798,277, filed on Jan. 29, 2019, provisional application No. 62/755,241, filed on Nov. 2, 2018, provisional application No. 62/745,194, filed on Oct. 12, 2018, provisional application No. 62/659,060, filed on Apr. 17, 2018, provisional application No. 62/644,233, filed on Mar. 16, 2018, provisional application No. 62/574,071, filed on Oct. 18, 2017, provisional application No. 62/536,266, filed on Jul. 24, 2017, provisional application No. 62/533,481, filed on Jul. 17, 2017, provisional application No. 62/518,715, filed on Jun. 13, 2017, provisional application No. 62/480,338, filed on Mar. 31, 2017, provisional application No. 62/431,157, filed on Dec. 7, 2016, provisional application No. 62/213,933, filed on Sep. 3, 2015, provisional application No. 62/212,462, filed on Aug. 31, 2015, provisional application No. 62/146,114, filed on Apr. 10, 2015, provisional application No. 62/138,925, filed on Mar. 26, 2015, provisional application No. 62/059,108, filed on Oct. 2, 2014, provisional application No. 62/041,553, filed on Aug. 25, 2014, provisional application No. 62/030,820, filed on Jul. 30, 2014, provisional application No. 62/015,297, filed on Jun. 20, 2014, provisional application No. 61/992,379, filed on May 13, 2014, provisional application No. 61/985,351, filed on Apr. 28, 2014.

(52) U.S. Cl.
CPC ..... *A63B 53/0408* (2020.08); *A63B 53/0437* (2020.08); *A63B 53/0441* (2020.08); *A63B 53/0466* (2013.01); *A63B 53/047* (2013.01); *A63B 2053/0491* (2013.01)

(58) Field of Classification Search
USPC ..... 473/324–350
See application file for complete search history.

(56) References Cited

U.S. PATENT DOCUMENTS

| | | | | |
|---|---|---|---|---|
| RE19,178 | E | 5/1934 | Spiker | |
| 3,749,408 | A * | 7/1973 | Mills | A63B 53/0487 473/340 |
| 3,815,910 | A * | 6/1974 | Raines | A63B 53/007 473/340 |
| 3,980,301 | A * | 9/1976 | Smith | A63B 53/02 473/314 |
| 4,043,562 | A | 8/1977 | Shillington | |
| 4,340,230 | A | 7/1982 | Churchward | |
| 4,754,977 | A | 7/1988 | Sahm | |
| 4,869,507 | A | 9/1989 | Sahm | |
| 4,927,144 | A * | 5/1990 | Stormon | A63B 53/0487 473/313 |
| 5,116,047 | A * | 5/1992 | Phelan | A63B 53/007 473/307 |
| 5,127,653 | A * | 7/1992 | Nelson | A63B 53/0487 473/239 |
| 5,137,275 | A * | 8/1992 | Nelson | A63B 53/02 473/306 |
| 5,154,424 | A | 10/1992 | Lo | |
| 5,193,806 | A * | 3/1993 | Burkly | A63B 53/04 473/331 |
| D335,317 | S | 5/1993 | Shearer | |
| D335,692 | S | 5/1993 | Antonious | |
| D336,757 | S | 6/1993 | Antonious | |

(56) References Cited

U.S. PATENT DOCUMENTS 5,244,205 A * 9/1993 Melanson ..... A63B 53/065 473/248
5,275,399 A * 1/1994 Schmidt ..... A63B 60/00 473/315
5,275,409 A * 1/1994 Currie ..... A63B 53/02 473/313
5,275,412 A 1/1994 Innes
5,340,104 A * 8/1994 Griffin ..... A63B 53/02 403/267
D350,582 S 9/1994 Miansian et al.
5,388,827 A * 2/1995 Reynolds, Jr. ..... A63B 60/46 473/339
5,390,918 A * 2/1995 Meyers ..... A63B 53/065 D21/734
5,429,366 A 7/1995 McCabe
D363,101 S 10/1995 Sturm
5,454,563 A 10/1995 Nagamoto et al.
5,470,063 A * 11/1995 Fisher ..... A63B 53/02 473/251
D365,864 S 1/1996 Sturm
5,489,097 A 2/1996 Simmons
D368,751 S 4/1996 Rife
D369,393 S 4/1996 Takahashi et al.
5,518,235 A * 5/1996 Mendenhall ..... A63B 53/02 473/324
5,533,725 A * 7/1996 Reynolds, Jr. ..... A63B 53/065 473/307
5,569,098 A * 10/1996 Klein ..... A63B 53/007 473/316
5,571,053 A 11/1996 Lane
D378,688 S 4/1997 Cameron
D385,609 S 10/1997 Cameron
5,683,307 A 11/1997 Rife
D388,143 S 12/1997 Huan-Chiang
D389,207 S 1/1998 Cameron
5,711,719 A * 1/1998 Fireman ..... A63B 60/00 473/305
5,720,671 A 2/1998 Cheng
5,746,664 A * 5/1998 Reynolds, Jr. ..... A63B 53/02 473/307
5,749,793 A * 5/1998 Lucetti ..... A63B 60/54 473/328
D398,685 S 9/1998 Masuda
5,803,824 A * 9/1998 Rollingson ..... A63B 53/02 473/307
D399,290 S 10/1998 Sizemore, Jr.
D399,911 S 10/1998 Nicolette et al.
5,839,974 A 11/1998 McAllister
D405,836 S 2/1999 Nicolette et al.
5,885,170 A * 3/1999 Takeda ..... A63B 53/04 473/307
5,890,969 A 4/1999 Bechler
D409,701 S 5/1999 Ashcraft et al.
5,911,638 A * 6/1999 Parente ..... A63B 60/00 473/409
5,924,938 A 7/1999 Hines
6,007,434 A 12/1999 Baker et al.
6,039,656 A 3/2000 Fireman
D422,655 S 4/2000 Hicks
6,050,903 A 4/2000 Lake
D426,276 S 6/2000 Besnard et al.
D431,854 S 10/2000 Cameron
D432,192 S 10/2000 Hicks
D436,151 S 1/2001 Nicolette et al.
D437,374 S 2/2001 Cameron
D441,820 S 5/2001 Nicolette et al.
6,234,915 B1 * 5/2001 Wu ..... A63B 53/0487 473/307
D443,668 S 6/2001 Nicolette et al.
D443,905 S 6/2001 Nicolette et al.
D444,833 S 7/2001 Wells et al.
6,264,571 B1 * 7/2001 Lekavich ..... A63B 53/007 60/341
6,287,215 B1 * 9/2001 Fisher ..... A63B 53/007 473/309
D449,664 S 10/2001 Beebe et al.
D449,865 S 10/2001 Fife, Jr. et al.
D450,799 S 11/2001 Nicolette et al.
D451,973 S 12/2001 Wells et al.
6,348,014 B1 2/2002 Chiu
6,354,959 B1 * 3/2002 Nicolette ..... A63B 53/02 473/340
6,394,910 B1 5/2002 McCarthy
6,478,694 B2 * 11/2002 Anderson ..... A63B 53/0487 473/340
D472,949 S 4/2003 Serrano
D474,821 S 5/2003 Wells et al.
D474,949 S 5/2003 Schaffeld et al.
6,561,919 B2 * 5/2003 Edel ..... A63B 53/02 473/250
6,638,181 B1 * 10/2003 Norman, III ..... A63B 53/0487 473/341
D483,086 S 12/2003 Schweigert et al.
6,659,883 B2 * 12/2003 Nelson ..... A63B 53/0487 473/340
D486,872 S 2/2004 Schweigert et al.
D488,200 S 4/2004 Olsavsky et al.
D498,276 S 11/2004 Schweigert et al.
6,902,496 B2 6/2005 Solheim et al.
D512,116 S 11/2005 Miraflor et al.
6,988,956 B2 1/2006 Cover et al.
6,997,819 B2 2/2006 Naylor et al.
D520,088 S 5/2006 Parr
7,077,760 B2 * 7/2006 Gray ..... A63B 53/02 473/340
D531,242 S 10/2006 Adams
D532,067 S 11/2006 Soracco et al.
7,153,220 B2 12/2006 Lo
D534,595 S 1/2007 Hasebe
7,156,752 B1 1/2007 Bennett
7,163,465 B2 * 1/2007 Edel ..... A63B 60/02 473/307
D536,401 S 2/2007 Kawami
D536,403 S 2/2007 Kawami
D538,371 S 3/2007 Kawami
7,201,668 B1 4/2007 Pamias
7,204,765 B2 4/2007 Cover et al.
D542,869 S 5/2007 Adams
D543,598 S 5/2007 Kuan et al.
D543,601 S 5/2007 Kawami
D555,219 S 11/2007 Lin
D556,277 S 11/2007 Broom
7,309,297 B1 12/2007 Solari
D561,854 S 2/2008 Morris
7,331,876 B2 2/2008 Klein
7,351,162 B2 4/2008 Soracco et al.
D569,461 S 5/2008 Morris
D569,930 S 5/2008 Nehrbas
7,396,289 B2 7/2008 Soracco et al.
7,416,494 B2 8/2008 Edel
D577,085 S 9/2008 Nicolette et al.
D577,086 S 9/2008 Nicolette et al.
D579,506 S 10/2008 Nicolette et al.
D579,995 S 11/2008 Nicolette et al.
D582,497 S 12/2008 Rollinson
7,462,110 B2 12/2008 Yamamoto
7,473,189 B2 1/2009 Schweigert et al.
7,491,131 B2 2/2009 Vinton
D595,793 S 7/2009 Rollinson
D599,425 S 9/2009 Laub
D600,763 S 9/2009 Cameron
7,744,485 B2 * 6/2010 Jones ..... A63B 60/02 473/409
D620,993 S 8/2010 Laub
D621,461 S 8/2010 Serrano et al.
D623,709 S 9/2010 Serrano et al.
D631,925 S 2/2011 Broom
7,887,432 B2 2/2011 Jones et al.
7,909,707 B2 3/2011 Klein
7,918,745 B2 4/2011 Morris et al.
D638,891 S 5/2011 Nicolette et al.

(56) References Cited

U.S. PATENT DOCUMENTS

D642,643 S 8/2011 Nicolette et al.
D643,485 S 8/2011 Nicolette et al.
D645,104 S 9/2011 Nicolette et al.
8,096,039 B2 1/2012 Soracco et al.
D653,718 S 2/2012 Stokke et al.
D661,753 S 6/2012 Cameron et al.
D666,260 S 8/2012 Cynn
8,257,196 B1 * 9/2012 Abbott ..... A63B 60/02 473/335
8,371,958 B2 2/2013 Treadwell
8,376,878 B2 2/2013 Bennett et al.
D688,339 S 8/2013 Hilton et al.
D688,341 S 8/2013 Rollinson
D691,226 S 10/2013 Hilton et al.
8,636,607 B2 * 1/2014 Renna ..... A63B 53/0487 473/340
D699,308 S 2/2014 Rollinson
8,696,492 B1 4/2014 Hocknell et al.
D704,782 S 5/2014 Rollinson
8,721,472 B2 5/2014 Kuan et al.
8,753,225 B1 * 6/2014 Abbott ..... A63B 53/0466 473/335
8,790,193 B2 7/2014 Serrano et al.
D711,483 S 8/2014 Wong
D715,388 S 10/2014 Serrano et al.
8,870,674 B1 10/2014 Abbott
D722,350 S 2/2015 Schweigert
D722,351 S 2/2015 Parsons et al.
D722,352 S 2/2015 Nicolette et al.
D723,120 S 2/2015 Nicolette
8,961,336 B1 * 2/2015 Parsons ..... A63B 53/0475 473/335
D724,164 S 3/2015 Schweigert et al.
D725,208 S 3/2015 Schweigert
D726,265 S 4/2015 Nicolette
D726,846 S 4/2015 Schweigert
D730,462 S 5/2015 Becktor et al.
D732,122 S 6/2015 Becktor
D732,618 S 6/2015 Becktor et al.
D733,234 S 6/2015 Nicolette
9,079,077 B2 * 7/2015 Wolf ..... A63B 60/32
9,108,092 B1 * 8/2015 Warner ..... A63B 53/06
D738,447 S 9/2015 Schweigert
D738,449 S 9/2015 Schweigert
D739,487 S 9/2015 Schweigert
D741,426 S 10/2015 Schweigert
D748,213 S 1/2016 Parsons et al.
D748,215 S 1/2016 Parsons et al.
9,272,193 B1 3/2016 Yim
D753,252 S 4/2016 Schweigert
9,545,544 B2 * 1/2017 Jones ..... A63B 53/0487
9,573,027 B2 * 2/2017 Nivanh ..... A63B 60/00
9,604,108 B1 * 3/2017 Dunnell ..... A63B 60/02
9,675,854 B2 * 6/2017 Wang ..... A63B 60/42
9,744,410 B1 * 8/2017 Foster ..... A63B 53/007
9,808,680 B1 * 11/2017 Myers ..... A63B 53/065
9,873,029 B1 * 1/2018 Sillies ..... A63B 60/02
9,925,427 B2 * 3/2018 Bischmann ..... A63B 53/007
9,956,463 B2 * 5/2018 Franklin ..... A63B 60/54
10,493,331 B2 * 12/2019 Kroloff ..... A63B 60/42
10,737,153 B2 8/2020 Schweigert et al.
10,960,271 B2 * 3/2021 Kroloff ..... A63B 53/0487
11,311,781 B2 * 4/2022 Kroloff ..... A63B 53/02
11,517,798 B2 * 12/2022 Kroloff ..... A63B 60/52
2002/0077193 A1 6/2002 Takeda
2002/0193174 A1 * 12/2002 Edel ..... A63B 60/00 473/305
2003/0199332 A1 10/2003 Lindsay
2004/0014532 A1 * 1/2004 Lee ..... A63B 53/0487 473/340
2004/0138003 A1 7/2004 Grace
2004/0180730 A1 9/2004 Franklin et al.
2006/0030420 A1 * 2/2006 Roake ..... A63B 60/02 473/340
2006/0052178 A1 3/2006 Franklin et al.
2006/0094522 A1 5/2006 Tang et al.
2006/0142095 A1 * 6/2006 Glickman ..... A63B 53/065 473/340
2006/0223649 A1 * 10/2006 Rife ..... A63B 60/02 473/340
2007/0021235 A1 * 1/2007 Jung ..... A63B 53/0487 473/340
2007/0129163 A1 6/2007 Solari
2007/0135232 A1 * 6/2007 Billings ..... A63B 53/0487 473/340
2007/0142122 A1 6/2007 Bonneau
2007/0149316 A1 * 6/2007 Nishino ..... A63B 60/02 473/335
2007/0207875 A1 9/2007 Kuan et al.
2007/0238548 A1 10/2007 Johnson
2007/0243950 A1 * 10/2007 Billings ..... A63B 53/065 473/340
2008/0139333 A1 6/2008 Klein
2008/0146372 A1 6/2008 John
2008/0176672 A1 7/2008 Roach et al.
2009/0029800 A1 1/2009 Jones et al.
2009/0156328 A1 6/2009 Reese
2009/0163287 A1 6/2009 Vald Via et al.
2009/0239678 A1 * 9/2009 De La Cruz ..... A63B 53/02 473/305
2009/0298611 A1 * 12/2009 Bezilla ..... A63B 53/0466 473/335
2009/0298612 A1 * 12/2009 Knutson ..... A63B 60/00 473/335
2010/0035700 A1 2/2010 Yu et al.
2010/0255922 A1 * 10/2010 Lueders ..... A63B 53/02 473/223
2010/0317454 A1 12/2010 Sato et al.
2010/0323815 A1 * 12/2010 Bezilla ..... A63B 53/04 473/335
2011/0165959 A1 7/2011 Klein
2012/0244957 A1 * 9/2012 McClung ..... A63B 60/00 473/316
2013/0165256 A1 6/2013 Stevenson
2013/0203522 A1 8/2013 Franklin et al.
2013/0210537 A1 8/2013 Ainscough et al.
2013/0244808 A1 * 9/2013 Bennett ..... A63B 53/06 473/335
2014/0179459 A1 * 6/2014 Schartiger ..... A63B 53/007 473/324
2014/0349779 A1 * 11/2014 Mizutani ..... A63B 53/06 473/335
2014/0378238 A1 * 12/2014 Voges ..... A63B 71/0619 473/409
2015/0005097 A1 * 1/2015 Motokawa ..... A63B 60/00 473/338
2015/0087439 A1 * 3/2015 Song ..... A63B 60/02 473/335
2015/0231454 A1 * 8/2015 Parsons ..... A63B 53/0475 473/335
2015/0231806 A1 * 8/2015 Parsons ..... A63B 53/0475 264/261
2015/0306477 A1 * 10/2015 Parsons ..... A63B 60/02 473/335
2015/0328505 A1 * 11/2015 Nicolette ..... A63B 53/047 473/331
2016/0016050 A1 1/2016 Rife et al.
2016/0016055 A1 * 1/2016 DiMarco ..... F16B 23/00 473/335
2016/0346649 A1 12/2016 Jertson et al.
2018/0001163 A1 1/2018 Becktor et al.
2018/0056154 A1 * 3/2018 Wallin ..... A63B 60/02
2018/0221737 A1 8/2018 Morales et al.
2018/0311545 A1 11/2018 Lambeth et al.
2018/0361206 A1 12/2018 Becktor et al.
2019/0175995 A1 * 6/2019 Kroloff ..... A63B 53/0433
2019/0175996 A1 * 6/2019 Kroloff ..... A63B 53/0487
2020/0061421 A1 * 2/2020 Kroloff ..... A63B 53/04
2021/0113898 A1 * 4/2021 Kroloff ..... A63B 53/02

(56) References Cited

U.S. PATENT DOCUMENTS

| | | | | |
|---|---|---|---|---|
| 2022/0212071 | A1* | 7/2022 | Kroloff | A63B 60/42 |
| 2022/0233920 | A1* | 7/2022 | Bryant | A63B 60/52 |

FOREIGN PATENT DOCUMENTS

| | | | | | |
|---|---|---|---|---|---|
| EP | 0691142 | A1 | * | 1/1996 | |
| GB | 2334454 | A | * | 8/1999 | A63B 53/0487 |
| JP | 0666724 | U | * | 9/1994 | |
| JP | 0966124 | A | * | 3/1997 | |
| JP | 2005160691 | A | | 6/2005 | |
| JP | 2007275253 | A | * | 10/2007 | A63B 53/0466 |
| JP | 2010069106 | A | * | 4/2010 | A63B 53/0466 |
| JP | 2010148702 | A | * | 7/2010 | A63B 53/0466 |
| KR | 200195183 | Y1 | * | 1/2000 | |
| KR | 20130005384 | A | * | 1/2013 | |
| KR | 101401409 | B1 | * | 5/2014 | |
| TW | M306124 | U | * | 2/2007 | |
| WO | 2006087846 | A1 | | 8/2006 | |

OTHER PUBLICATIONS

U.S. Appl. No. 29/523,587, Schweigert, "Golf Club Head," filed Apr. 10, 2015.

* cited by examiner

GOLF CLUB HEADS AND METHODS TO MANUFACTURE GOLF CLUB HEADS

CROSS REFERENCE

This application is a continuation-in-part of application Ser. No. 17/472,321, filed Sep. 10, 2021, which is a continuation of application Ser. No. 16/940,806, filed Jul. 28, 2020, now U.S. Pat. No. 11,141,635, which is a continuation of U.S. application Ser. No. 16/006,055, filed Jun. 12, 2018, now U.S. Pat. No. 10,737,153, which claims the benefit of U.S. Provisional Application No. 62/518,715, filed Jun. 13, 2017, U.S. Provisional Application No. 62/533,481, filed Jul. 17, 2017, U.S. Provisional Application No. 62/536,266, filed Jul. 24, 2017, U.S. Provisional Application No. 62/644,233, filed Mar. 16, 2018, and U.S. Provisional Application No. 62/659,060, filed Apr. 17, 2018.

U.S. patent application Ser. No. 16/940,806, filed Jul. 28, 2020, is a continuation-in-part of application Ser. No. 15/987,731, filed May 23, 2018, now U.S. Pat. No. 10,821,341, which claims the benefit of U.S. Provisional Application No. 62/518,715, filed Jun. 13, 2017, U.S. Provisional Application No. 62/533,481, filed Jul. 17, 2017, U.S. Provisional Application No. 62/536,266, filed Jul. 24, 2017, and U.S. Provisional Application No. 62/574,071, filed Oct. 18, 2017.

U.S. application Ser. No. 15/987,731 is a continuation-in-part of application Ser. No. 15/188,661, filed Jun. 21, 2016, now U.S. Pat. No. 10,441,858, which is a continuation of application Ser. No. 14/812,212, filed Jul. 29, 2015, now U.S. Pat. No. 9,387,375, which claims the benefit of U.S. Provisional Application No. 62/030,820, filed Jul. 30, 2014, and U.S. Provisional Application No. 62/146,114, filed Apr. 10, 2015.

U.S. application Ser. No. 15/987,731 is a continuation-in-part of application Ser. No. 15/489,366, filed Apr. 17, 2017, now U.S. Pat. No. 10,124,212, which is a continuation of application Ser. No. 15/078,749, filed Mar. 23, 2016, now U.S. Pat. No. 9,649,540, which claims the benefit of U.S. Provisional Application No. 62/138,925, filed Mar. 26, 2015, U.S. Provisional Application No. 62/212,462, filed Aug. 31, 2015, and U.S. Provisional Application No. 62/213,933, filed Sep. 3, 2015.

U.S. application Ser. No. 15/987,731 is a continuation-in-part of application Ser. No. 15/831,151, filed Dec. 4, 2017, now U.S. Pat. No. 10,478,680, which claims the benefit of U.S. Provisional Application No. 62/431,157, filed Dec. 7, 2016.

U.S. application Ser. No. 15/987,731 is a continuation-in-part of application Ser. No. 15/922,506, filed Mar. 15, 2018, now abandoned, which claims the benefit of U.S. Provisional Application No. 62/480,338, filed Mar. 31, 2017.

U.S. application Ser. No. 17/472,321 is a continuation-in-part of application Ser. No. 16/866,991, filed May 5, 2020, now U.S. Pat. No. 11,173,361, which is a continuation of application Ser. No. 16/283,390, filed Feb. 22, 2019, now U.S. Pat. No. 10,646,758, which is a continuation of application Ser. No. 14/962,953, filed Dec. 8, 2015, now U.S. Pat. No. 10,258,844, which is a continuation of application Ser. No. 14/686,466, filed Apr. 14, 2015, now U.S. Pat. No. 9,233,283, which claims the benefit of U.S. Provisional Application No. 61/985,351, filed Apr. 28, 2014, U.S. Provisional Application No. 61/992,379, filed May 13, 2014, U.S. Provisional Application No. 62/015,297, filed Jun. 20, 2014, U.S. Provisional Application No. 62/030,820, filed Jul. 30, 2014, and U.S. Provisional Application No. 62/059,108, filed Oct. 2, 2014.

U.S. patent application Ser. No. 16/866,991, filed May 5, 2020, is a continuation-in-part of application Ser. No. 16/400,128, filed May 1, 2019, now U.S. Pat. No. 10,688,355, which is a continuation of application Ser. No. 15/816,517, filed Nov. 17, 2017, now U.S. Pat. No. 10,315,080, which is a continuation of application Ser. No. 15/150,006, filed May 9, 2016, now U.S. Pat. No. 10,258,845, which is a continuation-in-part of application Ser. No. 14/586,720, filed Dec. 30, 2014, now U.S. Pat. No. 9,440,124, which claims the benefit of U.S. Provisional Application No. 62/041,553, filed Aug. 25, 2014.

This application is a continuation-in-part of application Ser. No. 17/706,782, filed Mar. 29, 2022, which is a continuation of application Ser. No. 16/674,332, filed Nov. 5, 2019, now U.S. Pat. No. 11,311,781, which is a continuation of application Ser. No. 16/275,883, filed Feb. 14, 2019, now U.S. Pat. No. 10,493,331, which claims the benefit of U.S. Provisional Application No. 62/745,194, filed Oct. 12, 2018, and U.S. Provisional Application No. 62/755,241, filed Nov. 2, 2018.

This application is a continuation-in-part of Application Ser. No. 17/344,705, filed Jun. 10, 2021, which is a continuation of application Ser. No. 16/751,500, filed Jan. 24, 2020, now U.S. Pat. No. 11,045,698, which claims the benefit of U.S. Provisional Application No. 62/798,277, filed Jan. 29, 2019.

U.S. application Ser. No. 16/751,500 is a continuation-in-part of application Ser. No. 16/035,271, filed Jul. 13, 2018, now U.S. Pat. No. 10,576,339, which claims the benefit of U.S. Provisional Application No. 62/533,481, filed Jul. 17, 2017.

This application is a continuation-in-part of application Ser. No. 17/378,252, filed Jul. 16, 2021, which is a continuation of application Ser. No. 17/232,401, filed Apr. 16, 2021, now U.S. Pat. No. 11,090,535, which is a continuation of application Ser. No. 16/567,937, filed Sep. 11, 2019, now U.S. Pat. No. 10,981,038.

This application is a continuation of application Ser. No. 17/123,325, filed Dec. 16, 2020, which claims the benefit of U.S. Provisional Application No. 62/949,064, filed Dec. 17, 2019.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Golf club heads may be manufactured using various materials and processes. For example, putter-type golf club heads often lack adjustable weighting features. As a result, an individual desiring a particular putter design may be unable to change the weight characteristics of the putter to better suit their playstyle. To remedy the problem outlined above, the present disclosure provides an adjustable weighting feature adaptable to any putter-type golf club head.

Figure 1:
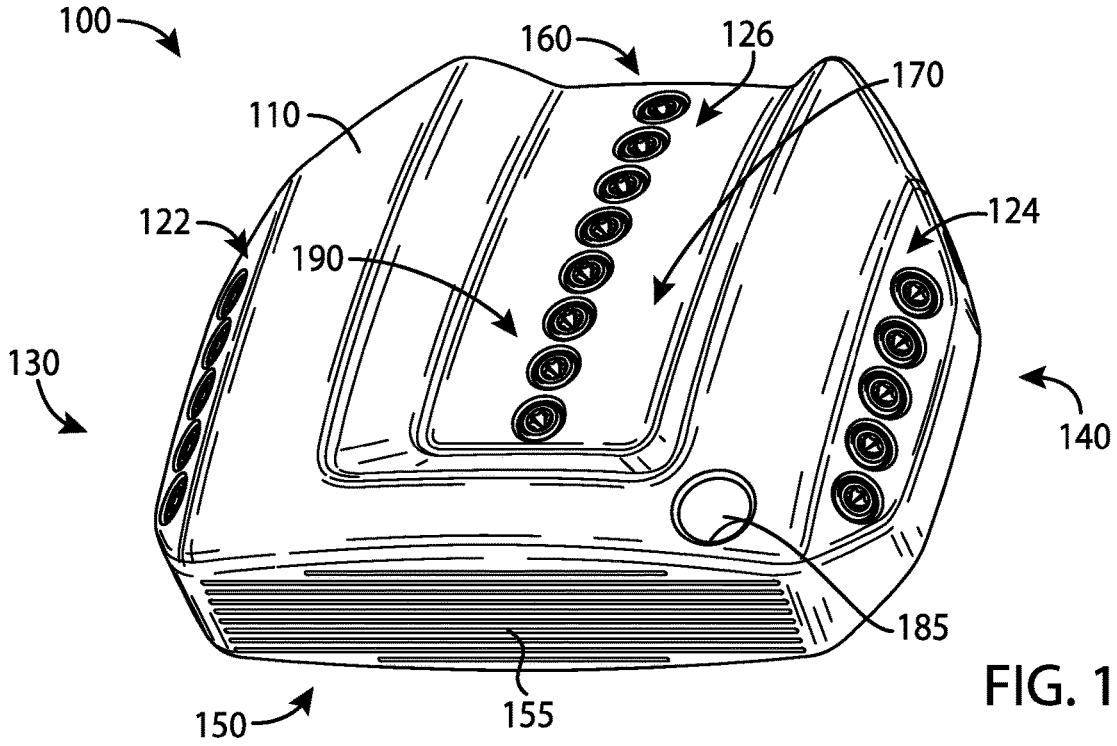
FIG. 1 depicts a front and top perspective view of a golf club head according to an example of the apparatus, methods, and articles of manufacture described herein.
Figure 2:
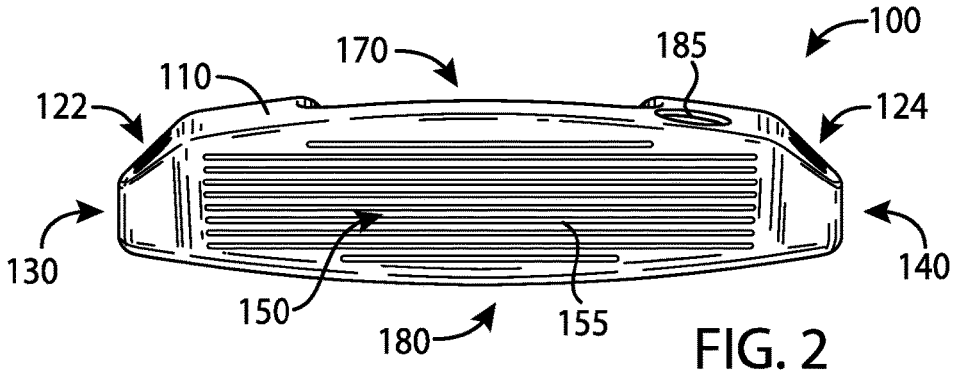
FIG. 2 depicts a front view of the example golf club head of FIG. 1.
Figure 3:
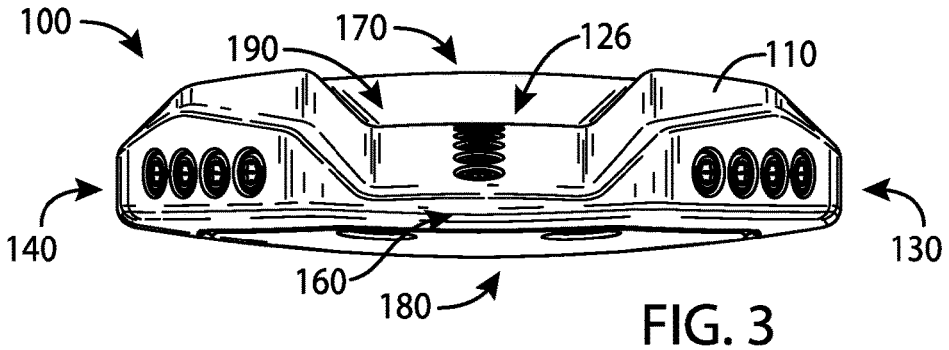
FIG. 3 depicts a rear view of the example golf club head of FIG. 1.
Figure 4:
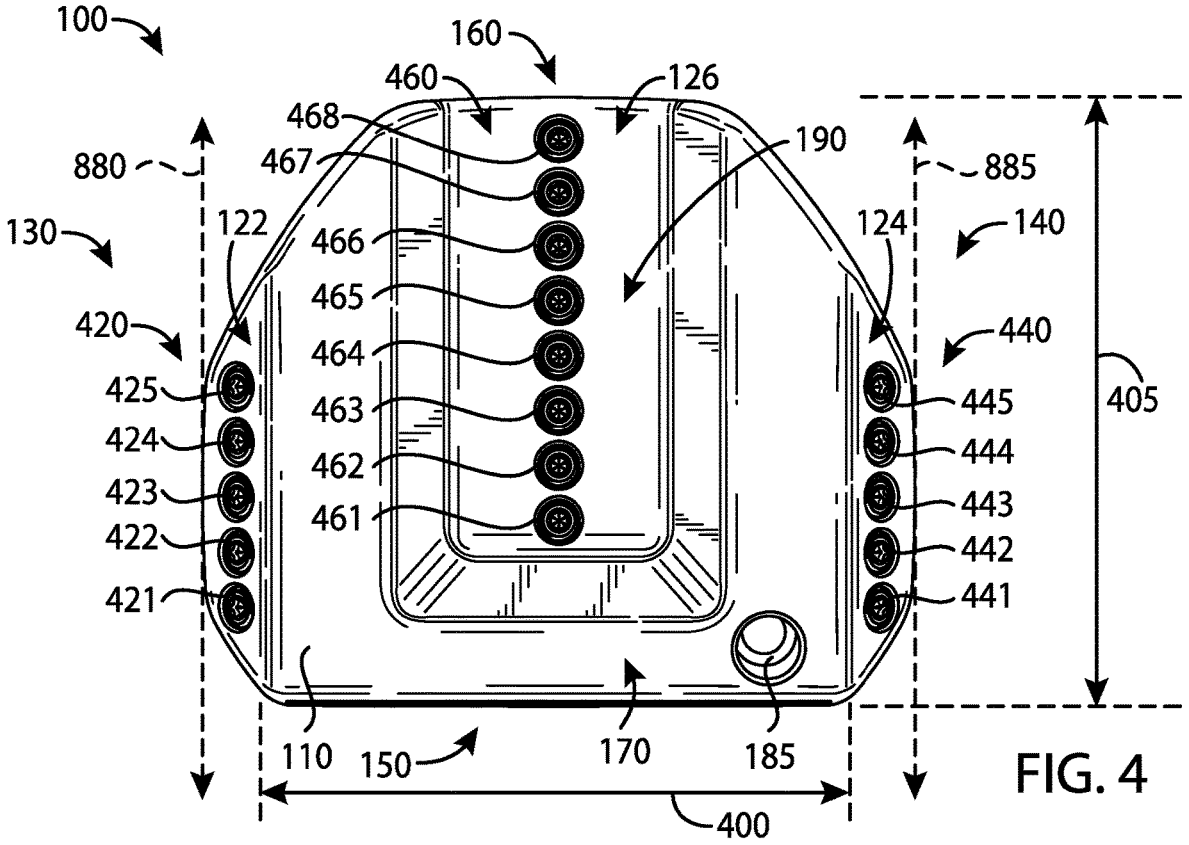
FIG. 4 depicts a top view of the example golf club head of FIG. 1.
Figure 5:
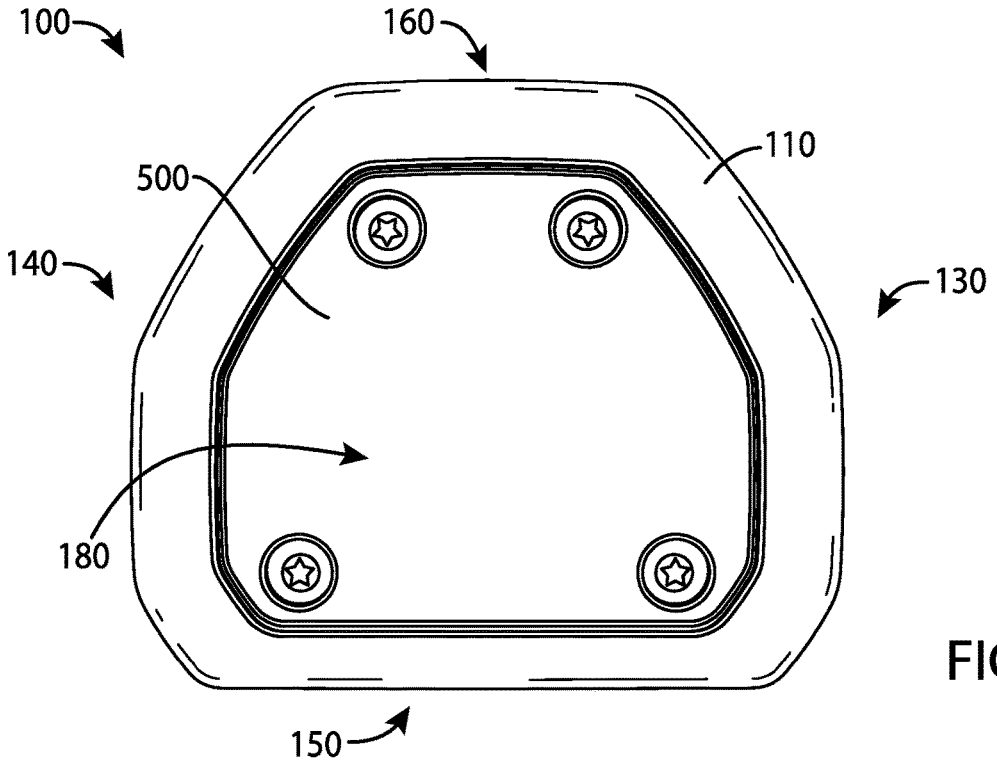
FIG. 5 depicts a bottom view of the example golf club head of FIG. 1.
Figure 6:
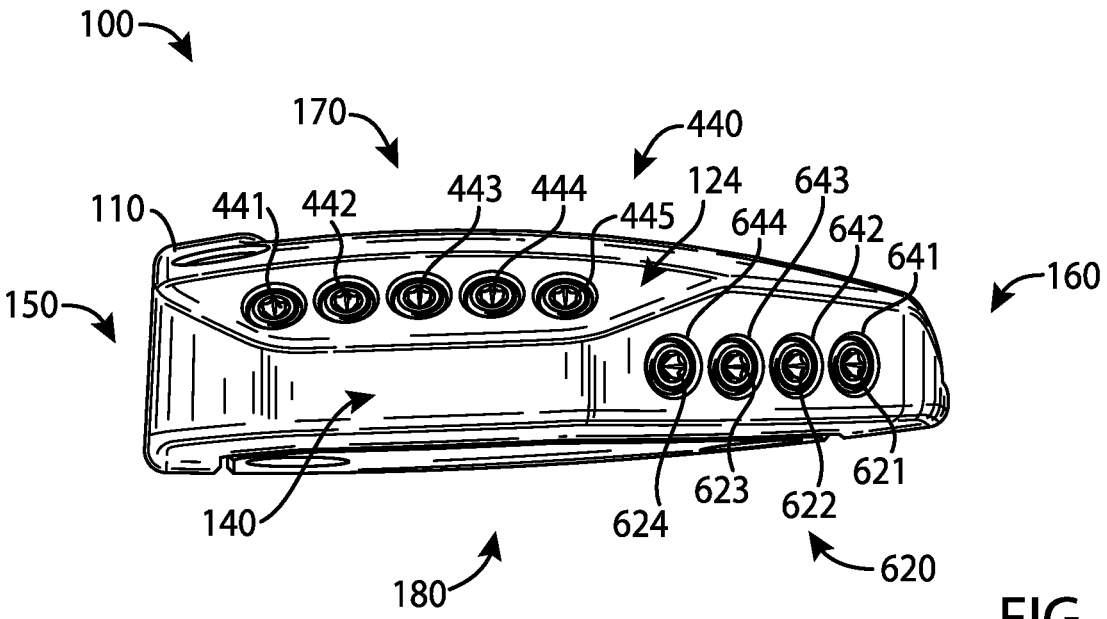
FIG. 6 depicts a left view of the example golf club head of FIG. 1.
Figure 7:
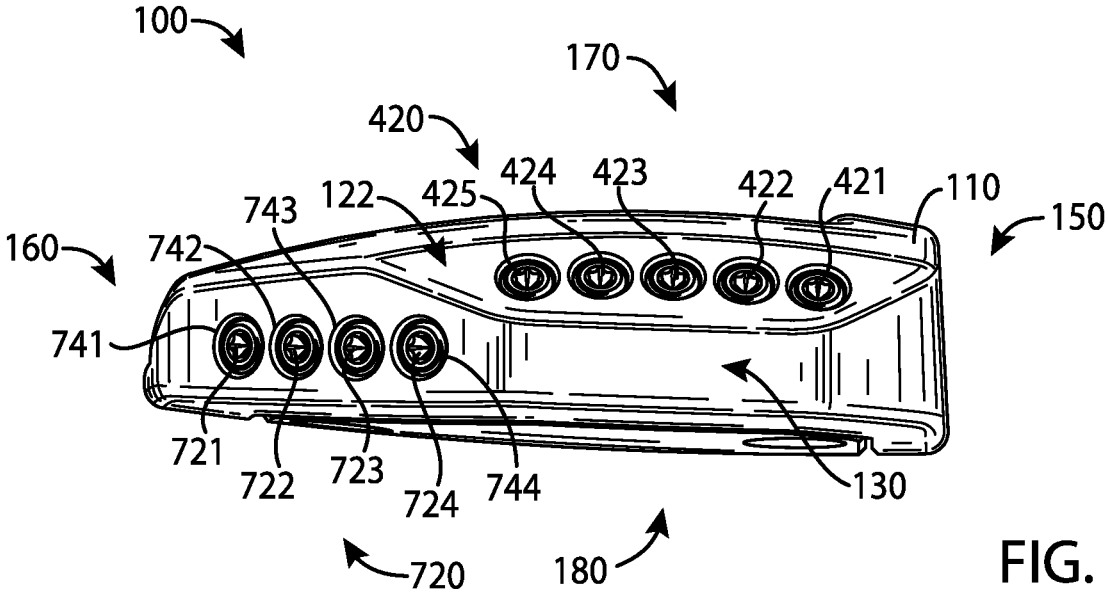
FIG. 7 depicts a right view of the example golf club head of FIG. 1.
Figure 8:
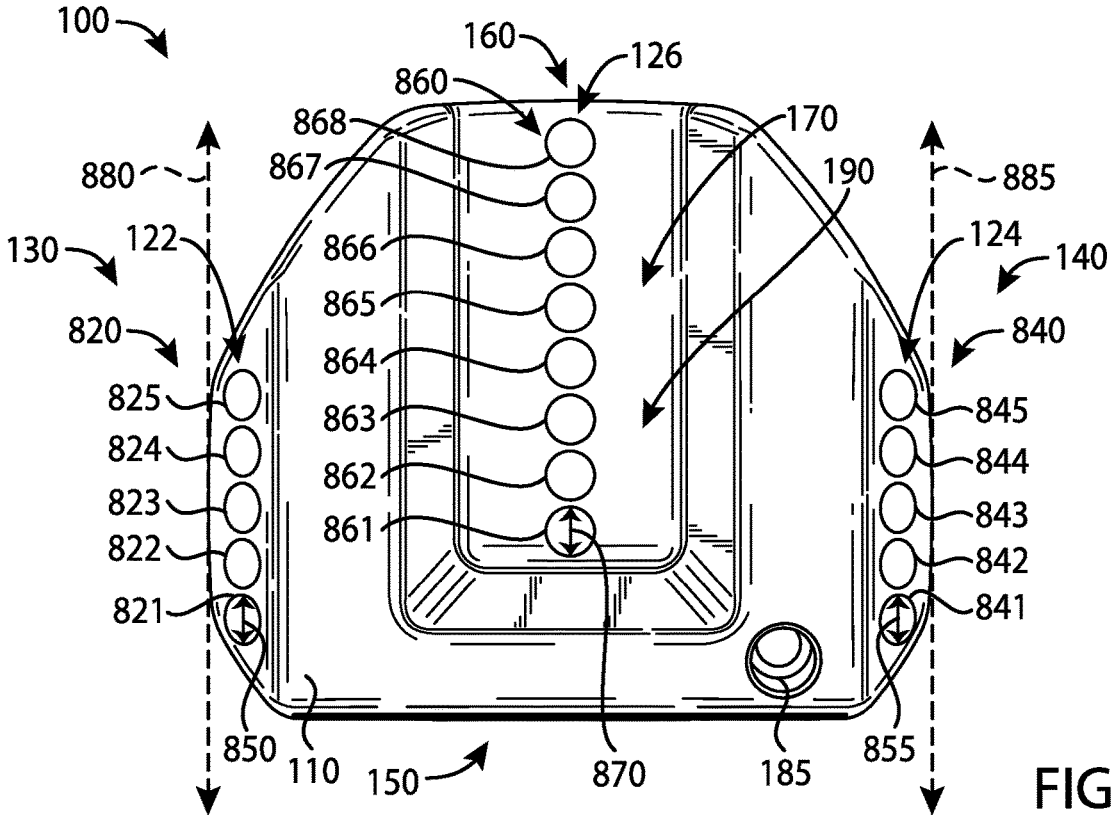
FIG. 8 depicts a top view of a body portion of the example golf club head of FIG. 1.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of examples of the present disclosure.

DESCRIPTION

In general, golf club heads and methods to manufacture golf club heads are described herein. The apparatus, methods, and articles of manufacture described herein are not limited in this regard.

In the example of FIG. 1, a golf club 100 may include a golf club head 110, a shaft 120 extending from the golf club head 110, and a grip 130 at the butt end of the shaft 120. The golf club 100 may be a blade-type putter, a mid-mallet-type putter, a mallet-type putter, or any other putter-type golf club. The particular putter-type may be determined based on an individual's putting stroke. While the golf club 100 is shown in a right-handed configuration, the teachings of the present disclosure may be readily adapted to a left-handed golf club. The apparatus, methods, and articles of manufacture described herein are not limited in this regard.

In the example of FIGS. 2-8, a golf club head 200 similar to the golf club head 110 of FIG. 1 is shown and may include a body portion 210 having a toe portion 230, a heel portion 240, a front portion 250 with a face portion 255 (e.g., a strike face) used to impact a golf ball (not shown), a rear portion 260, a top portion 270, and a sole portion 280. The toe and heel portions 230 and 240, respectively, may be on opposite ends of the body portion 210 and may define a length of the body portion 210. The front and rear portions 250 and 260, respectively, may be on opposite ends of the body portion 210 and may define a width of the body portion 210. The body portion 210 may be partially or entirely made of a steel-based material (e.g., 303 stainless steel), a titanium-based material, a magnesium-based material, an aluminum-based material (e.g., a high-strength aluminum alloy or a composite aluminum alloy coated with a high-strength alloy), a tungsten-based material, any combination thereof, and/or other suitable types of materials. Alternatively, the body portion 210 may be partially or entirely made of a non-metal material (e.g., composite, plastic, etc.). In one example, the body portion 210 may be entirely made of a steel-based material with a Rockwell hardness of 70-90 HRB. In another example, the body portion 210 may be entirely made of an aluminum-based material with a Rockwell hardness of 50-70 HRB. The apparatus, methods, and articles of manufacture described herein are not limited in this regard.

The face portion 255 may be an integral portion of the body portion 210 (e.g., formed via a milling process). Alternatively, the face portion 255 may be a separate piece or an insert coupled to the body portion 210 via various manufacturing and/or processes (e.g., a bonding process, a welding process, a brazing process, a mechanical locking method, a mechanical fastening method, any combination thereof, or other suitable types of manufacturing methods and/or processes). The face portion 255 may be associated with a loft plane that defines the loft angle of the golf club head 110. The apparatus, methods, and articles of manufacture described herein are not limited in this regard.

The golf club head 200 may also include a hosel portion 290 at the top portion 270 or elsewhere on the body portion 210. The hosel portion 290 may be an integral portion of the body portion 210. Alternatively, the hosel portion 290 may be a separate piece coupled to the body portion 210 via various manufacturing and/or processes (e.g., a bonding process, a welding process, a brazing process, a mechanical locking method, a mechanical fastening method, any combination thereof, or other suitable types of manufacturing methods and/or processes). The hosel portion 290 may be partially or entirely made of a steel-based material, a titanium-based material, a magnesium-based material, an aluminum-based material (e.g., a high-strength aluminum alloy or a composite aluminum alloy coated with a high-strength alloy), a tungsten-based material, any combination thereof, and/or other suitable types of materials. Alternatively, the hosel portion 290 may be partially or entirely made of a non-metal material (e.g., composite, plastic, etc.). In one example, the hosel portion 290 may be entirely made of a steel-based material with a Rockwell hardness of 70-90 HRB. In another example, the hosel portion 290 may be entirely made of an aluminum-based material with a Rockwell hardness of 50-70 HRB. Accordingly, the hosel portion 290 may be made from the same material or a different material as the body portion 210. The apparatus, methods, and articles of manufacture described herein are not limited in this regard.

The body portion 210 may include a visual guide portion 300 to aid an individual in lining up the golf club head 200 with his or her intended target line. The visual guide portion 300 may be provided at or proximate the top portion 270 and may extend between the front and rear portions 250 and 260. The visual guide portion 300 is exemplarily shown as a recessed line substantially equidistant from the toe portion 230 and the heel portion 240. The visual guide portion 300 may have a distinct color, marking, and/or other visual feature(s) so as to be visually distinguished from the surrounding portions of the body portion 210. In other examples (not shown), the body portion 210 may be configured with more than one visual guide portion. Alternatively, the body portion 210 may be configured with no visual guide portion at all. The apparatus, methods, and articles of manufacture described herein are not limited in this regard.

The body portion 210 may include a first set of weight ports 510 (e.g., shown as weight ports 511 and 512) and/or a second set of weight ports 520 (e.g., shown as weight ports 521, 522, 523, 524, 525, and 526) at the sole portion 280. The first set of weight ports 510 may be closer to the front portion 250 than to the rear portion 260. One or more weight ports (e.g., shown as weight port 511) of the first set of weight ports 510 may be closer to the heel portion 240 than to the toe portion 230. Additionally or alternatively, one or more weight ports (e.g., shown as weight port 512) may be located closer to the toe portion 230 than to the heel portion 240. The second set of weight ports 520 may be closer to the rear portion 260 than to the front portion 250. One or more weight port (e.g., shown as weight ports 521, 522, and 523) of the second set of weight ports 520 may be closer to the heel portion 240 than to the toe portion 230. The weight ports of the second set of weight ports 520 located closer to the heel portion 240 may be evenly or unevenly spaced to form a dotted line extending between the heel portion 240 and the toe portion 230. Additionally or alternatively, one or more weight port (e.g., shown as weight ports 524, 525, and 526) of the second set of weight ports 520 may be closer to the toe portion 230 than to the heel portion 240. The weight ports of the second set of weight ports 520 located closer to the toe portion 230 may be evenly or unevenly spaced to form a dotted line extending between the toe portion 230 and the heel portion 240. The weight ports of the second set of weight ports 520 may be linearly aligned and may be parallel or substantially parallel with the face portion 255. The apparatus, methods, and articles of manufacture described herein are not limited in this regard.

The first and second set of weight ports 510 and 520, respectively, may have similar or different physical properties (e.g., shape, size, etc.). While the weight ports of the first set of weight ports 510 are shown as being larger (e.g., in diameter and volume) than the weight ports of the second set of weight ports 520, the opposite may hold true in alternative examples. Additionally or alternatively, size differences may exist between weight ports of the first set of weight ports 510 and/or between weight ports of the second set of weight ports 520. While the weight ports of the first and second sets of weight ports 510 and 520, respectively, are shown as having a cylindrical shape (e.g., a circular cross-section), any number of weight ports of the first set of weight ports 510 may have a shape that is similar to or different from a shape of any number of weight ports of the second set of weight ports 520. While the weight ports of the first and second sets of weight ports 510 and 520, respectively, are shown in a particular location at the sole portion 280, the location of one or more weight ports of the first set of weight ports 510 and/or the second set of weight ports 520 may be changed in alternative examples. The apparatus, methods, and articles of manufacture described herein are not limited in this regard.

Each weight port of the first set of weight ports 510 may be configured to receive a weight portion of a first set of weight portions 530 (e.g., shown as weight portions 531 and 532). The weight portions of the first set of weight portions 530 may have a cylindrical shape to complement the shape of the weight ports of the first set of weight ports 510. The weight portions of the first set of weight portions 530 may be interchangeable with one another. As such, each weight port of the first set of weight ports 510 may be configured to interchangeably receive any of the weight portions of the first set of weight portions 530. While the first set of weight ports 510 is shown totaling two in number, the first set of weight ports 510 may have more or less than two weight ports in alternative examples. Accordingly, the number of weight portions of the first set of weight portions 530 may increase or decrease to match the number of weight ports of the first set of weight ports 510. In some examples, one or more weight ports of the first set of weight ports 510 may be left unoccupied if desired. The apparatus, methods, and articles of manufacture described herein are not limited in this regard.

Each weight port of the second set of weight ports 520 may be configured to receive a weight portion of a second set of weight portions 540 (e.g., shown as weight portions 541, 542, 543, 544, 545, and 546). The weight portions of the second set of weight portions 540 may have a cylindrical shape to complement the shape of the weight ports of the second set of weight ports 520. The weight portions of the second set of weight portions 540 may be interchangeable with one another. As such, each weight port of the second set of weight ports 520 may be configured to interchangeably receive any of the weight portions of the second set of weight portions 540. While the second set of weight ports 520 is shown totaling six in number, the second set of weight ports 520 may have more or less than six weight ports in alternative examples. Accordingly, the number of weight portions of the second set of weight portions 540 may increase or decrease to match the number of weight ports of the second set of weight ports 520. In some examples, one or more weight ports of the second set of weight ports 520 may be left unoccupied if desired. The apparatus, methods, and articles of manufacture described herein are not limited in this regard.

The first and second sets of weight portions 530 and 540, respectively, may have similar or different physical properties (e.g., color, shape, size, density, mass, volume, etc.). As a result, the first and second sets of weight portions 530 and 540, respectively, may contribute to the functional and/or ornamental design of the golf club head 200. For example, the first and second sets of weight portions 530 and 540, respectively, may be partially or entirely made of a high-density material such as a tungsten-based material or other suitable types of materials. In the example of FIGS. 2-8, the first and second sets of weight portions 530 and 540, respectively, may be tungsten-allow screws. In another example, the first and second sets of weight portions 530 and 540, respectively, may be made of a tungsten-based material, a steel-based material, a titanium-based material, or any combination thereof. In yet another example, the first and second sets of weight portions 530 and 540, respectively, may be partially or entirely made of a non-metal material (e.g., composite, plastic, etc.). The apparatus, methods, and articles of manufacture described herein are not limited in this regard.

In the example of FIGS. 9-15, a face portion 900 of a golf club head including any golf club head described herein may include a strike portion 910, a toe portion 930 having a toe edge 931, a heel portion 940 having a heel edge 941, a top portion 970 having a top edge 971, a sole portion 980 having a sole edge 981, and a center strike portion 985. The toe edge 931, the heel edge 941, the top edge 971, and the sole edge 981 may define a periphery or perimeter 990 of the face portion 900. The center strike portion 985 may be located inside the perimeter 990 and may include a geometric center 991 of the face portion 900. In one example, the face portion 900 may be co-manufactured with a body portion (e.g., body portion 210) of a golf club head (e.g., golf club head 200) to be an integral part of the body portion of the golf club head (e.g., milling and/or other techniques such as grinding, etching, laser milling, etc. to the body portion). In another example, the face portion 900 may be a separate piece from a body portion of a golf club and attached to the body portion by welding, soldering, adhesive bonding, press fitting, and/or other suitable attachment methods. In yet another example, the face portion 900 may be a separate piece from a body portion of a golf club head and attached to the body portion by one or more fasteners such as bolts and/or screws. The apparatus, methods, and articles of manufacture described herein are not limited in this regard.

The strike portion 910 of the face portion 900 may partially or entirely include a plurality of projections 1000 (e.g., two projections generally shown in FIGS. 9-13 as 1001 and 1002). In the example of FIGS. 9-15, the entire strike portion 910 of the face portion 80 may include the plurality of projections 1000. In another example, the strike portion 910 of the face portion 900 may partially include the plurality of projections 1000. In one example, the face portion 900 may be a separate piece and the strike portion 910 may be located opposite a back portion 1010 (FIG. 11) of the face portion 900. The back portion 1010 may be coupled to and/or in contact with a filler material that may at least partially structurally support the face portion 900, dampen noise, and/or reduce vibration when the face portion 900 strikes a golf ball as described herein. The apparatus, methods, and articles of manufacture described herein are not limited in this regard.

Figure 11:
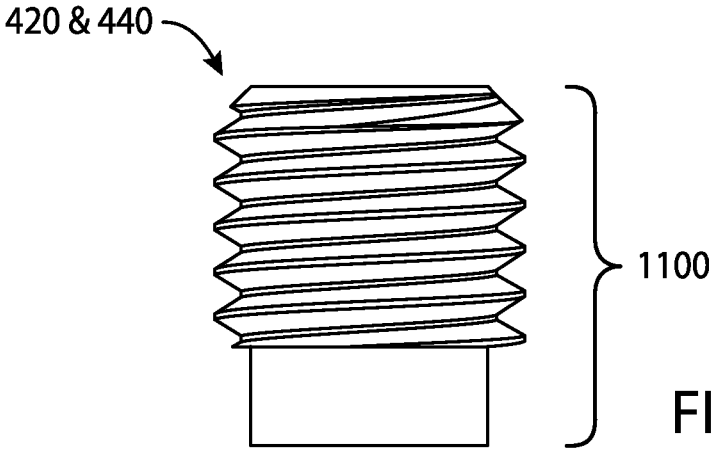
FIG. 11 depicts a side view of a weight portion associated with the example golf club head of FIG. 1.
Figure 12:
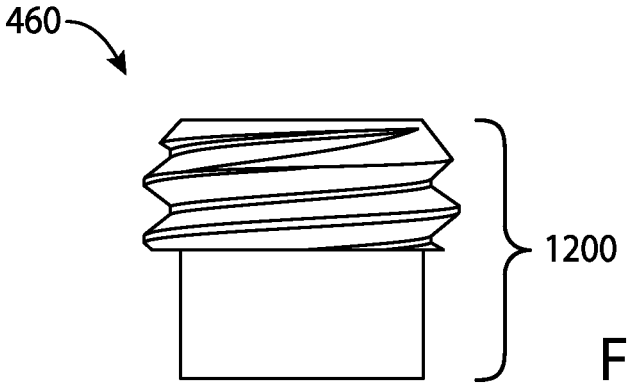
FIG. 12 depicts a side view of another weight portion associated with the example golf club head of FIG. 1.
Figure 13:
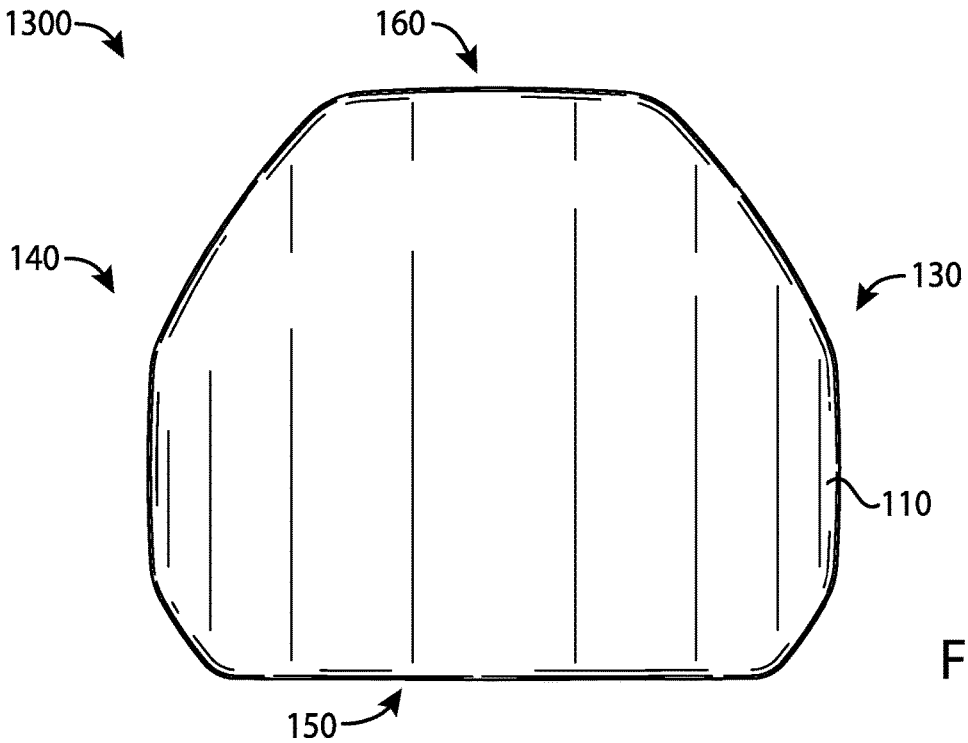
FIG. 13 depicts a bottom view of another example body portion of FIG. 1.

In the example of FIGS. 9-15, each one of the plurality of projections 1000 may be separated from and linearly aligned with an adjacent projection by one of a plurality of grooves 1020 (e.g., one groove generally shown in FIGS. 11-13 as 1021). The plurality of grooves 1020 may be arranged on the strike portion 910 of the face portion 900 in a grid pattern with each grid cell corresponding to one of the plurality of projections 1000 (e.g., one projection shown in FIG. 15 as 1001). In other words, the plurality of projections 1000 may be configured on the strike portion 910 of the face portion 900 in an array defined by the plurality of grooves 1020. The apparatus, methods, and articles of manufacture described herein are not limited in this regard.

Figure 14:
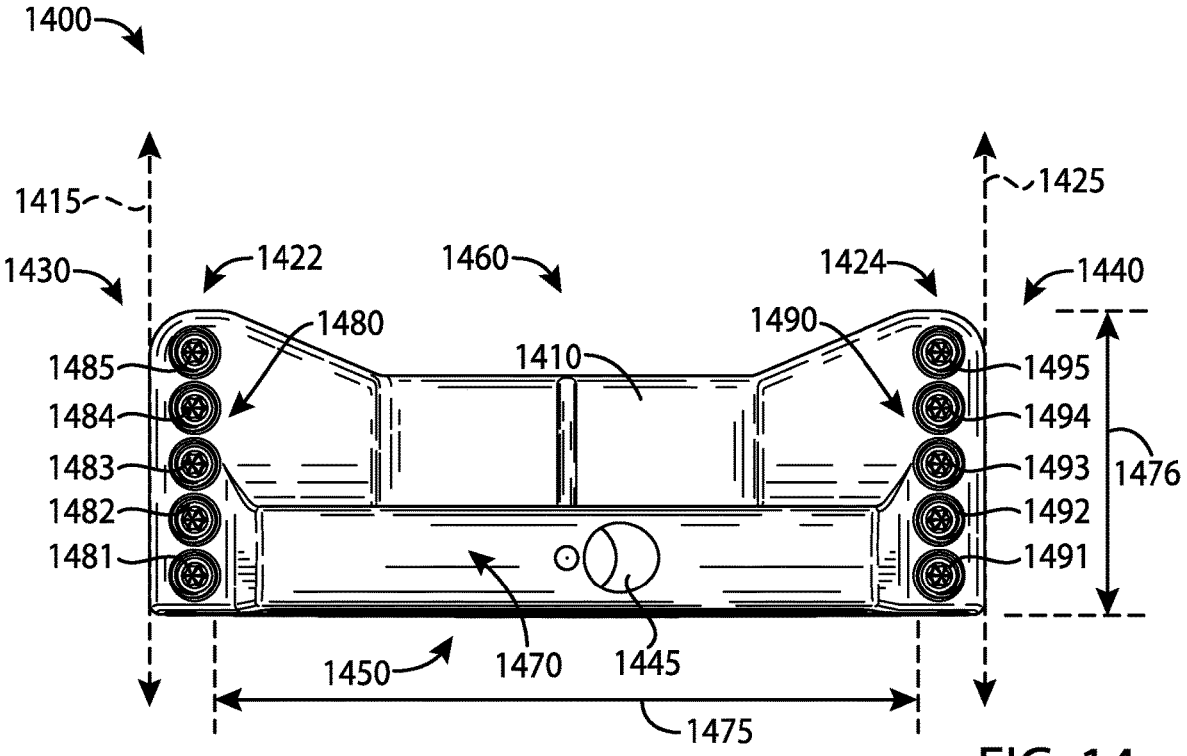
FIG. 14 depicts a top view of a golf club head according to another example of the apparatus, methods, and articles of manufacture described herein.

The plurality of grooves 1020 may include a first plurality of grooves 1030 (FIG. 14) and a second plurality of grooves 1040 (FIG. 14). The first plurality of grooves 1030 may include two or more grooves (e.g., generally shown in FIG. 14 as grooves 1032 and 1033) extending across the strike portion 910 in a first direction (e.g., as indicated in FIG. 14 by direction arrows 1050 and 1055 associated with grooves 1032 and 1033, respectively). The second plurality of grooves 1040 may include two or more grooves (e.g., generally shown in FIG. 14 as grooves 1044 and 1045) extending across the strike portion 910 in a second direction (e.g., as indicated in FIG. 14 by direction arrows 1060 and 1065 associated with grooves 1044 and 1045, respectively). The second direction may be different from the first direction. In one example, the second direction may be transverse to the first direction. Each one of the first plurality of grooves 1030 (e.g., groove 1032) may be linear and may be parallel or substantially parallel with each other one of the first plurality of grooves 1030 (e.g., groove 1033). Similarly, each one of the second plurality of grooves 1040 (e.g., groove 1044) may be linear and may be parallel or substantially parallel with each other one of the second plurality of grooves 1040 (e.g., groove 1045). In another example (not shown), each one of the first plurality of grooves 1030 (e.g., groove 1032) may be non-linear and/or non-parallel with each other one of the first plurality of grooves 1030 Similarly, each one of the second plurality of grooves 1040 (e.g., groove 1044) may be non-linear and/or non-parallel with each other one of the second plurality of grooves 1040 (e.g., groove 1045). The first plurality of grooves 1030 may intersect with the second plurality of grooves 1040. In one example, one or more grooves of the first plurality of grooves 1030 and one or more grooves of the second plurality of grooves 1040 may intersect a horizontal centerline axis 1070 (FIG. 9) of the face portion 900 at a 45 degree angle. In another example, one or more grooves of the first plurality of grooves 1030 and one or more grooves of the second plurality of grooves 1040 may intersect the horizontal centerline axis 1070 at a 60 degree angle. In yet another example, one or more grooves of the first plurality of grooves 1030 and one or more grooves of the second plurality of grooves 1040 may intersect the horizontal centerline axis 1070 at a 30 degree angle. In yet another example, one or more grooves of the first plurality of grooves 1030 and one or more grooves of the second plurality of grooves 1040 may intersect the horizontal centerline axis 1070 at any angle. The apparatus, methods, and articles of manufacture described herein are not limited in this regard.

As generally indicated in FIG. 14 by direction arrows 1050 and 1055, the first direction may include a first diagonal direction extending upwardly from left-to-right across the face portion 900. Accordingly, the first plurality of grooves 1030 may include grooves of the plurality of grooves 1020 extending in the first direction between the toe edge 931 and the top edge 971, between the sole edge 981 and the top edge 971, and between the sole edge 981 and the heel edge 941. The second direction, as generally indicated in FIG. 14 by direction arrows 1060 and 1065, may include a second diagonal direction extending upwardly from right-to-left across the strike portion 910 of the face portion 900. Accordingly, the second plurality of grooves 1040 may include grooves of the plurality of grooves 1020 extending in the second direction between the heel edge 941 and the top edge 971, between the sole edge 981 and the top edge 971, and between the sole edge 981 and the toe edge 931. The apparatus, methods, and articles of manufacture described herein are not limited in this regard.

Figure 15:
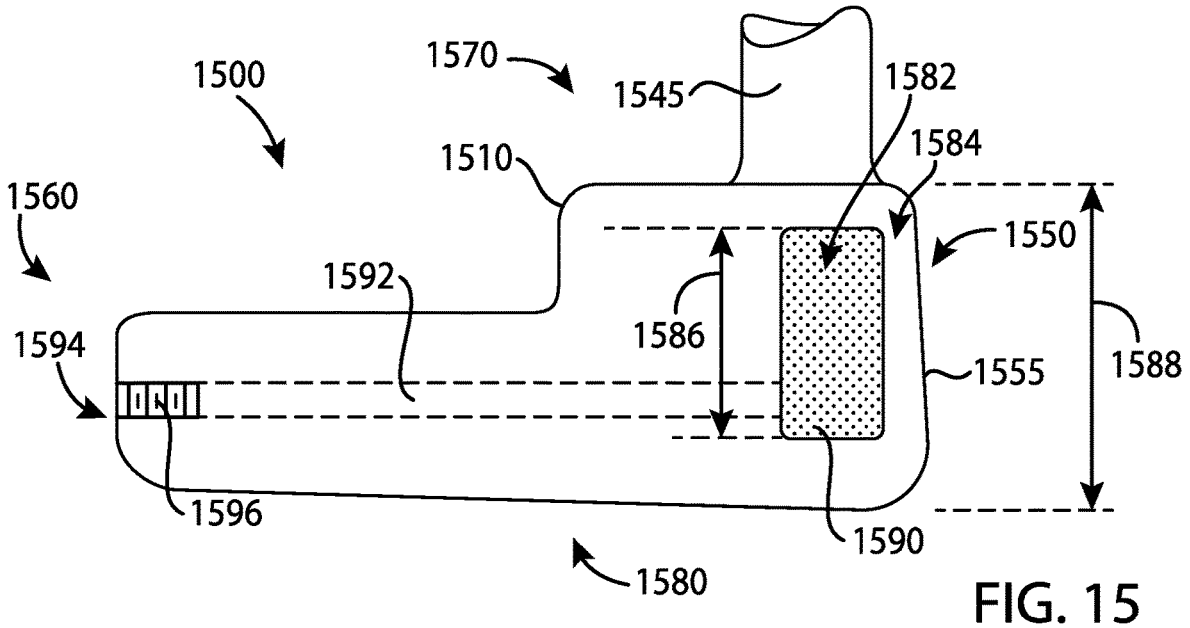
FIG. 15 depicts a schematic cross-sectional view of a golf club head according to yet another example of the apparatus, methods, and articles of manufacture described herein.

In one example, as shown in FIG. 12, a groove, generally shown as groove 1021, may have a truncated V-shaped cross section, or said differently, an inverted trapezoidal cross section. The groove 1021 may have a depth 1110 and a variable width that transitions from a lowermost width 1112 to an uppermost width 1113. In one example, the width of the groove 1021 linearly transitions from the lowermost width 1112 to the uppermost width 1113. The depth 1110 may be greater than or equal to approximately 0.010 inch (0.254 millimeters) and less than or equal to approximately 0.020 inch (0.508 millimeters). The lowermost width 1112, as measured between base portions (e.g., a base portion 1210 of projection 1001 is shown in FIG. 15) of adjacent projections (e.g., projections 1001 and 1002) of the plurality of projections 1000, may be greater than or equal to approximately 0.010 inch (0.254 millimeters) and less than or equal to approximately 0.012 inch (0.305 millimeters). The uppermost width 1113, as measured between peak portions (e.g., a peak portion 1220 of projection 1001 is shown in FIG. 15) of adjacent projections (e.g., projections 1001 and 1002), may be greater than or equal to approximately 0.021 inch (0.533 millimeters) and less than or equal to approximately 0.036 inch (0.914 millimeters). The apparatus, methods, and articles of manufacture described herein are not limited in this regard.

Each groove of the plurality of grooves 1020 may have a cross section similar to groove 1021 (see FIG. 12). As described herein, the plurality of projections 1000 may be defined by the arrangement of the plurality of grooves 1020. In one example, the resulting geometric shape of each one of the plurality of projections 1000 may be a pyramidal frustum. The distance between adjacent projections of the plurality of projections 1000 may be defined by the width of a groove of the plurality of grooves 1020 extending therebetween. For example, the distance between adjacent projections 1001 and 1002 of the plurality of projections 1000 may be defined by the width of groove 1021 of the plurality of grooves 1020. In one example, each groove of the plurality of grooves 1020 may have the same or substantially the same width, whether the width be constant or variable. Accordingly, distances between adjacent projections of the plurality of projections 1000 may be similar or substantially similar. In another example (not shown), some or all of the grooves of the plurality of grooves 1020 may have different widths. Accordingly, the distance between adjacent projections of the plurality of projections 1000 may also be different. The apparatus, methods, and articles of manufacture described herein are not limited in this regard.

While not shown, the face portion 900 may be configured such that one or more of the plurality of projections 1000 have other geometric shapes. For example, one or more of the plurality of projections 1000 may be a cube or cuboid. Accordingly, the corresponding grooves of the plurality of grooves 1020 may be an intersecting array of grooves that define one or more cubic or cuboidal grid cells. In another example, one or more of the plurality of projections 1000 may be a triangular pyramidal frustum. Accordingly, the corresponding grooves of the plurality of grooves 1020 may be an intersecting array of grooves that define one or more triangular grid cells. In yet another example, one or more of the plurality of projections 1000 may be a pentagonal pyramidal frustum. Accordingly, the corresponding grooves of the plurality of grooves 1020 may be an intersecting array of grooves that define one or more pentagonal grid cells. In yet another example, one or more of the plurality of projections 1000 may be a hexagonal pyramidal frustum. Accordingly, the corresponding grooves of the plurality of grooves 1020 may be an intersecting array of grooves that define one or more hexagonal grid cells. In yet another example, one or more of the plurality of projections 1000 may be any regular or irregular polygonal pyramidal frustum. In yet another example, one or more of the plurality of projections 1000 may be a conical frustum (e.g., having circular or elliptical base portion). The apparatus, methods, and articles of manufacture described herein are not limited in this regard.

In one example, as shown in FIG. 15, a projection, generally shown as projection 1001, may be a square or rectangular pyramidal frustum having a base portion 1210 proximal to the face portion 900, a peak portion 1220 distal to the face portion 900, and a height 1230. The base portion 1210 may include edges 1211, 1212, 1213, and 1214, and the peak portion 1220 may include edges 1221, 1222, 1223, and 1224. The length of edge 1211 or edge 1213 of the base portion 1210 may correspond to a distance (e.g., distance 1120 in FIG. 14) separating two successive grooves of one of the first plurality of grooves 1030 and the second plurality of grooves 1040. The length of edge 1212 or edge 1214 of the base portion 1210 may correspond to the distance separating two successive grooves of the other one of the first plurality of grooves 1030 and the second plurality of grooves 1040. The base portion 1210 may be connected to the peak portion 1220 via at least one side wall generally shown as side walls 1225, 1226, 1227, and 1228. The peak portion 1220 may be flat or textured and may have a smaller area than the base portion 1210. Accordingly, the projection 1001 may taper in a direction from the base portion 1210 to the peak portion 1220. For example, each of the side walls 1225, 1226, 1227, and 1228, respectively, may be trapezoidal and may extend inwardly from the base portion 1210 to the peak portion 1220. Said differently, the area of the projection 1001 may gradually diminish when transitioning from the base portion 1210 to the peak portion 1220. The apparatus, methods, and articles of manufacture described herein are not limited in this regard.

Each projection of the plurality of projections 1000 may be oriented on the face portion 900 such that the diagonals of the corresponding base portion 1210 and peak portion 1220 generally point in horizontal and vertical directions along the face portion 900 when directly viewing the strike portion 910. Accordingly, the projections of the plurality of projections 1000 may be linearly aligned in one or more diagonal directions across the strike portion 910 of the face portion 900. Linearly aligned projections of the plurality of projections 1000 may extend diagonally from the toe portion 930 to the top portion 970, from the toe portion 930 to the sole portion 980, from the top portion 970 to the sole portion 980, from the heel portion 940 to the top portion 970, from the heel portion 940 to the sole portion 980, or a combination thereof. As described herein, the grooves of the plurality of grooves 1020 may also extend diagonally from the toe portion 930 to the top portion 970, from the toe portion 930 to the sole portion 980, from the top portion 970 to the sole portion 980, from the heel portion 940 to the top portion 970, from the heel portion 940 to the sole portion 980, or a combination thereof. Additionally, or alternatively, the projections of the plurality of projections 1000 and the grooves of the plurality of grooves 1020 may be vertically and/or horizontally configured on the strike portion 910 of the face portion 900. For example, at least a portion of the projections of the plurality of projections 1000 may be substantially aligned in one or more horizontal and/or vertical directions across the strike portion 910 of the face portion 900. In another example, the projections of the plurality of projections 1000 and the grooves of the plurality of grooves 1020 may have curved configurations on the strike portion 910 of the face portion 900. The apparatus, methods, and articles of manufacture described herein are not limited in this regard.

The sizes (e.g., volumes) of the plurality of projections 1000 may change in any direction moving from the center strike portion 985 to the perimeter 990 of the face portion 900. In one example, the areas of the peak portions 1220 of the plurality of projections 1000 may successively increase in any direction moving from the central portion 985 to the perimeter 990 of the face portion 900. Additionally, or alternatively, the areas of the base portions 1210 of the plurality of projections 1000 may successively increase in any direction moving from the center strike portion 985 to the perimeter 990 of the face portion 900. Accordingly, a smallest one of the plurality of projections 1000 (e.g., projection 1001) may be located at the center strike portion 985, and more particularly, at or proximate the geometric center 991 of the face portion 900, whereas a largest one of the plurality of projections 1000 may be located farthest from the center strike portion 985, typically at or proximate the toe edge 931 and/or the heel edge 941. The apparatus, methods, and articles of manufacture described herein are not limited in this regard.

Figure 9:
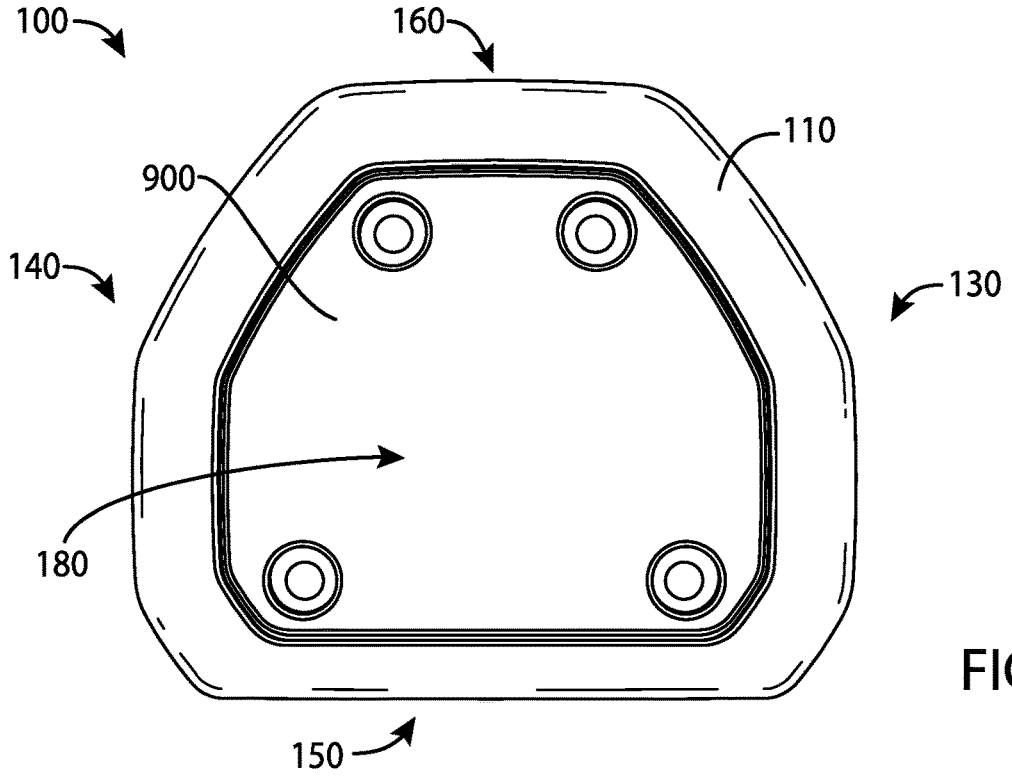
FIG. 9 depicts a bottom view of the example body portion of FIG. 8.
Figure 10:
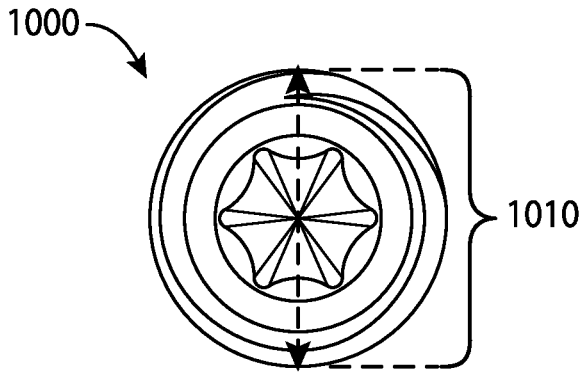
FIG. 10 depicts a top view of a weight portion associated with the example golf club head of FIG. 1.

At least two projections of the plurality of projections 1000 may have similar sizes if they are located on a line passing through the geometric center 991 and are equidistant to the geometric center 991. For purposes of illustration, FIG. 9 shows a vertical centerline axis 1240 extending between the top edge 971 and the sole edge 981 and passing through the geometric center 991. FIG. 9 also shows the horizontal centerline axis 1070 extending between the toe edge 931 and the heel edge 941 and passing through the geometric center 991. At least two projections of the plurality of projections 1000 may have similar sizes due to being located on the vertical centerline axis 1240 and equidistant to the geometric center 991. For example, the two projections of the plurality of projections 1000 may include a first projection 1003 on the vertical centerline axis 1240 at or proximate the top edge 971 and a second projection 1004 on the vertical centerline axis 1240 at or proximate the sole edge 981, the first and second projections 1003 and 1004 being equidistant to the geometric center 991. Likewise, at least two projections of the plurality of projections 1000 may have similar sizes if they are located on the horizontal centerline axis 1070 and are equidistant to the geometric center 991. For example, the two projections of the plurality of projections 1000 may include a first projection 1005 on the horizontal centerline axis 1070 at or proximate the toe edge 931 and a second projection 1006 on the horizontal centerline axis 1070 at or proximate the heel edge 941, the first and second projections 1005 and 1006 being equidistant to the geometric center 991. The apparatus, methods, and articles of manufacture described herein are not limited in this regard.

Each one of the plurality of projections 1000 may be a square or rectangular pyramidal frustum of similar height 1230. The total areas of the base portions 1210 and peak portions 1220 of the plurality of projections 1000 may be approximately 2.15 square inches (1387.09 square millimeters) and 1.04 square inches (670.97 square millimeters), respectively. Accordingly, the total areas of the peak portions 1220 may be less than half the total areas of the base portions 1210. Alternatively, the total areas of the peak portions 1220 may be equal to or greater than half the total areas of the base portions 1210. As described herein, the smallest one of the plurality of projections 1000 (e.g., projection 1001) may be located at the center strike portion 985 and may be located at or proximate the geometric center 991 of the face portion 900. In one example, an area ratio between the base portion 1210 and the peak portion 1220 of the smallest one of the plurality of projections 1000 may be approximately 4.16 or more generally ranging from 4.0 to 5.0. However, area ratios outside the foregoing range are also possible. The largest one of the plurality of projections 1000 on the vertical centerline axis 1240 of the face portion 900 may be located at or proximate the top edge 971 and/or the sole edge 981. For example, the largest one of the plurality of projections 1000 on the vertical centerline axis 1240 may correspond to two projections (e.g., projections 1003 and 1004) equidistant to the geometric center 991 of the face portion 900 and oppositely located at or proximate the top edge 971 and the sole edge 981, respectively. In one example, the area ratio between the base portion 1210 and the peak portion 1220 belonging to the largest one of the plurality of projections 1000 on the vertical centerline axis 1240 may be approximately 2.68 or more generally ranging from 2.0 to 3.0. However, area ratios outside the foregoing range are also possible. The largest one of the plurality of projections 1000 on the horizontal centerline axis 1070 of the face portion 900 may be located at or proximate the toe edge 931 and/or the heel edge 941. For example, the largest one of the plurality of projections 1000 located on the horizontal centerline axis 1070 may correspond to two projections (e.g., projections 1005 and 1006) equidistant to the geometric center 991 of the face portion 900 and oppositely located at or proximate the toe edge 931 and the heel edge 941, respectively. In one example, the area ratio between the base portion 1210 and the peak portion 1220 belonging to the largest one of the plurality of projections 1000 on the horizontal centerline axis 1070 may be approximately 1.61 or more generally ranging from 1.0 to 2.0. However, area ratios outside the foregoing range are also possible. Accordingly, the area ratio between the base portion 1210 and the peak portion 1220 of a projection of the plurality of projections 1000 may be inversely related to the size of the projection. In other words, the larger a projection is, the smaller is the area ratio between the base portion 1210 and the peak portion 1220 of the projection. Said differently still, in examples where the base portions 1210 and the peak portions 1220 of the plurality of projections 1000 successively increase in any direction moving from the center strike portion 985 to the perimeter 990 of the face portion 900, the corresponding area ratios between the base portions 1210 and the peak portions 1220 of the plurality of projections 1000 may successively decrease in any direction moving from the center strike portion 985 to the perimeter 990 of the face portion 900. The apparatus, methods, and articles of manufacture described herein are not limited in this regard.

At least one of the plurality of projections 1000 may be a different size compared to at least one other projection of the plurality of projections 1000 positioned adjacently leftward, rightward, above, below, or at a diagonal with respect thereto. The difference in sizing between two adjacent projections of the plurality of projections 1000 (e.g., projections 1001 and 1002) may result from differences between the areas of their base portions 1210 and/or peak portions 1220. Additionally, or alternatively, the difference in sizing between two adjacent projections of the plurality of projections 1000 may result from differences in height 1230. A change in size between two or more projections of the plurality of projections 1000 successively aligned in a substantially horizontal, vertical, or diagonal direction across the face portion 900 may be based on a relative proximity between each of the two or more projections of the plurality of projections 1000 and the center strike portion 985. In one example, the two or more successively aligned projections of the plurality of projections 1000 may successively increase in size in the substantially horizontal, vertical, or diagonal direction moving from the center strike portion 985 to the perimeter 990 of the face portion 900. Accordingly, the largest one of the plurality of projections 1000 may be located farthest from the center strike portion 985, generally at or about the perimeter 990 of the face portion 900, and more particularly, at or proximate the toe edge 931 or the heel edge 941 of the face portion 900. The apparatus, methods, and articles of manufacture described herein are not limited in this regard.

In one example, two or more of the plurality of projections 1000 may be similar or substantially similar in height such that the peak portions 1220 associated therewith may each provide a ball striking surface. In another example, the plurality of projections 1000 may increase in height 1230 in one or more directions moving from the center strike portion 985 to the perimeter 990 of the face portion 900. In yet another example, the plurality of projections 1000 may decrease in height in one or more directions moving from the center strike portion 985 to the perimeter 990 of the face portion 900. In yet another example, the plurality of projections 1000 may increase, decrease, or otherwise vary in height in one or more directions on the face portion 900. Accordingly, the depths 1110 of the plurality of grooves 1020 may vary based on the heights 1230 of the plurality of projections 1000, or vice versa. The apparatus, methods, and articles of manufacture described herein are not limited in this regard.

A rate of change of the areas of the peak portions 1220 and/or base portions 1210 of the plurality of projections 1000 may be similar in a direction moving from the center strike portion 985 to the toe edge 931 and in a direction moving from the center strike portion 985 to the heel edge 941. In another example, the rate of change of the areas of the peak portions 1220 and/or base portions 1210 of the plurality of projections 1000 may be similar in a direction moving from the center strike portion 985 to the top edge 971 and in a direction moving from the center strike portion 985 to the sole edge 981. In yet another example, the rate of change of the areas of the peak portions 1220 and/or base portions 1210 of the plurality projections 1000 may be similar in a direction moving from the center strike portion 985 to the toe edge 931, in a direction moving from the center strike portion 985 to the heel edge 941, in a direction moving from the center strike portion 985 to the top edge 971, and in a direction moving from the center strike portion 985 to the sole edge 981. In yet another example, the rate of change of the areas of the peak portions 1220 and/or base portions 1210 of the plurality of projections 1000 may be similar and/or vary in any direction (e.g., horizontal, vertical, diagonal, etc.) moving from the center strike portion 985 to any location on the perimeter 990 of the face portion 900. The apparatus, methods, and articles of manufacture described herein are not limited in this regard.

The change in areas of the peak portions 1220 and/or base portions 1210 of the plurality of projections 1000 in one or more directions moving from the center strike portion 985 to the perimeter 990 of the face portion 900 may be a function of a distance between the location of the plurality of projections 1000 on the face portion 900 and the center strike portion 985. Accordingly, the areas of the peak portions 1220 and/or base portions 1210 of the plurality of projections 1000 may successively increase moving from the center strike portion 985 to the perimeter 990 of the face portion 900 according to a function based on the distance of the projections 1000 from the center strike portion 985. In one example, the change in areas of the peak portions 1220 and/or base portions 1210 of the plurality of projections 1000 in one or more directions moving from the center strike portion 985 to the perimeter 990 of the face portion 900 may be a linear function of a distance between the location of the plurality of projections 1000 on the face portion 900 and the center strike portion 985. In another example, the change in areas of the peak portions 1220 and/or base portions 1210 of the plurality of projections 1000 in one or more directions moving from the center strike portion 985 to the perimeter 990 of the face portion 900 may be a polynomial function (e.g., a quadratic function or cubic function) of a distance between the location of the plurality of projections 1000 on the face portion 900 and the center strike portion 985. The areas of the peak portions 1220 and/or base portions 1210 may vary from the center strike portion 985 to the toe portion 930, the heel portion 940, the top portion 970, and/or the sole portion 980 according to any relationship based on any physical property of the face portion 900 and/or any physical property of a portion of the face portion 900 (e.g., a location on the face portion 900) relative to the center strike portion 985. The apparatus, methods, and articles of manufacture described herein are not limited in this regard.

The change in areas of the peak portions 1220 and/or base portions 1210 of the plurality of projections 1000 in one or more directions moving from the center strike portion 985 to the perimeter 990 of the face portion 900 may be defined by the change in a distance 1120 (FIG. 14) between successive grooves of the first plurality of grooves 1030 extending in the first direction and between successive grooves of the second plurality of grooves 1040 extending in the second direction. In one example, the distance 1120 between successive grooves of the first and second plurality of grooves 1030 and 1040, respectively, may successively increase in any direction moving from the center strike portion 985 to the perimeter 990 of the face portion 900. In other words, the distance 1120 between successive grooves of the first and second plurality of grooves 1030 and 1040, respectively, may successively increase moving from the center strike portion 985 to the toe edge 931, from the center strike portion 985 to the heel edge 941, moving from the center strike portion 985 to the top edge 971, and moving from the center strike portion 985 to the sole edge 981. In one example, the distance 1120 between successive grooves of the first and second plurality of grooves 1030 and 1040, respectively, may increase linearly from the center strike portion 985 to the perimeter 990 of the face portion 900. The distance 1120 between successive grooves of the first and second plurality of grooves 1030 and 1040, respectively, may be a linear function of a distance between the location of the first and second plurality of grooves 1030 and 1040, respectively, on the face portion 900 and the center strike portion 985. In another example, the distance 1120 between successive grooves of the first and second plurality of grooves 1030 and 1040, respectively, may be a polynomial function (e.g., a quadratic function or cubic function) of a distance between the location of the first and second plurality of grooves 1030 and 1040, respectively, on the face portion 900 and the center strike portion 985. In another example, the distance 1120 between successive grooves of the first and second plurality of grooves 1030 and 1040, respectively, may successively increase in one or more directions moving from the center strike portion 985 toward the perimeter 990 of the face portion 900. In other words, the distance 1120 between successive grooves of the first and second plurality of grooves 1030 and 1040, respectively, may successively increase in one or more of the following directions: from the center strike portion 985 to the toe edge 931, from the center strike portion 985 to the heel edge 941, from the center strike portion 985 to the top edge 971, and from the center strike portion 985 to the sole edge 981. In yet another example, the distance 1120 between successive grooves of the first and second plurality of grooves 1030 and 1040, respectively, may successively increase at a similar or different rate in one or more directions moving from the center strike portion 985 toward the perimeter 990 of the face portion 900. Accordingly, the change in the distance 1120 between successive grooves of the first and second plurality of grooves 1030 and 1040, respectively, located at or proximate to the toe portion 930, at or proximate to the heel portion 940, at or proximate to the top portion 970, and/or at or proximate to the sole portion 980 may be similar or may vary. The apparatus, methods, and articles of manufacture described herein are not limited in this regard.

The shape of the plurality of projections 1000, the configuration of the plurality of grooves 1020, and/or the change in size (e.g., increase in area of the peak portions 1220 and/or base portions 1210) of the plurality of projections 1000 from the center strike portion 985 to the perimeter 990 of the face portion 900 may affect ball speed, control, sound, and/or spin. Striking a golf ball with the face portion 900 as described herein may: (1) improve stroke consistency; (2) result in lower ball speeds, which may result in decreased ball roll out distance; (3) result in heel and toe shots having decreased ball speeds, which may also result in shorter ball roll out distance; (4) allow relatively lower and higher handicap players to strike the ball with different locations on the face portion 900; and/or, (5) minimize the amount of ball speed loss for off-center hits toward the toe and/or heel, thereby producing more consistent ball roll out distances for center, toe, and heel shots. The apparatus, methods, and articles of manufacture described herein are not limited in this regard.

In the example of FIGS. 9-15, the plurality of grooves 1020 may be darker than the plurality of projections 1000. A resultant color contrast between the plurality of grooves 1020 and the plurality of projections 1000 may produce an X-shaped visual feature (e.g., see FIG. 1) appearing centrally on the face portion 900 and extending between the top portion 970 and the sole portion 980 of the face portion 900. The X-shaped visual feature may cross over the geometric center 991 of the face portion 900, and as such, may generally indicate a sweet spot of the corresponding golf club head in addition to providing the face portion 900 with a unique and attractive aesthetic. The apparatus, methods, and articles of manufacture described herein are not limited in this regard.

While the example of the face portion 900 shown in FIGS. 9-15 generally includes a plurality of projections 1000 increasing in size in any direction moving from the center strike portion 985 to the perimeter 990 of the face portion 900, other examples (not shown) of the face portion 900 may feature the plurality of projections 1000 decreasing in size in any direction moving from the center strike portion 985 to the perimeter 990 of the face portion 900. For instance, the areas of the peak portions 1220 and/or base portions 1210 may successively decrease in any direction moving from the central portion 985 to the perimeter 990 of the face portion 900. Accordingly, a largest one of the plurality of projections 1000 may be located at the center strike portion 985, and more particularly, at or proximate the geometric center 991 of the face portion 900, whereas a smallest one of the plurality of projections 1000 may be located at or proximate the toe edge 931 and/or the heel edge 941. The apparatus, methods, and articles of manufacture described herein are not limited in this regard.

A rate of change of the areas of the peak portions 1220 and/or base portions 1210 of the plurality of projections 1000 may be similar in a direction moving from the center strike portion 985 to the toe edge 931 and in a direction moving from the center strike portion 985 to the heel edge 941. In another example, the rate of change of the areas of the peak portions 1220 and/or base portions 1210 of the plurality of projections 1000 may be similar in a direction moving from the center strike portion 985 to the top edge 971 and in a direction moving from the center strike portion 985 to the sole edge 981. In yet another example, the rate of change of the areas of the peak portions 1220 and/or base portions 1210 of the plurality of projections 1000 may be similar in a direction moving from the center strike portion 985 to the toe edge 931, in a direction moving from the center strike portion 985 to the heel edge 941, in a direction moving from the center strike portion 985 to the top edge 971, and in a direction moving from the center strike portion 985 to the sole edge 981. In yet another example, the rate of change of the areas of the peak portions 1220 and/or base portions 1210 of the plurality of projections 1000 may be similar and/or vary in any direction (i.e., horizontal, vertical, diagonal, etc.) moving from the center strike portion 985 to any location on the perimeter 990 of the face portion 900. The change in areas of the peak portions 1220 and/or base portions 1210 of the plurality of projections 1000 from the center strike portion 985 to the perimeter 990 of the face portion 900 may be a linear or polynomial function (e.g., a quadratic function or cubic function) of a distance between the location of the plurality of projections 1000 on the face portion 900 and the center strike portion 985. Additionally, or alternatively, the plurality of projections 1000 may decrease in height 1230 at a fixed or variable rate from the center strike portion 985 to the perimeter 990 of the face portion 900. The apparatus, methods, and articles of manufacture described herein are not limited in this regard.

The change in areas of the peak portions 1220 and/or base portions 1210 of the plurality of projections 1000 from the center strike portion 985 to the perimeter 990 of the face portion 900 may be defined by the change in the distance 1120 between successive grooves of the first plurality of grooves 1030 extending in the first direction and between successive grooves of the second plurality of grooves 1040 extending in the second direction. In one example, the distance 1120 between successive grooves of the first and second plurality of grooves 1030 and 1040 may successively decrease in any direction moving from the center strike portion 985 to the perimeter 990 of the face portion 900. In other words, the distance 1120 between successive grooves of the first and second plurality of grooves 1030 and 1040 may successively decrease moving from the center strike portion 985 to the toe edge 931, moving from the center strike portion 985 to the heel edge 941, moving from the center strike portion 985 to the top edge 971, and moving from the center strike portion 985 to the sole edge 981. The distance 1120 between successive grooves of the first and second plurality of grooves 1030 and 1040 may be a linear or polynomial function (e.g., a quadratic function or cubic function) of a distance between the location of the first and second plurality of grooves 1030 and 1040 on the face portion 900 and the center strike portion 985. In another example, the distance 1120 between successive grooves of the first and second plurality of grooves 1030 and 1040 may successively decrease in any direction moving from the center strike portion 985 toward the perimeter 990 of the face portion 900. In other words, the distance 1120 between successive grooves of the first and second plurality of grooves 1030 and 1040 may successively decrease in one or more of the following directions: from the center strike portion 985 to the toe edge 931, from the center strike portion 985 to the heel edge 941, from the center strike portion 985 to the top edge 971, and from the center strike portion 985 to the sole edge 981. The distance 1120 between successive grooves of the first and second plurality of grooves 1030 and 1040 may successively decrease at a similar or different rate in one or more directions moving from the center strike portion 985 toward the perimeter 990 of the face portion 900. Accordingly, the decrease in the distance 1120 between successive grooves of the first and second plurality of grooves 1030 and 1040 located at or proximate to the toe portion 930, at or proximate to the heel portion 940, at or proximate to the top portion 970, and/or at or proximate to the sole portion 980 may be similar or vary. The apparatus, methods, and articles of manufacture described herein are not limited in this regard.

Figure 16:
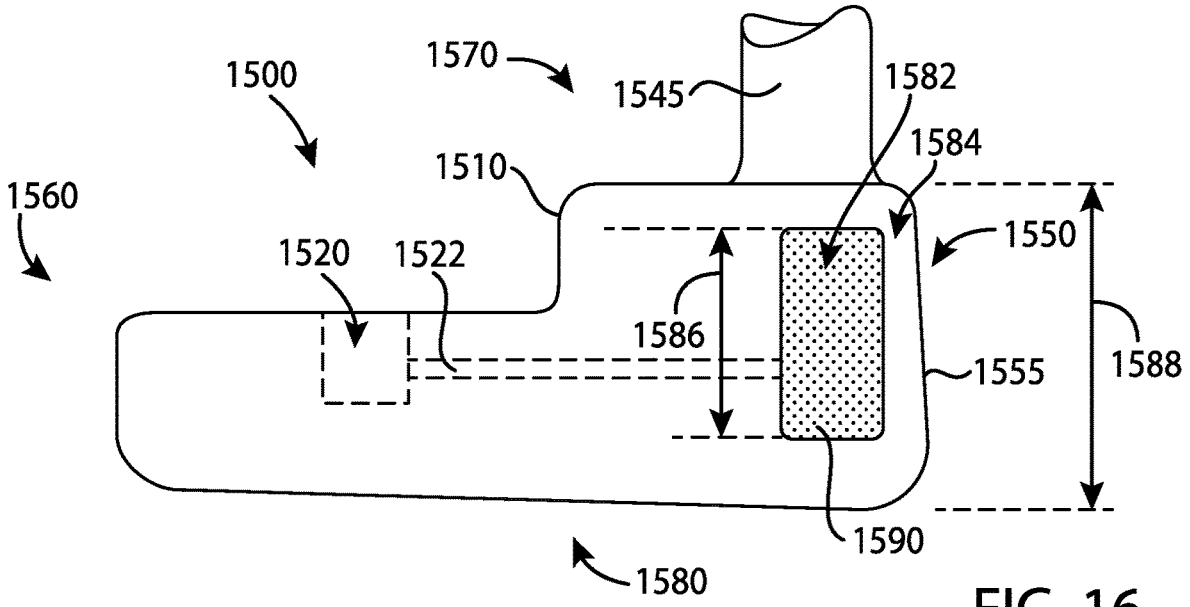
FIG. 16 depicts a schematic cross-sectional view of another example of the golf club head of FIG. 15.
Figure 17:
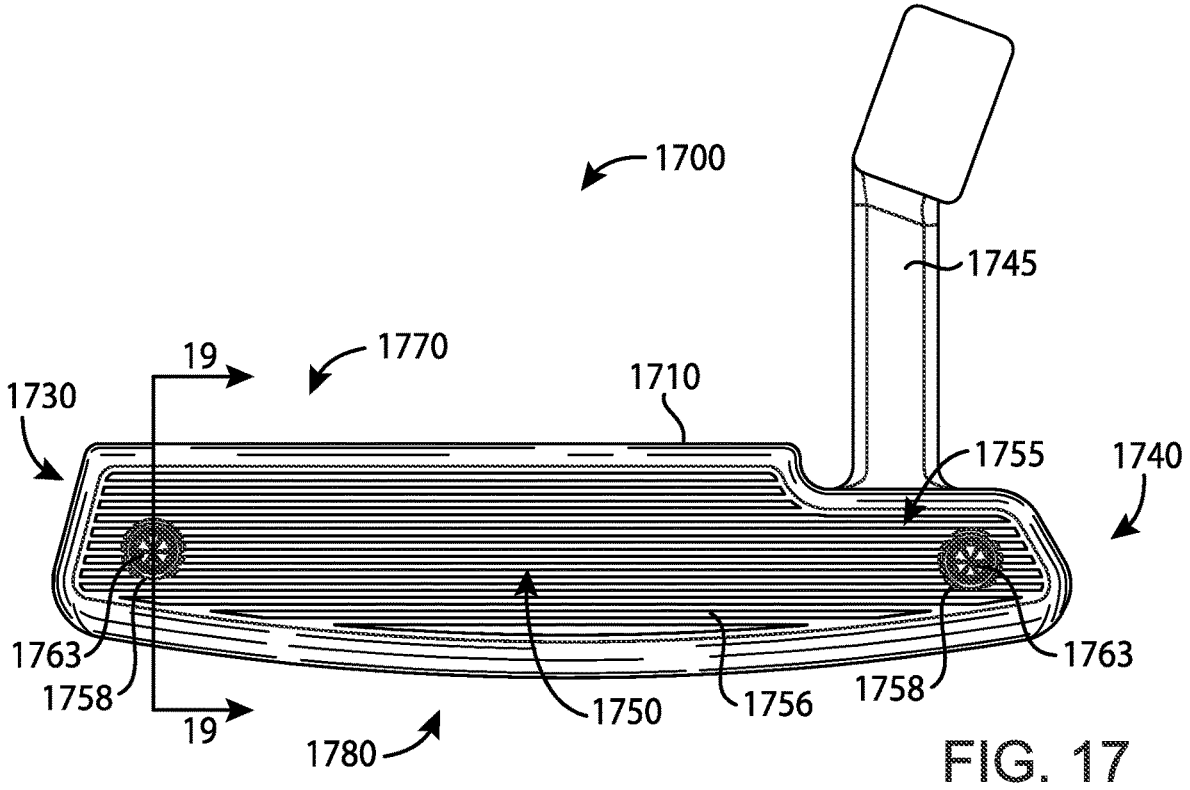
FIG. 17 depicts a front view of a golf club head according to yet another example of the apparatus, methods, and articles of manufacture described herein.

In one example, as shown in FIG. 16, a process 1600 of manufacturing the face portion 900 may include providing a face portion (block 1610) having a planar strike portion (i.e., without any grooves). In one example, the face portion 900 may be an integral part of a golf club head. In another example, the face portion 900 may be a separate face insert that may be coupled to a front portion of a golf club head by using adhesive, tape, welding, soldering, fasteners and/or other suitable methods and devices. The process 1600 may include forming a plurality of grooves on the strike portion of the face portion (block 1620) with distances between successive grooves of the plurality of grooves changing (e.g., increasing or decreasing) in any direction moving from a center strike portion to a perimeter of the face portion. Alternatively, in another example, as shown in FIG. 17, a process 1700 of manufacturing the face portion 900 may include providing a face portion (block 1710) having a planar strike portion (i.e., without any grooves), and forming a plurality projections on the strike portion of the face portion (block 1720) with the size of the plurality of projections changing (e.g., increasing or decreasing) in any direction from a center strike portion to a perimeter of the face portion. As described herein, each one of the plurality of projections may include a peak portion separated from a base portion by a height. In one example, two or more of the plurality of projections may be pyramidal frustums. The change in size may include a change to the areas of the peak portions of the plurality of projections, a change to the areas of the base portions of the plurality of projections, and/or a change in height of the plurality of projections. The apparatus, methods, and articles of manufacture described herein are not limited in this regard.

In one example, the plurality of grooves may be manufactured by milling the face portion. Accordingly, the portions of the face portion that are not milled may form the plurality of projections (e.g., residual portion(s)). In another example, the plurality of grooves may be stamped onto the face portion. In yet another example, the face portion including the plurality of projections and/or the plurality of grooves may be manufactured by forging. In yet another example, the face portion including the plurality of projections and/or the plurality of grooves may be manufactured by casting. In yet another example, the plurality of projections and/or the plurality of grooves may be manufactured by press forming. In yet another example, the plurality of projections and/or the plurality of grooves may be manufactured by laser and/or thermal etching or eroding of the face material. In yet another example, the plurality of projections and/or the plurality of grooves may be manufactured by chemically eroding the face material using photo masks. In yet another example, the plurality of projections and/or the plurality of grooves may be manufactured by electro/chemically eroding the face material using a chemical mask such as wax or a petrochemical substance. In yet another example, the plurality of projections and/or the plurality of grooves may be manufactured by abrading the face material using air or water as the carry medium of the abrasion material such as sand. Any one or a combination of the methods discussed above can be used to manufacture one or more of the plurality of projections and/or the plurality of grooves on the face portion. In some examples, the plurality of projections may be a different color than the plurality of grooves. The apparatus, methods, and articles of manufacture described herein are not limited in this regard.

Figure 18:
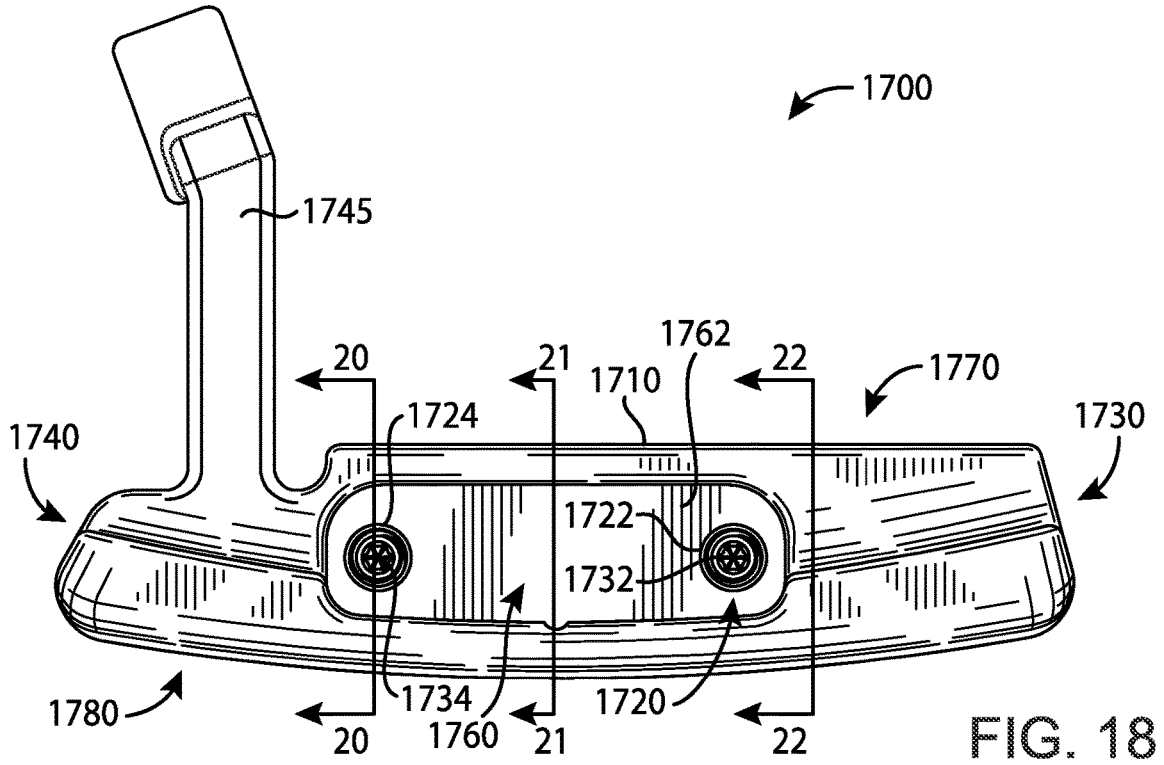
FIG. 18 depicts a rear view of the golf club head of FIG. 17.
Figure 19:
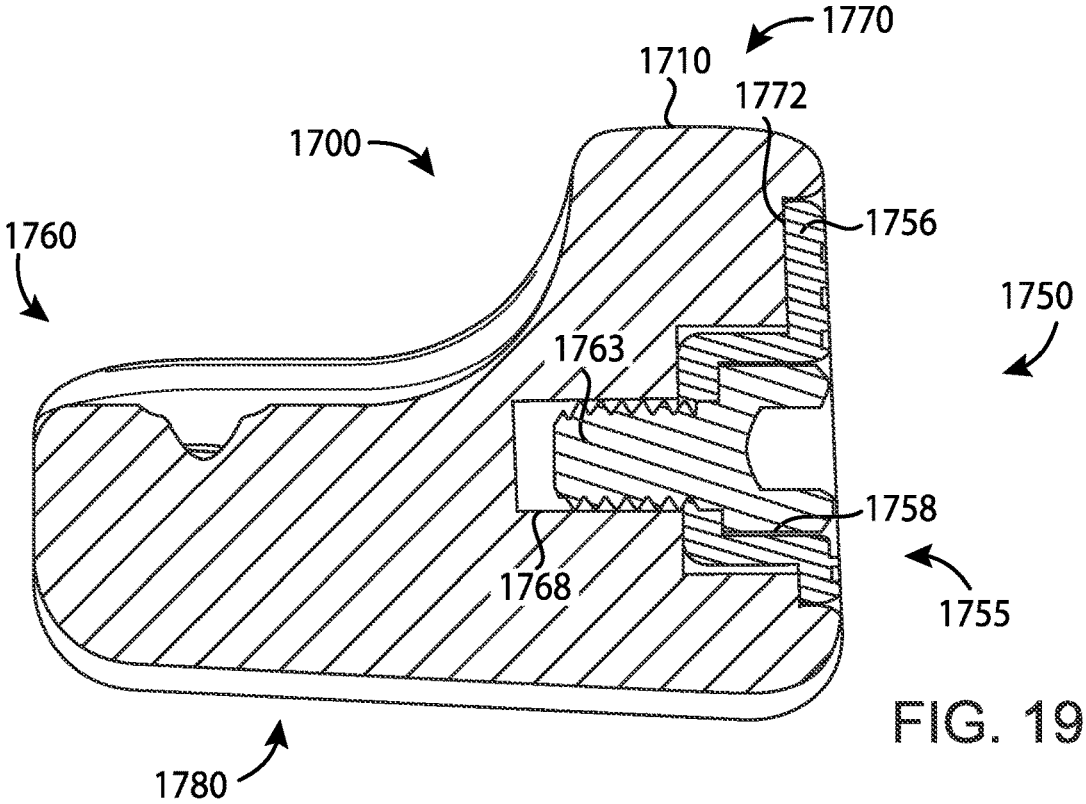
FIG. 19 depicts a cross-sectional view of the golf club head of FIG. 17 at line 19-19 of FIG. 17.
Figure 20:
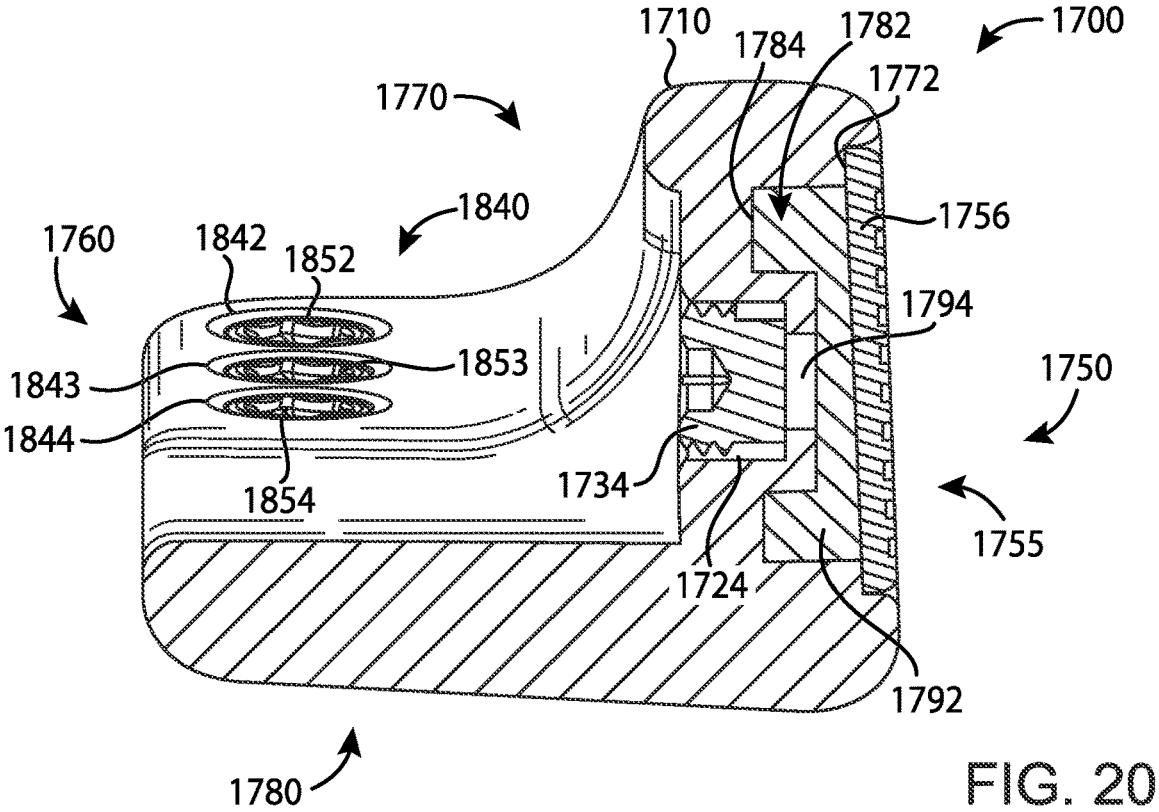
FIG. 20 depicts a cross-sectional view of the golf club head of FIG. 17 at line 20-20 of FIG. 18.
Figure 21:
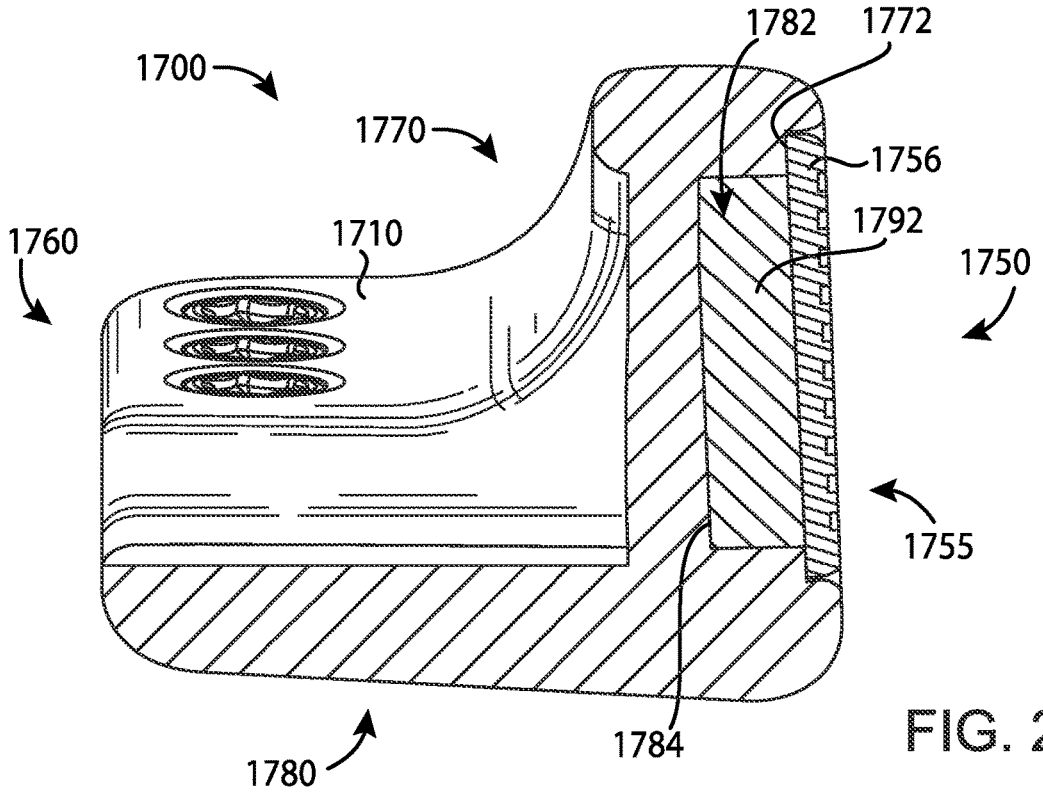
FIG. 21 depicts a cross-sectional view of the golf club head of FIG. 17 at line 21-21 of FIG. 18.
Figure 22:
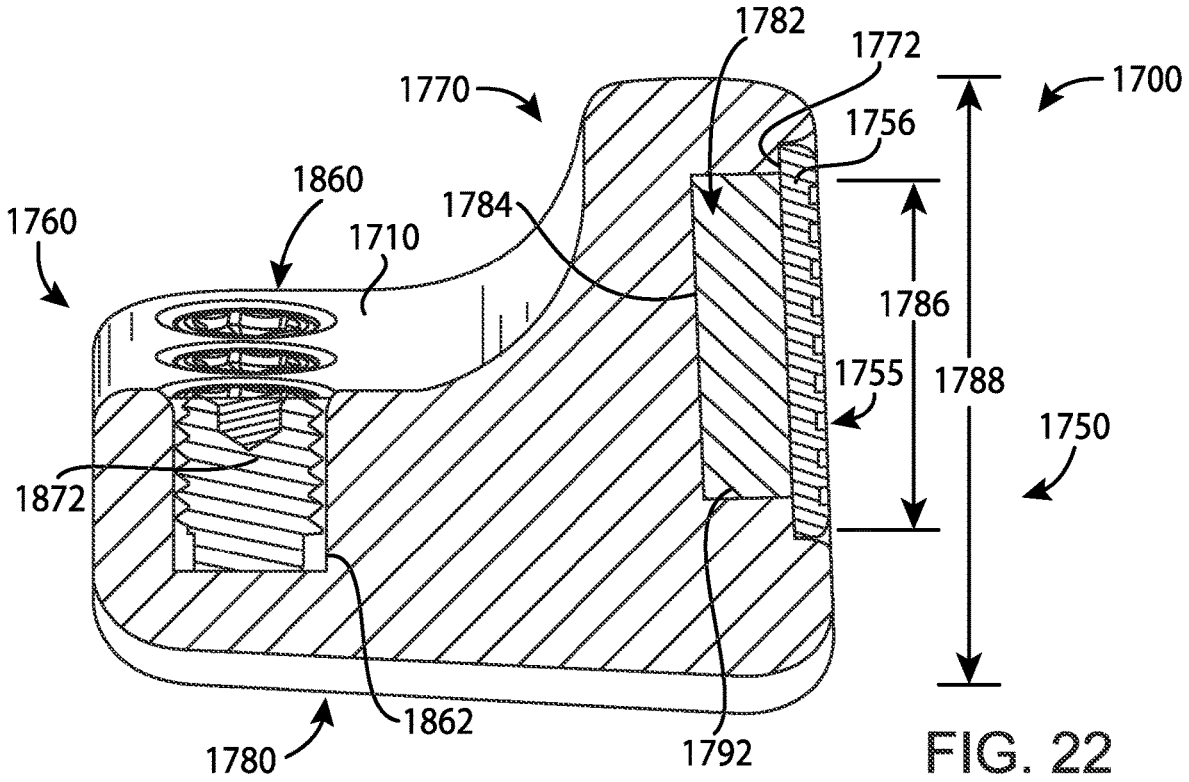
FIG. 22 depicts a cross-sectional view of the golf club head of FIG. 17 at line 22-22 of FIG. 18.
Figure 23:
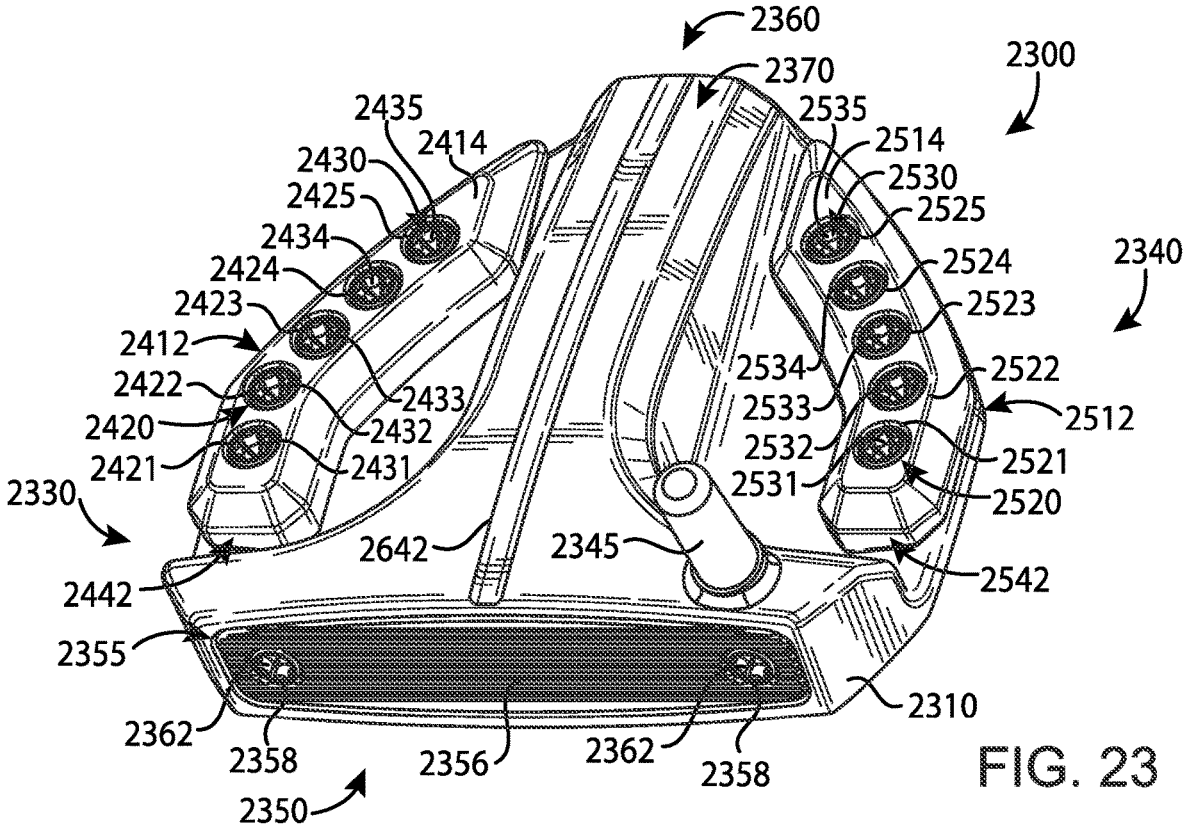
FIG. 23 depicts a front and top perspective view of a golf club head according to yet another example of the apparatus, methods, and articles of manufacture described herein.
Figure 24:
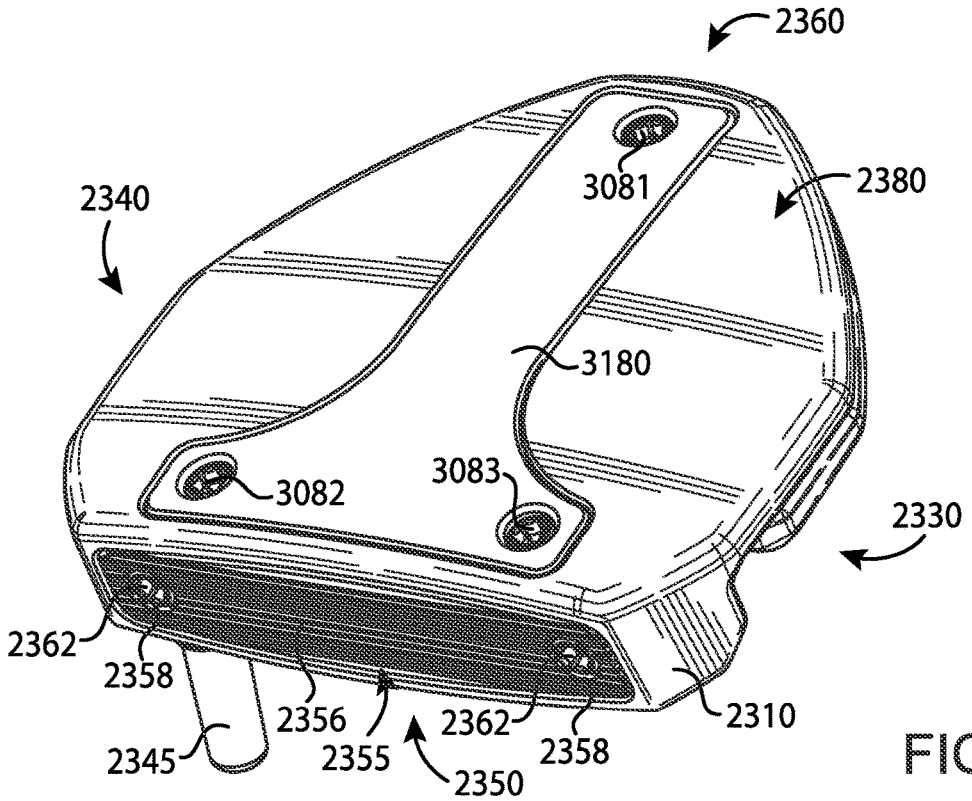
FIG. 24 depicts a front and bottom perspective view of the golf club head of FIG. 23.

In the example of FIGS. 18 and 19, a golf club head 1800 may include a body portion 1810 having a toe portion 1830, a heel portion 1840, a front portion 1850 with a face portion 1855 (e.g., similar to face portion 900), a rear portion 1860, a top portion 1870, a sole portion (not shown), one or more visual guides (e.g., shown as visual guide 1885), and one or more sets of weight ports (not shown) and corresponding sets of weight portions (not shown) as described herein. The body portion 1810 may be made from any of the materials described herein with respect to the body portion 210 in the example of FIGS. 2-8. The apparatus, methods, and articles of manufacture described herein are not limited in this regard.

The body portion 1810 may also include a cavity 1890 configured to receive a hosel portion (not shown in FIGS. 18 and 19). The cavity 1890 may be located at the top portion 1870. In one example, the cavity 1890 may be located at a recessed area 1892 of the top portion 1870 proximate the front portion 1850 and the heel portion 1840. The cavity 1890 may have an opening 1895 with a rounded rectangular shape. Alternatively, the opening 1895 of the cavity 1890 may have a different shape such as, but not limited to, circular, square, rounded square, triangular, rounded triangular, oval, rectangular, or any other shape that is suitable for receiving a hosel portion therein. The apparatus, methods, and articles of manufacture described herein are not limited in this regard.

Figure 25:
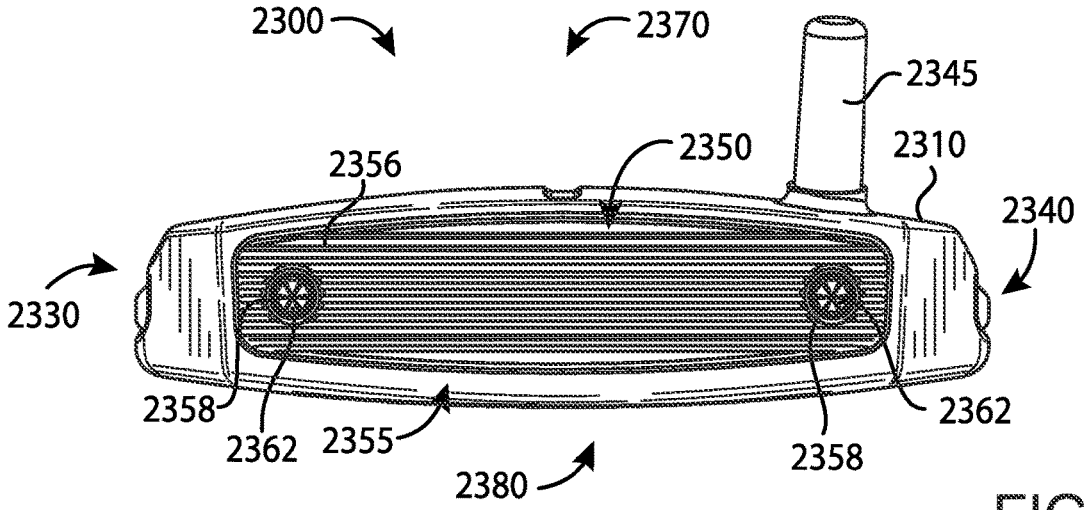
FIG. 25 depicts a front view of the golf club head of FIG. 23.
Figure 26:
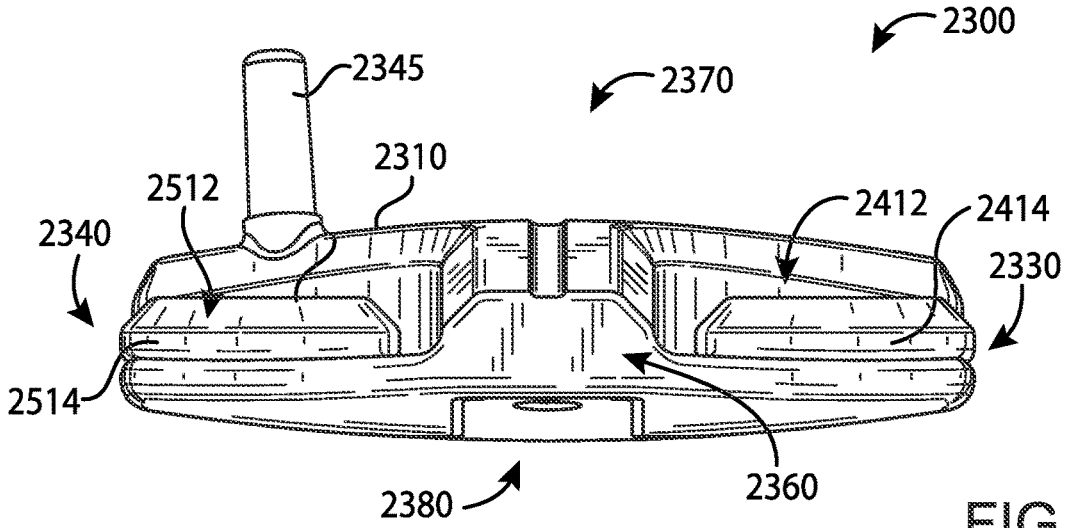
FIG. 26 depicts a rear view of the golf club head of FIG. 23.
Figure 27:
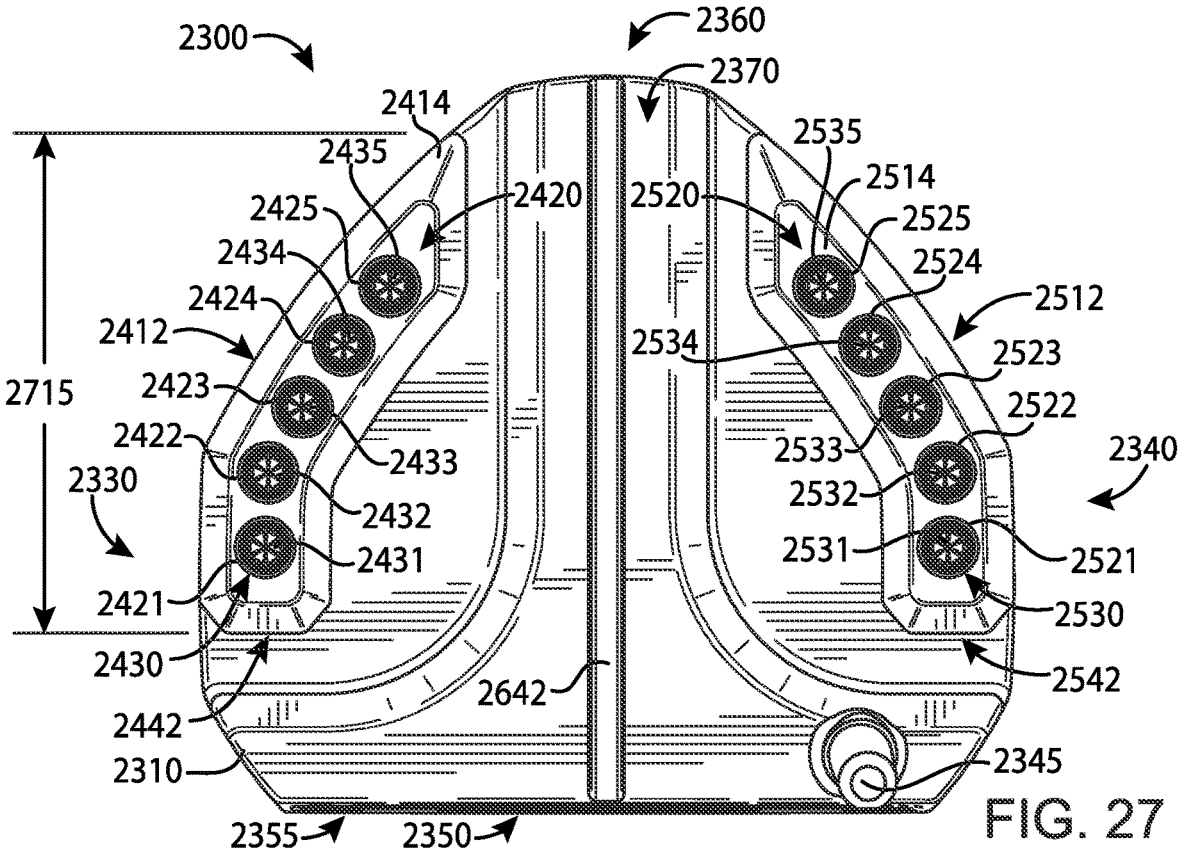
FIG. 27 depicts a top view of the golf club head of FIG. 23.
Figure 28:
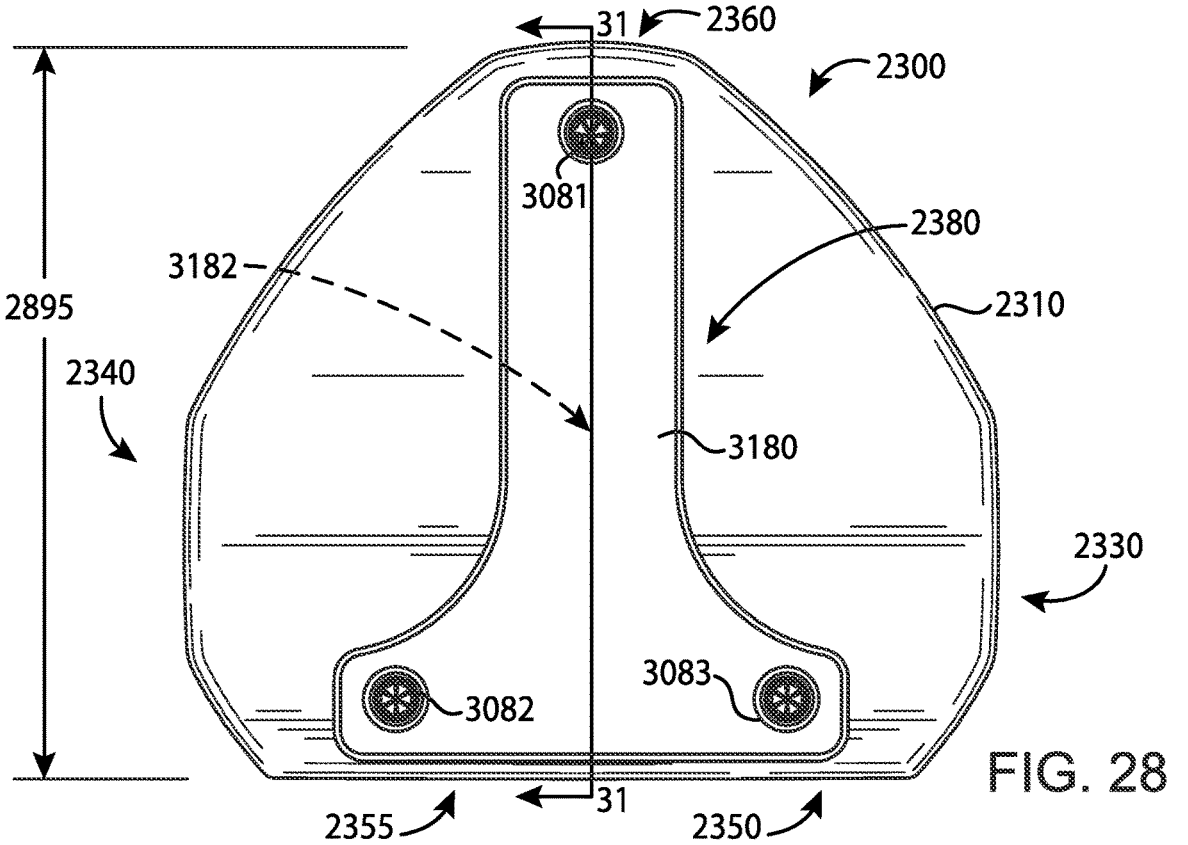
FIG. 28 depicts a bottom view of the golf club head of FIG. 23.
Figure 29:
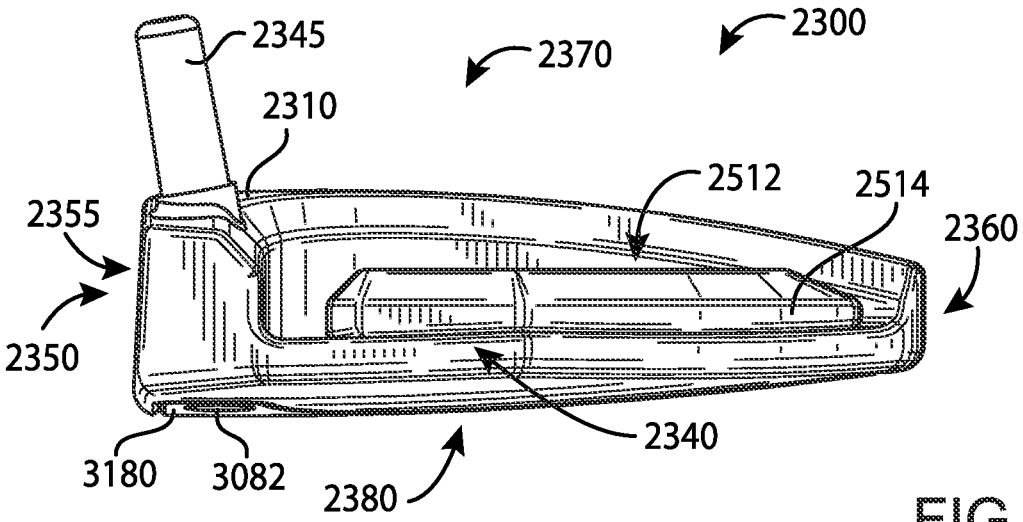
FIG. 29 depicts a left view of the golf club head of FIG. 23.

In FIGS. 20-27, hosel portions having different neck configurations are shown for exemplary purposes. In the example of FIGS. 20-24, a hosel portion 2000 is shown including a neck portion 2010 having a double bend configuration. In the example of FIG. 25, a hosel portion 2500 is shown including a neck portion 2510 having a single bend configuration. In the example of FIG. 26, a hosel portion 2600 is shown including a neck portion 2610 having a slanted configuration. In the example of FIG. 27, a hosel portion 2700 is shown including a neck portion 2710 having a plumber's neck configuration. In the examples of FIGS. 20-26, the neck portions 2010, 2510, and 2610 may include corresponding stem portions 2020, 2520, and 2620. In the example of FIG. 27, the neck portion 2710 may include a bore portion 2720. The stem portions 2020, 2520, and 2620 and the bore portion 2720 are each capable of receiving a shaft (not shown). The hosel portions 2000, 2500, 2600, and 2700 may also include corresponding insert portions 2030, 2530, 2630, and 2730 that are each capable of being received in the cavity 1890 of the body portion 1810 shown in FIGS. 18 and 19. The insert portions 2030, 2530, 2630, and 2730 may be similarly configured to complement the shape of the cavity 1890. For example, the insert portions 2030, 2530, 2630, and 2730 may have a cross-section with a rounded rectangular shape. In other examples, the insert portions 2030, 2530, 2630, and 2730 may have other cross-sectional shapes based on the particular shape of the cavity 1890. The apparatus, methods, and articles of manufacture described herein are not limited in this regard.

The hosel portions 2000, 2500, 2600, and 2700 may be partially or entirely made of a steel-based material, a titanium-based material, an aluminum-based material (e.g., a high-strength aluminum alloy or a composite aluminum alloy coated with a high-strength alloy), a tungsten-based material, any combination thereof, and/or other suitable types of materials. Alternatively, the hosel portions 2000, 2500, 2600, and 2700 may be partially or entirely made of a non-metal material (e.g., composite, plastic, etc.). In one example, the hosel portions 2000, 2500, 2600, and 2700 may be entirely made of a steel-based material (e.g., 303 stainless steel) with a Rockwell hardness of 70-90 HRB. In another example, the hosel portions 2000, 2500, 2600, and 2700 may be entirely made of an aluminum-based material with a Rockwell hardness of 50-70 HRB. In one example, the hosel portions 2000, 2500, 2600, and 2700 may be made from the same material or a different material as the body portion 1810 of the golf club head 1800 shown in FIGS. 18 and 19. The apparatus, methods, and articles of manufacture described herein are not limited in this regard.

Figure 30:
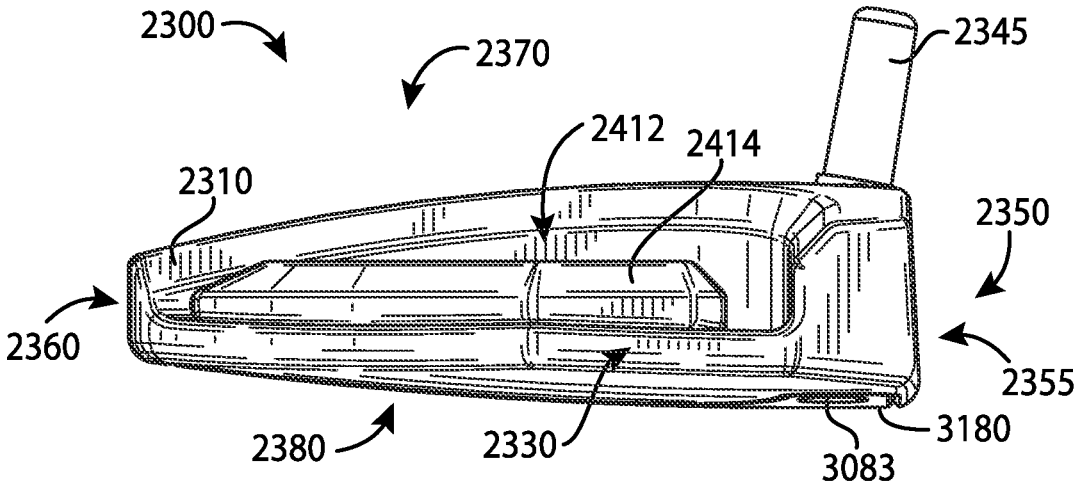
FIG. 30 depicts a right view of the golf club head of FIG. 23.
Figure 31:
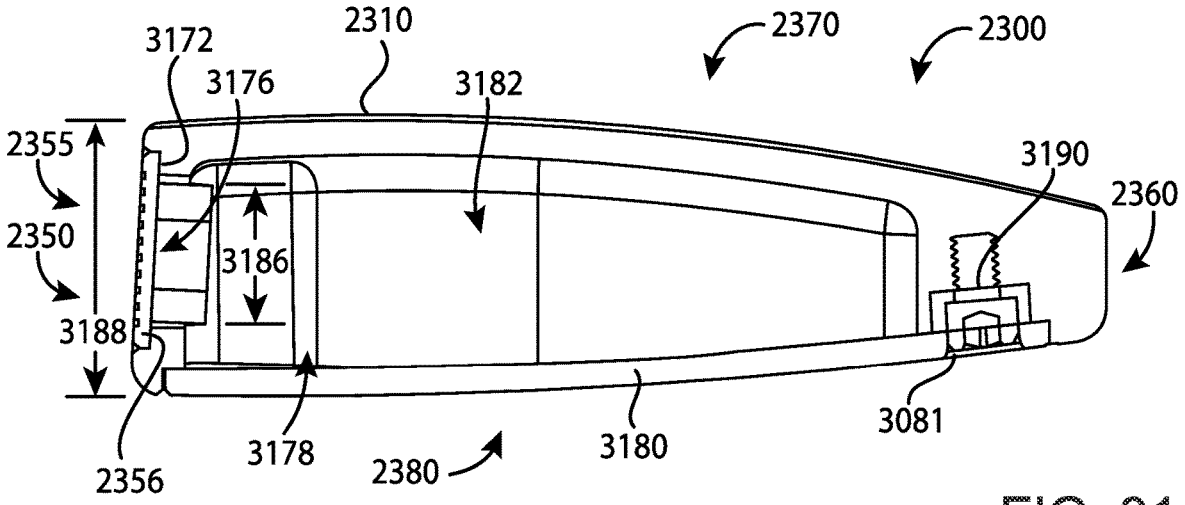
FIG. 31 depicts a cross-sectional view of the golf club head of FIG. 23 taken at line 31-31 of FIG. 31.

In the example of FIGS. 28-31, the golf club head 1800 of FIGS. 18 and 19 is shown with the hosel portion 2000 of FIGS. 20-24 assembled to the body portion 1810. Alternatively, any one of the other hosel portions 2500, 2600, and 2700 shown in FIGS. 25-27 may be similarly assembled to the body portion 1810 in the place of the hosel portion 2000. During assembly, the insert portion 2030 of the hosel portion 2000 is received inside the cavity 1890 of the body portion 1810. The hosel portion 2000 may be engaged to the body portion 1810 through an interference fit established with the cavity 1890 to ensure proper positioning (i.e., centering the insert portion 2030 of the hosel portion 2000 in the cavity 1890) of the hosel portion 2000 and to provide a seamless aesthetic between the hosel portion 2000 and the body portion 1810. In the example of FIGS. 30 and 31, the neck portion 2010 of the hosel portion 2000 may include a transition portion 3000 that diminishes in thickness or tapers toward the insert portion 2030. The transition portion 3000 may frictionally engage one or more side walls (e.g., shown as side walls 3010, 3012, 3014, and 3016) of the cavity 1890 at or proximate the opening 1895 to provide an interference fit between the transition portion 3000 and the side walls of the cavity 1890. The insert portion 2030 of the hosel portion 2000 may be spaced apart from the interior structure of the cavity 1890. Accordingly, the insert portion 2030 may be spaced from the side walls 3010, 3012, 3014, and 3016 and a base 3018 from which they extend. In one example, the insert portion 2030 may be closer to the side walls 3010, 3012, 3014, and 3016 than to the base 3018. The resulting space inside the cavity 1890 surrounding the insert portion 2030 may be partially or entirely filled with an epoxy 3020 or other adhesive to hold the insert portion 2030 in place, thereby securing the hosel portion 2000 to the body portion 1810. Accordingly, the hosel portion 2000 may be secured to the body portion 1810 without the need of any mechanical fasteners such as screws and the like. The apparatus, methods, and articles of manufacture described herein are not limited in this regard.

The insert portion 2030 may include one or more channels (e.g., shown as channels 3051, 3052, and 3053) encircling the insert portion 2030. The channels 3051, 3052, and 3053 may be parallel or substantially parallel to each other. The channels 3051, 3052, and 3053 may be concentric about a longitudinal axis 3060 of the insert portion 2030. The channels 3051, 3052, and 3053 may engage with the epoxy 3020 inside the cavity 1890 and serve as a mechanical locking mechanism between the insert portion 2030 and the epoxy 3020. The channels 3051, 3052, and 3053 may include a square-shaped cross section or other cross section (e.g., U-shaped, V-shaped, T-shaped, triangle-shaped, saw-tooth-shaped). A cross section of the channels 3051, 3052, and 3053 may be symmetrical or asymmetrical. The channels 3051, 3052, and 3053 may be evenly or unevenly spaced apart in a longitudinal direction along the insert portion 2030. The channels 3051, 3052, and 3053 may be located on the insert portion 2030 such that the insert portion 2030 alternates between two or more portions with differing perimeter sizes, thereby providing the insert portion 2030 with greater surface area with which to engage the epoxy 3020. For example, the channels 3051, 3052, and 3053 may be located on the insert portion 2030 such that the insert portion 2030 alternates between a first portion 3055 and a second portion 3056. The first portion 3055 may have a larger perimeter than the second portion 3056 or vice versa. In one example, the channels 3051, 3052, and 3053 may have a depth of approximately 0.010 inch and a width of approximately 0.040 inch. In alternative examples, the channels 3051, 3052, and 3053 may have different depths and/or widths. The apparatus, methods, and articles of manufacture described herein are not limited in this regard.

In one example, the cavity 1890 may have a length of approximately 0.372 inch, a width of approximately 0.260 inch, and a depth of approximately 0.470 inch. In one example, a first spacing between the transition portion 3000 of the neck portion 2010 and each of the side walls 3010, 3012, 3014, and 3016 may gradually increase up to approximately 0.010 inch in a direction toward the base 3018. A second spacing between the first portion(s) 3055 of the insert portion 2030 and each of the side walls 3010, 3012, 3014, and 3016 may be approximately 0.010 inch. A third spacing between the second portion(s) 3056 of the insert portion 2030 and each of the side walls 3010, 3012, 3014, and 3016 may be approximately 0.020 inch. A fourth spacing between a lower portion 3070 of the insert portion 2030 and each of the side walls 3010, 3012, 3014, and 3016 may gradually increase from approximately 0.010 inch to approximately 0.030 inch in a direction toward the base 3018. A fifth spacing between a terminal end 3075 of the lower portion 3070 and the base 3018 may be approximately 0.040 inch. The transition portion 3000 of the neck portion 2010 may be tapered at a first angle to define the gradual increase in the first spacing in a direction toward the base 3018. The lower portion 3070 may be tapered at a second angle to define the gradual increase in the fourth spacing in a direction toward the base 3018. The first angle may be greater than, equal to, or less than the second angle. In one example, the transition portion 3000 may be tapered at approximately five degrees relative to longitudinal axis 3060, and the lower portion 3070 may be tapered at approximately forty-five degrees relative to the longitudinal axis 3060. Accordingly, the spacing between the insert portion 2030 and the base 3018 may be generally greater than the spacing between the insert portion 2030 and any of the side walls 3010, 3012, 3014, and 3016. The apparatus, methods, and articles of manufacture described herein are not limited in this regard.

Figure 32:
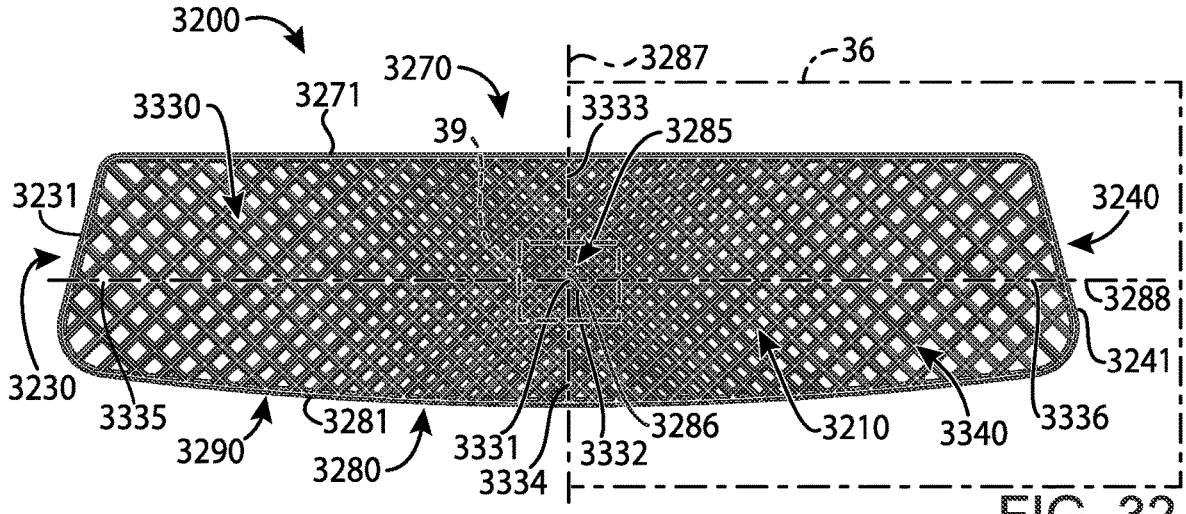
FIG. 32 depicts a front perspective view of a face portion of a golf club head according to an example of the apparatus, methods, and articles of manufacture described herein.

In the example of FIG. 32, a method 3200 of assembling a golf club head is generally shown by blocks 3210-3240. At block 3210, a body portion is provided and may be selected from a plurality of body portions. Each of the plurality of body portions may be a putter-type body having a cavity similar to the cavity 1890 shown in FIGS. 18 and 19. The plurality of body portions may include one or more blade-type putter bodies, one or more mid-mallet-type putter bodies, one or more mallet-type putter bodies, and/or any other putter-type bodies. At block 3220, a hosel portion is provided and may be selected from a plurality of hosel portions. The plurality of hosel portions may include any one of the hosel portions 2000, 2500, 2600, and 2700 of FIGS. 20-27, respectively, and/or any other hosel portion types. Each of the plurality of hosel portions may include either a stem or a bore portion, a neck portion, and an insert portion capable of being received in the cavity of any one of the plurality of body portions. At block 3230, the selected hosel portion may be attached to the selected body portion. The selected hosel portion may be attached to the selected body portion by press-fitting the selected hosel portion into the cavity of the selected body portion such that the insert portion of the selected hosel portion is received inside the cavity and an interference fit is established between the neck portion of the selected hosel portion and the cavity of the selected body portion. At block 3240, the selected hosel portion may be secured to the selected body portion. The selected hosel portion may be secured to the selected body portion using an epoxy or other adhesive to hold the insert portion of the selected hosel portion in place inside the cavity of the selected body portion. The cavity of the selected body portion may be partially filled with the epoxy or other adhesive prior to attaching the selected hosel portion to the selected body portion at block 3230. Additionally, or alternatively, the epoxy or other adhesive may be applied to the insert portion of the selected hosel portion prior to attaching the selected hosel portion to the selected body portion at block 3230. Accordingly, the method 3200 outlined above may provide a variety of combinations between the plurality of body portions and the plurality of hosel portions. As such, a golf club head may be assembled by selecting a body portion and a hosel portion that are optimized to a particular player's putting stroke. The apparatus, methods, and articles of manufacture described herein are not limited in this regard.

Figure 33:
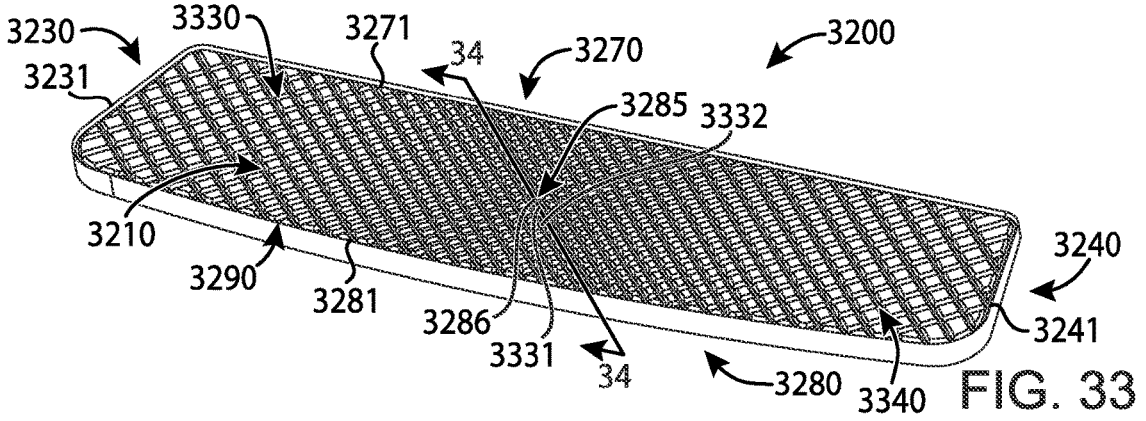
FIG. 33 depicts a side perspective view of the face portion of FIG. 32.
Figure 34:
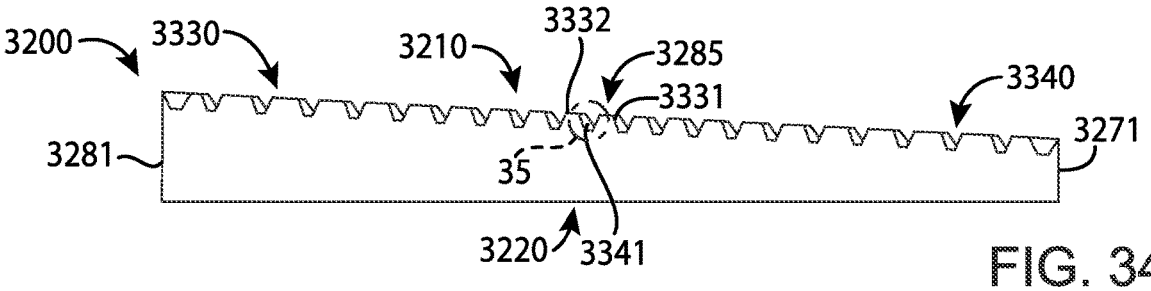
FIG. 34 depicts a perspective cross-sectional view of the face portion of FIG. 32.
Figure 35:
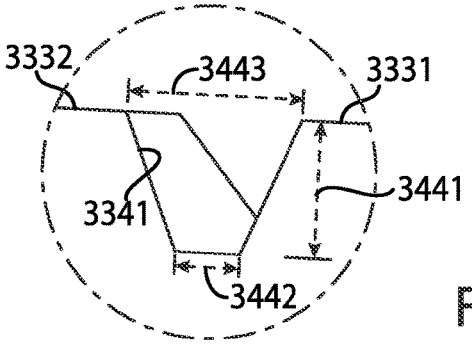
FIG. 35 depicts an enlarged view of area 35 of the face portion of FIG. 34.

In the example of FIGS. 33-35, a golf club head 3300 may include a body portion 3310 having a toe portion 3330, a heel portion 3340, a front portion 3350 with a face portion 3355, a rear portion 3360, a top portion 3370, and a sole portion 3380. The body portion 3310 may be made from any of the materials described herein. The face portion 3355 may be similar in many or all respects to the face portion 900 shown in FIGS. 9 and 10. The face portion 3355 may be an integral portion of the body portion 3310. Alternatively, the face portion 3355 may be a separate piece or an insert coupled to the body portion 3310 via various manufacturing and/or processes (e.g., a bonding process, a welding process, a brazing process, a mechanical locking method, a mechanical fastening method, any combination thereof, or other suitable types of manufacturing methods and/or processes). The face portion 3355 may be associated with a loft plane that defines the loft angle of the golf club head 3300. The apparatus, methods, and articles of manufacture described herein are not limited in this regard.

The body portion 3310 may also include a cavity 3500 configured to receive a hosel portion 3400. The cavity 3500 may be located at the top portion 3370 and may extend downward into the body portion 3310. The cavity 3500 may be similar to the cavity 1890 shown in FIGS. 18 and 19. For example, the cavity 3500 may have an opening 3510, a base 3515, and one or more side walls (e.g., shown as side walls 3520, 3530, 3540, and 3550) extending therebetween. The base 3515 and the side walls 3520, 3530, 3540, and 3550 may define an interior structure of the cavity 3500. The opening 3510 may have a rounded rectangular shape or other desired shape. The apparatus, methods, and articles of manufacture described herein are not limited in this regard.

A through-hole 3560 may be located at the front portion 3350 and feeds into the cavity 3500 through a side wall (e.g., side wall 3520) of the cavity 3500. The side wall 3520 may be located behind the face portion 3355 and at least a portion of the side wall 3520 may generally face rearward of the body portion 3310. The through-hole 3560 may be cylindrical in shape and may extend from the front portion 3350 in a direction rearward of the body portion 3310. The through-hole 3560 may be located in a recessed portion 3570 of the front portion 3350 adjacent the opening 3510 of the cavity 3500. The recessed portion 3570 may be U-shaped and may delimit an upper extent of the face portion 3355. The apparatus, methods, and articles of manufacture described herein are not limited in this regard.

The hosel portion 3400 may include a neck portion 3410 extending from an insert portion 3420. The hosel portion 3400 may be made from any of the materials described herein. Accordingly, the hosel portion 3400 may be made from the same or different material as the body portion 3310. For the purpose of illustration, the hosel portion 3400 is exemplarily shown having a plumber's neck configuration and may include a bore portion 3430 capable of receiving a shaft (not shown). In alternative examples, the hosel portion 3400 may have a different neck configuration such as, but not limited to, a double bend configuration, a single bend configuration, or a slanted configuration, as described herein. In the illustrated example, the insert portion 3420 may have a cross-sectional shape that is complementary to the cavity 3500 and promotes a clearance or frictional fit therebetween. The insert portion 3420 may include a fastener port 3440 and is received inside the cavity 3500 such that the fastener port 3440 interfaces with the through-hole 3560. In this way, a complementary fastener, shown as fastener 3450 may be received in the through-hole 3560 and engaged to the fastener port 3440, thereby securing the hosel portion 3400 to the body portion 3310. The apparatus, methods, and articles of manufacture described herein are not limited in this regard.

In one example, the fastener 3450 may be a bolt or a screw. The fastener 3450 may include a head 3452 and external threads 3454 for engaging complementary internal threads 3442 of the fastener port 3440. The fastener port 3440 may be configured as a through-hole and the fastener 3450 may be sized such that a tip portion 3456 of the fastener 3450 abuts against side wall 3530 when the fastener 3450 is fully fastened to the fastener port 3440, thereby resulting in a continuous physical force being exerted by the fastener 3450 against the side wall 3530 for holding the hosel portion 3400 in place. Alternatively, the tip portion 3456 may stop short of the side wall 3530 when the fastener 3450 is fully fastened to the fastener port 3440. Tightening of the fastener 3450 may pull the hosel portion 3400 forward toward the front portion 3350, thereby resulting in a continuous physical force being exerted by the hosel portion 3400 against side wall 3520 of the cavity 3500. In other words, tightening of the fastener 3450 may result in a clamping pressure exerted by the hosel portion 3400 and the fastener 3450 against an intervening structure 3580 of the body portion 3310 that separates the recessed portion 3570 and the cavity 3500. The amount of tightening of the fastener 3450 may be limited by the head 3452 pressing or abutting against the recessed portion 3570 of the front portion 3350. The depth of the recessed portion 3570 may be determined based on a desired side profile of the head 3452. In other words, increasing the depth of the recessed portion 3570 may reduce the amount in which the head 3452 protrudes forward from the front portion 3350. In some examples, the depth of the recessed portion 3570 is such that the head 3452 is at least flush (i.e., no visible side profile) with the face portion 3355. In other examples, the depth of the recessed portion 3570 is such that head 3452 partially or entirely protrudes forward from the front portion 3350. In examples where the head 3452 protrudes forward of the front portion 3350, the golf club head 3300 may be deemed non-conforming by the rules of golf but would nevertheless find use in fitting/testing scenarios and in the hands of recreational golfers. Based on the application, the fastener 3450 may or may not be readily removable with a tool. The apparatus, methods, and articles of manufacture described herein are not limited in this regard.

The insert portion 3420 of the hosel portion 3400 may be spaced apart from the base 3515 of the cavity 3500 when secured to the body portion 3310 using the fastener 3450. An intermediate material 3590 may be provided inside the cavity 3500 between the base 3515 and the insert portion 3420 of the hosel portion 3400. The intermediate material 3590 may be configured to dampen vibration and prevent deeper travel of the insert portion 3420 inside the cavity 3500. In one example, the height of the intermediate material 3590 may be such that when the insert portion 3420 comes to rest against the intermediate material 3590, the fastener port 3440 is auto-aligned with the through-hole 3560. The intermediate material 3590 may include a compressible foam, elastomer, or other material with vibration dampening behavior. In alternative examples, the intermediate material 3590 may be omitted in favor of extending the length of the insert portion 3420 or reducing the depth of the cavity 3500 to promote contact between the insert portion 3420 and the base 3515 of the cavity 3500. The apparatus, methods, and articles of manufacture described herein are not limited in this regard.

Figure 36:
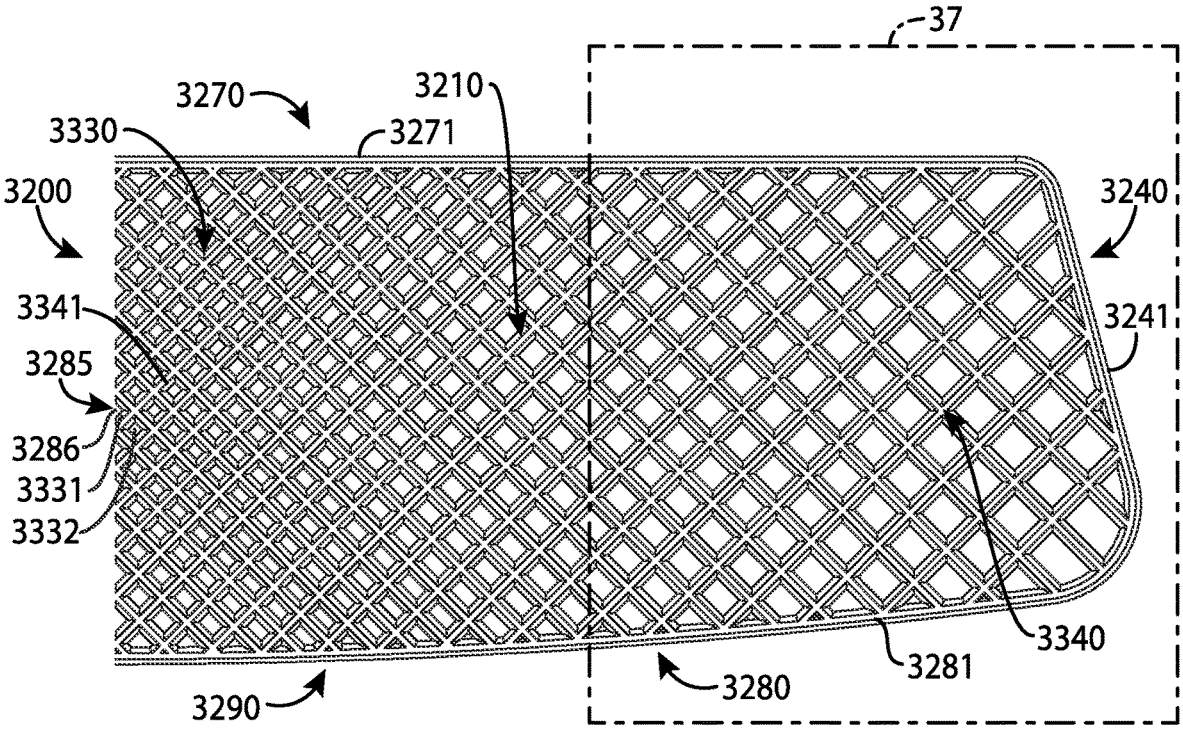
FIG. 36 depicts an enlarged view of area 36 of the face portion of FIG. 32.
Figure 37:
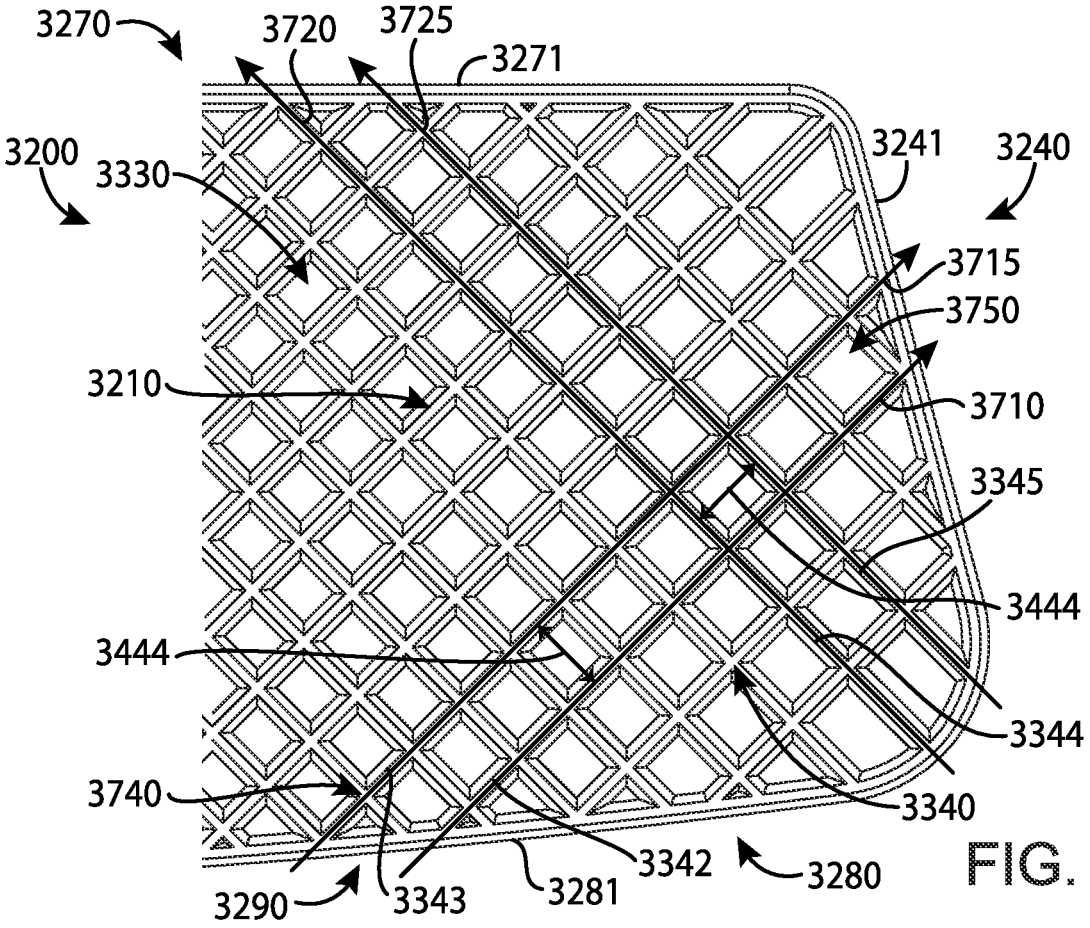
FIG. 37 depicts an enlarged view of area 37 of the face portion of FIG. 36.
Figure 38:
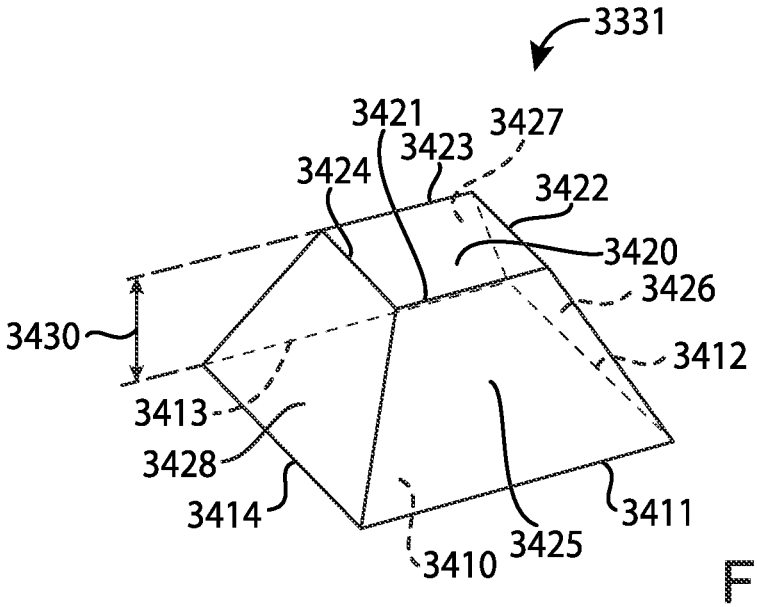
FIG. 38 depicts a perspective schematic view of a pyramidal frustum.
Figure 39:
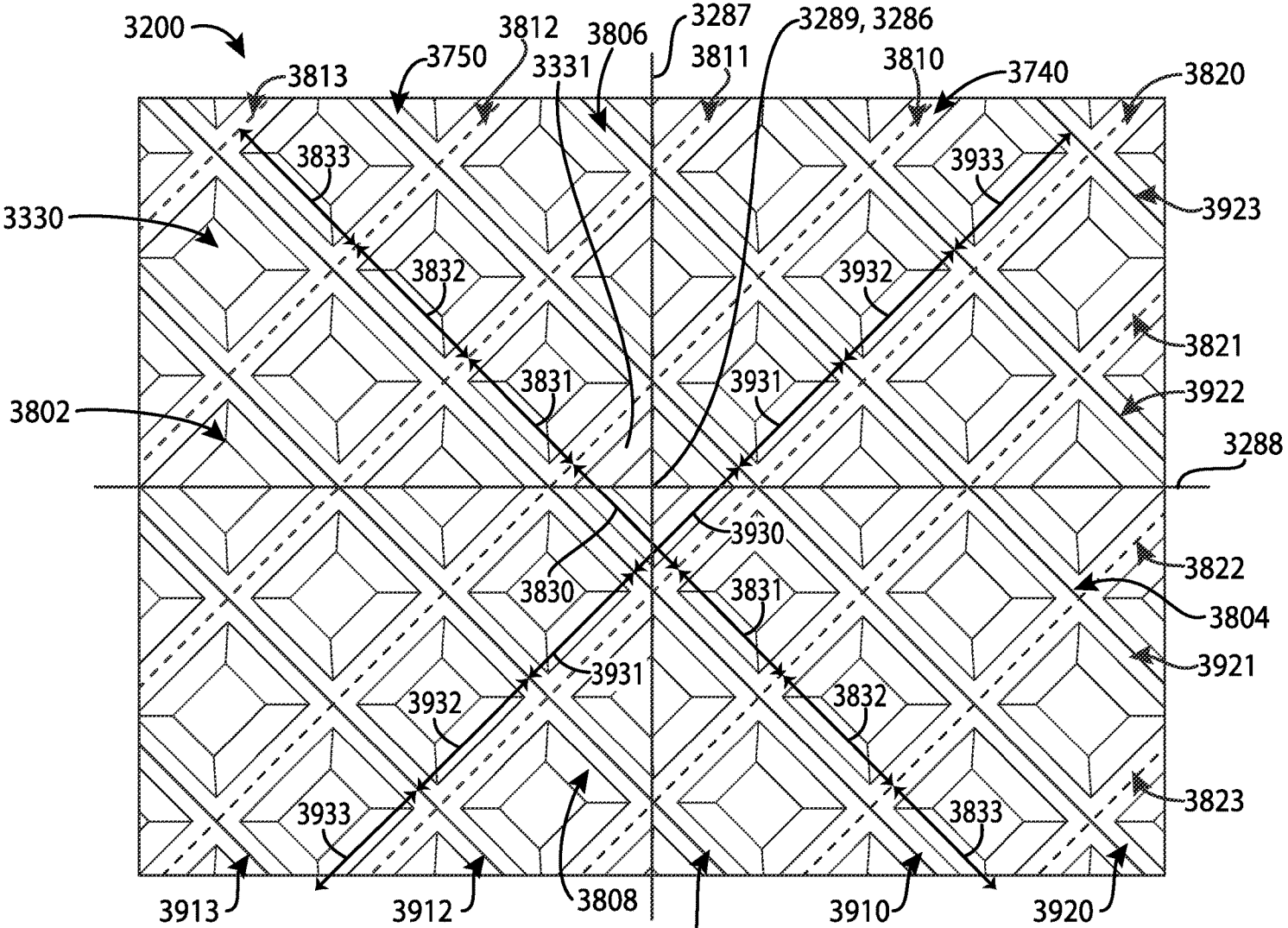
FIG. 39 depicts an enlarged view of area 39 of the face portion of FIG. 32.
Figure 40:
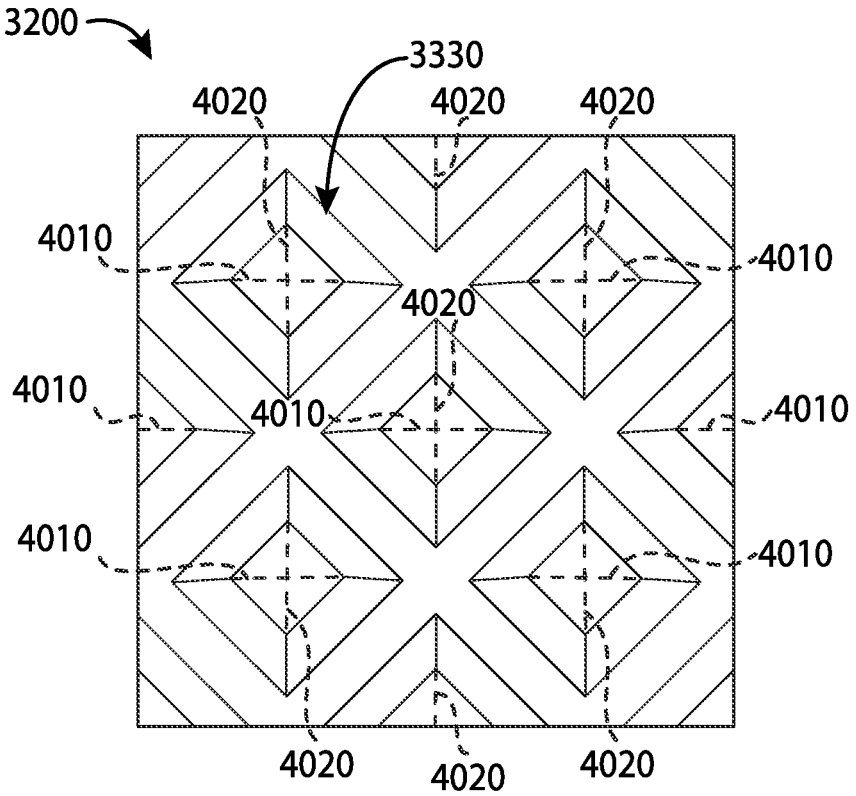
FIG. 40 depicts an alternative face pattern for a face portion of a golf club.
Figure 41:
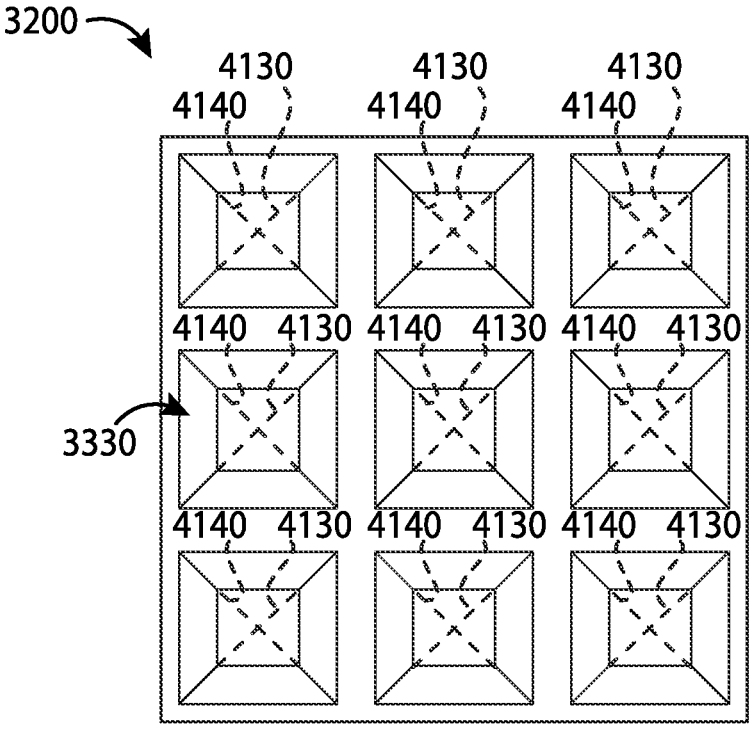
FIG. 41 depicts another alternative face pattern for a face portion of a golf club.
Figure 42:
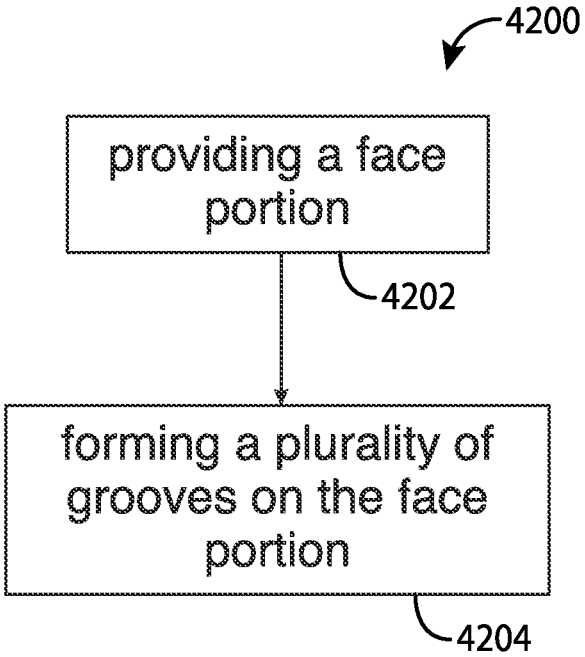
FIG. 42 depicts a method of manufacturing a face portion according to an example of the apparatus, methods, and articles of manufacture described herein.
Figure 43:
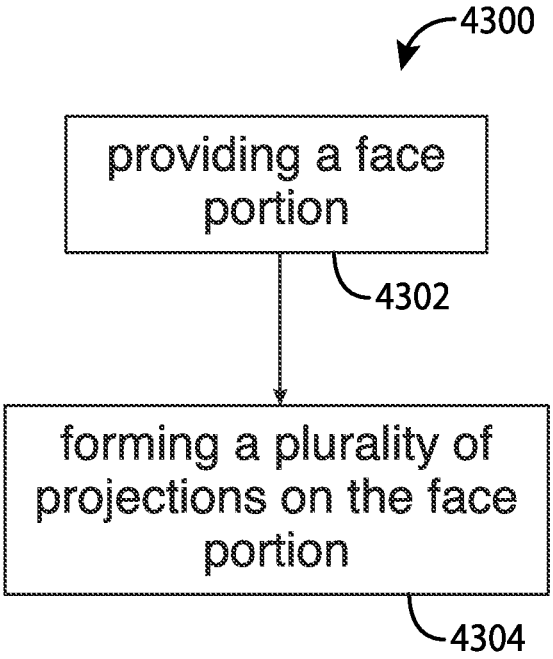
FIG. 43 depicts another method of manufacturing a face portion according to an example of the apparatus, methods, and articles of manufacture described herein.
Figure 44:
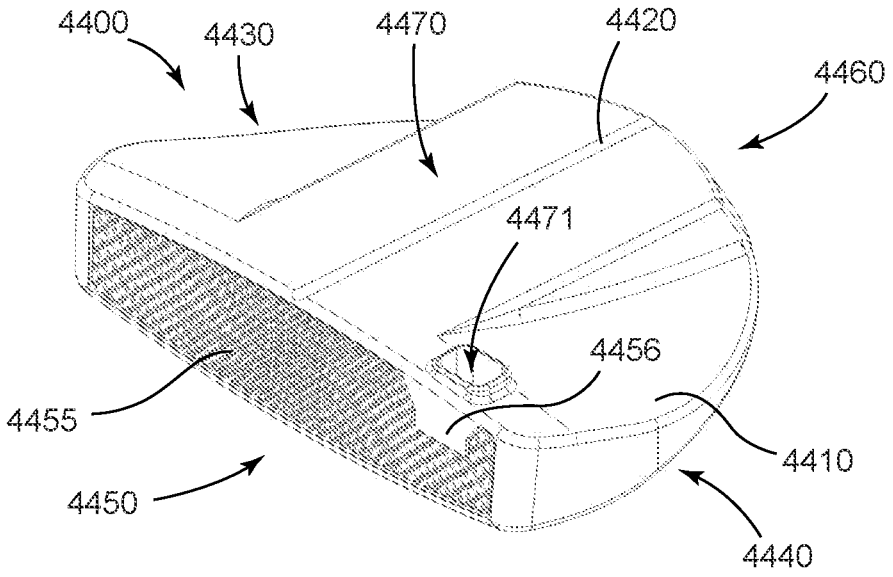
FIG. 44 depicts a front and top perspective view of a golf club head according to an example of the apparatus, methods, and articles of manufacture described herein.
Figure 45:
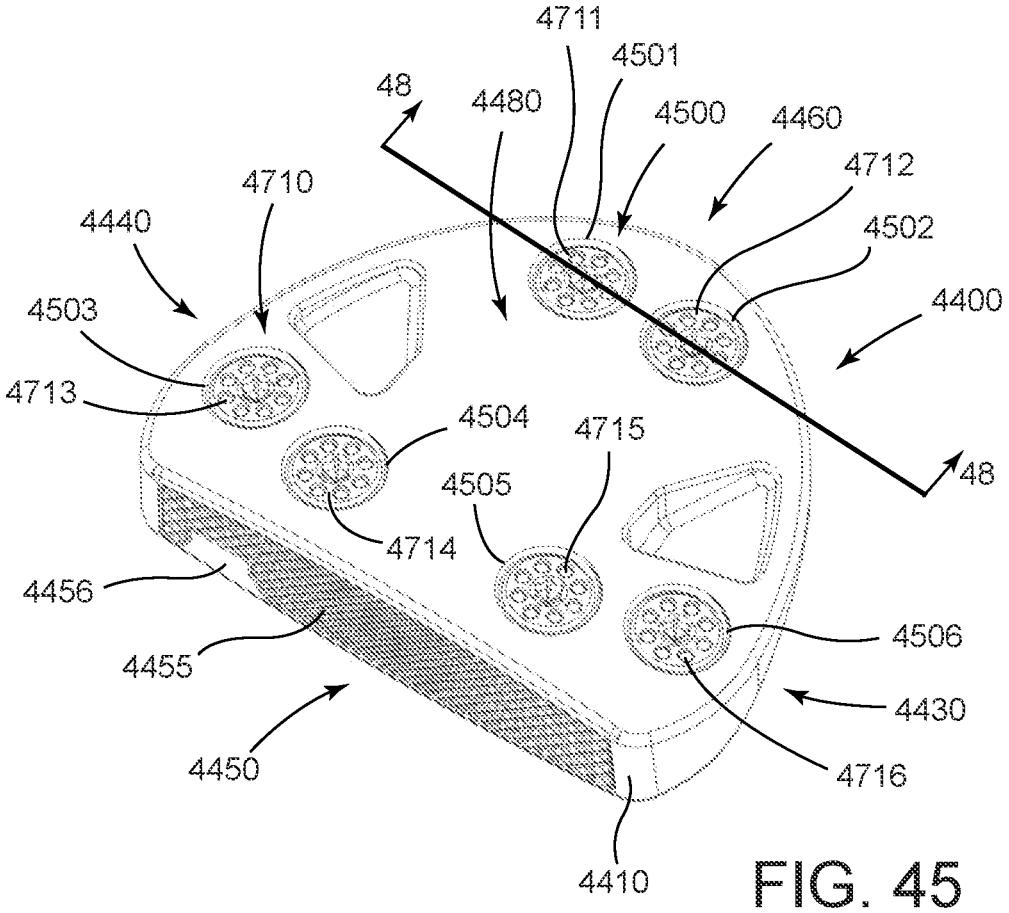
FIG. 45 depicts a front and bottom perspective view of the golf club head of FIG. 44.
Figure 46:
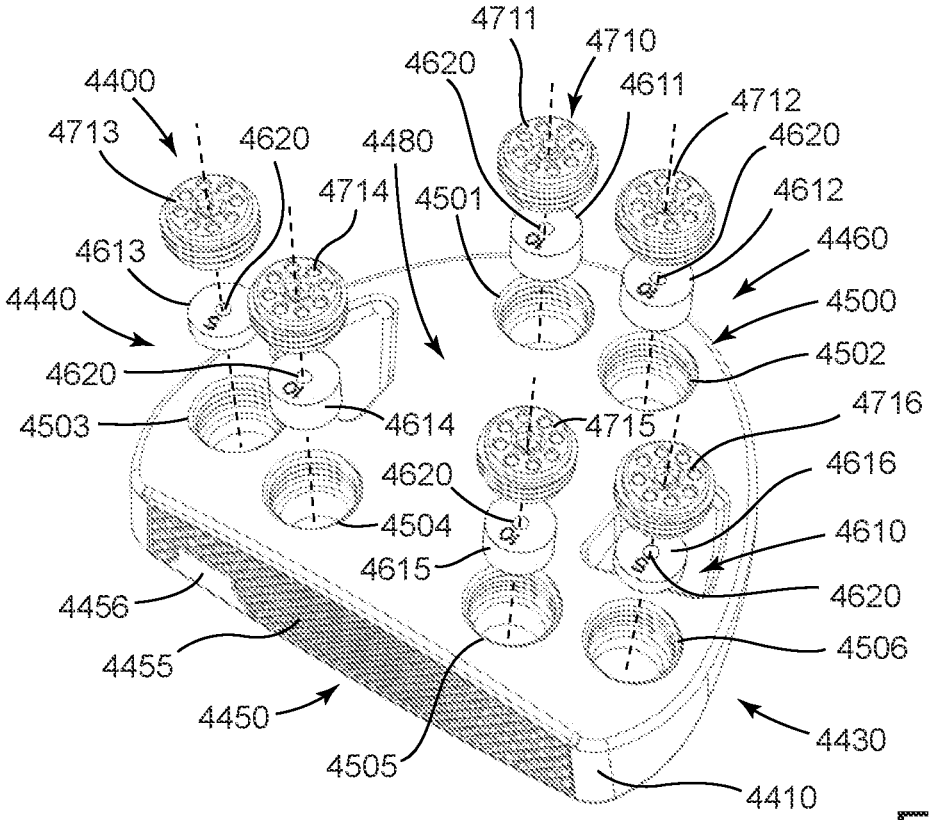
FIG. 46 depicts an exploded view of the golf club head of FIG. 45.
Figure 47:
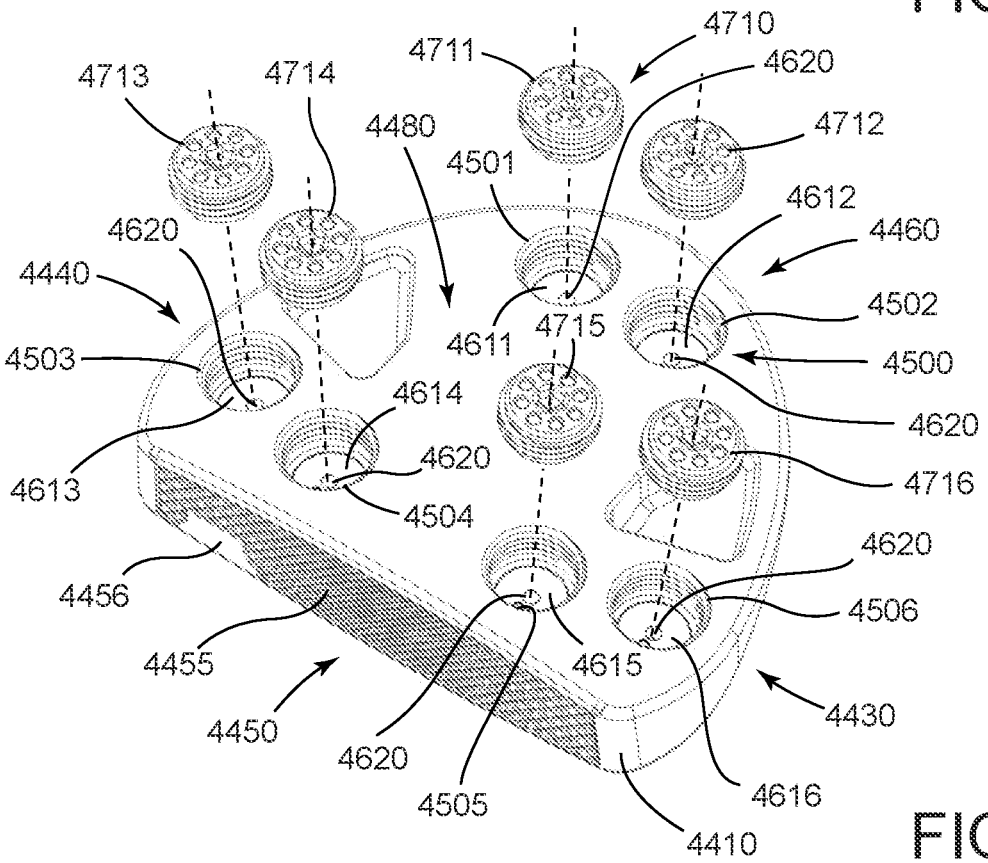
FIG. 47 depicts a partial exploded view of the golf club head of FIG. 45.

In the example of FIG. 36, a method 3600 of assembling a golf club head is generally shown by blocks 3610-3650. At block 3610, a body portion may be selected from a plurality of body portions. Each of the plurality of body portions may be a putter-type body having a cavity extending downward into the body portion and a through-hole located at the front portion and feeding into the cavity. For example, each of the plurality of body portions may have a cavity and through-hole similar to the cavity 3500 and through-hole 3560 shown in FIG. 35. The plurality of body portions may include one or more blade-type putter bodies, one or more mid-mallet-type putter bodies, one or more mallet-type putter bodies, and/or any other putter-type bodies. The apparatus, methods, and articles of manufacture described herein are not limited in this regard.

At block 3620, a hosel portion is provided and may be selected from a plurality of hosel portions. The plurality of hosel portions may include one or more hosel portions with a double bend neck configuration, one or more hosel portions with a single bend neck configuration, one or more hosel portions with a plumber's neck configuration, one or more hosel portions with a slanted configuration, and/or one or more hosel portions of any other neck type. Each of the plurality of hosel portions may include an insert portion with a fastener port. The insert portion of each of the plurality of hosel portions may be similar to the insert portion 3420 shown in FIGS. 34 and 35. Accordingly, the insert portion of each of the plurality of hosel portions may be capable of being received in the cavity of any one of the plurality of body portions. In this way, the plurality of body portions and the plurality of hosel portions may be interchangeable with one another. The apparatus, methods, and articles of manufacture described herein are not limited in this regard.

At block 3630, the insert portion of the selected hosel portion may be inserted into the cavity of the selected body portion such that the fastener port of the selected hosel portion interfaces with the through-hole of the selected body portion. In some examples, an intermediate material may be provided inside the cavity of the selected body portion to dampen vibration and limit the insert portion of the selected hosel portion from traveling any deeper inside the cavity of the selected body portion. The intermediate material may also encourage alignment between the fastener port of the selected hosel portion and the through-hole of the selected body portion. The apparatus, methods, and articles of manufacture described herein are not limited in this regard.

At blocks 3640 and 3650, a fastener may be inserted into the through-hole of the selected body portion and the fastener may be engaged to the fastener port of the selected hosel portion, thereby securing the selected hosel portion to the selected body portion. As described herein, the fastener may be a bolt or screw having a tip portion that may abut and exert a continuous physical force against a side wall of the cavity for holding the hosel portion in place. Tightening of the fastener may pull the insert portion of the selected hosel portion forward against the cavity of the selected body portion, which may result in a continuous physical force being exerted by the hosel portion against a side wall of the cavity that generally faces rearward of the selected body portion. The amount in which the fastener is tightened may be limited by a head of the fastener pressing or abutting against the front portion of the selected body portion. In some examples, the front portion of the selected body portion may include a recessed portion that delimits an upper extent of the face portion and is where the through-hole is located. In these examples, the head of the fastener may press against the recessed portion to limit further tightening of the fastener. The depth of the recessed portion may be determined based on a desired amount of side profile for the fastener. In some examples, the fastener may be readily removable using a tool to allow quick disassembly of the golf club head. The same fastener may again be used in the assembly of any subsequent body portion and hosel portion combinations. The apparatus, methods, and articles of manufacture described herein are not limited in this regard.

Accordingly, the method 3600 outlined above may provide a variety of combinations between the plurality of body portions and the plurality of hosel portions. The method 3600 may be particularly useful in player fittings, whereby a fitter or tester can quickly assemble and disassemble as many combinations as is necessary to discover a body portion and hosel portion combination that is optimized to a particular player's putting stroke. Upon determining an optimal set up, the particular player's golf club head may be assembled pursuant to the method 3200 outlined in FIG. 32, for example. The apparatus, methods, and articles of manufacture described herein are not limited in this regard.

In the example of FIGS. 44-48, a golf club head 4400 may include a body portion 4410 and a visual guide portion 4420. The body portion 4410 may have a toe portion 4430, a heel portion 4440, a front portion 4450, a rear portion 4460, a top portion 4470 having a cavity 4471 configured to receive a hosel (not shown), and a sole portion 4480. The front portion 4450 may include a face portion 4455 (e.g., a strike face), which may be used to impact a golf ball (not shown). The face portion 4455 may include any one of the face patterns described herein but is generally shown with a face pattern similar to the one described with reference to FIGS. 32-39. For exemplary purposes, the face portion 4455 is shown with an optional cutout portion 4456 for bearing a manufacturer's logo or other brand/product identifying information. The body portion 4410 may be made from any material(s) described herein. The apparatus, methods, and articles of manufacture described herein are not limited in this regard.

The body portion 4410 may include a set of weight ports 4500 (e.g., shown as weight ports 4501, 4502, 4503, 4504, 4505, and 4506) at the sole portion 4480. The weight ports of the set of weight ports 4500 may be variously located at the sole portion 4480 and extend into the body portion 4410 toward the top portion 4470. The weight ports of the set of weight ports 4500 may have the same or different physical properties (e.g., shape, size, etc.) and may vary in number. In one example shown in FIG. 48, and with specific reference to weight port 4501 for purposes of understanding, each weight port of the set of weight ports 4500 may include a first section 4810 and a second section 4820 concentrically aligned with the first section 4810 and in communication therewith. The first section 4810 and the second section 4820 may both have a cylindrical shape and the first section 4810 may be located deeper in the body portion 4410 than the second section 4820. The first section 4810 may be defined by a first diameter 4811 and a first depth 4812 while the second section 4820 may be defined by a second diameter 4821 and a second depth 4822. Any given weight port of the set of weight ports 4500 may have a total depth defined by the sum of the first depth 4812 and the second depth 4822, and a total volume defined as the sum of the volume of the first section 4810 and the volume of the second section 4820. The first section 4810 may have less volume than the second section 4820 or vice versa. The weight ports of the set of weight ports 4500 may have the same or different first section 4810 measurements (i.e., first diameter 4811 and/or first depth 4812) and/or second section 4820 measurements (i.e., second diameter 4821 and/or second depth 4822). Accordingly, the total depth and volume of any given weight port of the set of weight ports 4500 may be the same or different from any other weight port of the set of weight ports 4500. The apparatus, methods, and articles of manufacture described herein are not limited in this regard.

Each weight port of the set of weight ports 4500 may be configured to receive a weight portion of a first set of weight portions 4610 (e.g., shown as weight portions 4611, 4612, 4613, 4614, 4615, and 4616). Each weight portion of the first set of weight portions 4610 may have a cylindrical shape to complement the shape of the first section 4810 of a corresponding weight port of the set of weight ports 4500. For example, the weight portions of the first set of weight portions 4610 may be puck-shaped. In assembly, each weight portion of the first set of weight portions 4610 may be dropped into or otherwise coupled to the first section 4810 of the corresponding weight port of the set of weight ports 4500. Each weight portion of the first set of weight portions 4610 may be secured to the first section 4810 of the corresponding weight port via an epoxy or other adhesive and may include a central through-bore 4620 for air relief and/or relief for excess epoxy. In one example shown in FIG. 48, and with specific reference to weight portion 4611 for purposes of understanding, each weight portion of the first set of weight portions 4610 may include a first diameter 4830 and a first thickness 4840. The weight portions of the first set of weight portions 4610 may have the same or different first diameter 4830 measurements and/or first thickness 4840 measurements. Accordingly, the relative size of any given weight portion of the first set of weight portions 4610 may be the same or different from any other weight portion of the first set of weight portions 4610. Additionally, the weight portions of the first set of weight portions 4610 may or may not be interchangeable. In one example, at least a portion of the weight portions of the first set of weight portions 4610 are interchangeable. In one example, the particular size of a given weight portion of the first set of weight portions 4610 may be selected such that the weight portion occupies a substantial entirety of the first section 4810 of a corresponding weight port of the set of weight ports 4500. Each weight portion of the first set of weight portions 4610 may bear indicia such as symbols, alphanumeric characters, colors or a combinations thereof indicating a mass property thereof. For exemplary purposes, weight portions 4613 and 4616 are shown bearing the number "5" to indicate a mass of five grams whereas weight portions 4611, 4612, 4614, and 4615 are shown bearing the number "10" to indicate a mass of ten grams. The weight portions of the first set of weight portions 4610 may each be made of a material ranging from a low-density material to a high-density material such as, but not limited to, a titanium-based material, a steel-based material, or a tungsten-based material. The apparatus, methods, and articles of manufacture described herein are not limited in this regard.

Additionally, each weight port of the set of weight ports 4500 may be configured to receive a weight portion of a second set of weight portions 4710 (e.g., shown as weight portions 4711, 4712, 4713, 4714, 4715, and 4716). Each weight portion of the second set of weight portions 4710 may have a cylindrical shape to complement the shape of the second section 4820 of a corresponding weight port of the set of weight portions 4500. In assembly, each weight portion of the second set of weight portions 4710 may be fastened (e.g., threadingly coupled) to the second section 4820 of the corresponding weight port of the set of weight ports 4500. In one example shown in FIG. 48, and with specific reference to weight portion 4711 for purposes of understanding, each weight portion of the second set of weight portions 4710 may include a second diameter 4850 and a second thickness 4860. The weight portions of the second set of weight portions 4710 may have the same or different second diameter 4850 measurements and/or second thickness 4860 measurements. Accordingly, the relative size of any given weight portion of the second set of weight portions 4710 may be the same or different from any other weight portion of the second set of weight portions 4710. Additionally, the weight portions of the second set of weight portions 4710 may or may not be interchangeable. In one example, at least a portion of the weight portions of the second set of weight portions 4710 are interchangeable. The weight portions of the second set of weight portions 4710 may each be made of a material ranging from a low-density material to a high-density material such as, but not limited to, a titanium-based material, a steel-based material, or a tungsten-based material. The apparatus, methods, and articles of manufacture described herein are not limited in this regard.

Figure 48:
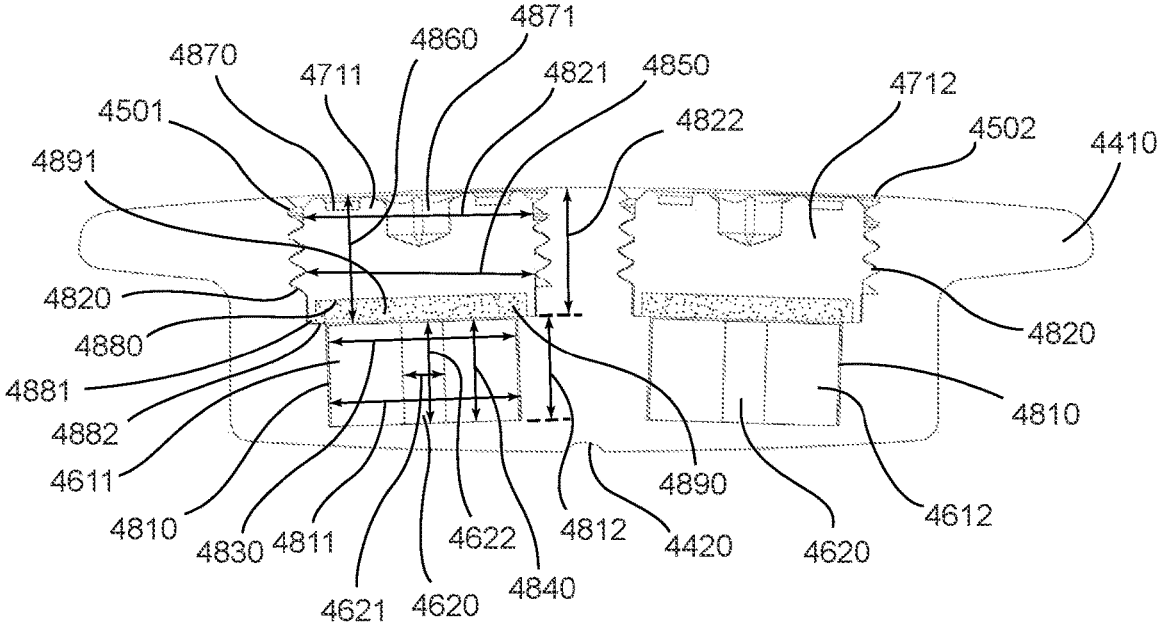
FIG. 48 depicts a cross-sectional view of the golf club head of FIG. 45 at line 48-48 of FIG. 45.

Referring still to the example shown in FIG. 48, one or more weight portions (e.g., weight portion 4711) of the second set of weight portions 4710 may be a threaded fastener (e.g., a screw) having a proximal end 4870 with a screw head 4871 and a distal end 4880 with a protruding rim 4881 configured to abut an internal annular ledge 4882 of the corresponding weight port (e.g., weight port 4501). In other words, a weight portion of the second set of weight portions 4710 may be configured to come to rest against the internal annular ledge 4882 when the weight portion is fastened to the second section 4820 of the corresponding weight port. The internal annular ledge 4882 may correspond to a transition portion between the first section 4810 and the second section 4820 of the corresponding weight port. Additionally, the protruding rim 4881 may function as a standoff separating the weight portion (e.g., weight portion 4711) of the second set of weight portions 4710 from a weight portion (e.g., weight portion 4611) of the first set of weight portions 4610 disposed in the same weight port (e.g., weight port 4501) of the set of weight ports 4500. As a result, the weight portion of the second set of weight portions 4710 and the weight portion of the first set of weight portions 4610 may be spaced apart from each other as shown in FIG. 48 by space 4890. The space 4890 provided between the weight portion of the second set of weight portions 4710 and the weight portion of the first set of weight portions 4610 may provide additional air relief and/or relief for excess epoxy (e.g., epoxy 4891). The apparatus, methods, and articles of manufacture described herein are not limited in this regard.

In the specific example of FIGS. 44-48, the first sections 4810 of the set of weight ports 4500 may have the same or approximately the same first diameter 4811 measurements (e.g., 0.460±0.05 inch or 1.1684±0.127 cm) and the same or approximately the same first depth 4812 measurements (e.g., 0.250±0.05 inch or 0.635±0.127 cm). Likewise, the second sections 4820 of the set of weight ports 4500 may have the same or approximately the same second diameter 4821 measurements (e.g., 0.550±0.05 inch or 1.397±0.127 cm) and the same or approximately the same second depth 4822 measurements (e.g., 0.310±0.05 inch or 0.787±0.127 cm). In such a configuration, the first sections 4810 of the set of weight ports 4500 may have less volume, and more particularly, a smaller diameter measurement than the second sections 4820 of the set of weight ports 4500, thereby enabling the weight portions of the second set of weight portions 4710 to conceal the first section 4810 of the set of weight ports 4500 and any weight portions of the first set of weight portions 4610 disposed therein. The apparatus, methods, and articles of manufacture described herein are not limited in this regard.

In the example of FIGS. 44-48, the weight portions of the first set of weight portions 4610 may have the same first diameter 4830 measurements (e.g., 0.450±0.05 inch or 1.143±0.127 cm) and variable first thickness 4840 measurements (e.g., 0.245±0.05 inch or 0.6223±0.127 cm for weight portions 4611, 4612, 4614, and 4615, and 0.125±0.05 inch or 0.318±0.127 cm for weight portions 4613 and 4616). Given the reduction in the first thickness 4840 measurements for weight portions 4613 and 4616, the first depth 4812 measurements of the first sections 4810 of corresponding weight ports 4503 and 4506 may also be reduced (e.g., to 0.130±0.05 inch or 0.330±0.127 cm) if desired. The central through-bores 4620 of the weight portions of the first of weight portions 4610 may each have a bore diameter 4621 of 0.100±0.05 inch or 0.254±0.127 cm) and a bore thickness 4622 equal to the first thickness 4840 of the corresponding weight portion. As described herein, the physical properties of the first set of weight portions, such as diameter, depth, or volume may be determined to provide certain performance characteristics for the golf club head 4400. As described herein, the weight portions of the first set of weight portions 4610 may each be made of a material ranging from a low-density material to a high-density material depending on the preferences of a player, for example. The apparatus, methods, and articles of manufacture described herein are not limited in this regard.

In the example of FIGS. 44-48, the weight portions of the second set of weight portions 4710 may have the same second diameter 4850 measurements (e.g., 0.540±0.05 inch or 1.372±0.127 cm) and the same second thickness 4860 measurements (e.g., 0.300±0.05 or 0.762±0.127 cm). Each of the weight portions of the second set of weight portions 4710 may be lighter, approximately equal to in weight, or heavier than a corresponding weight portion of the first set of weight portions 4610 occupying the same weight port of the set of weight ports 4500. As described herein, the physical properties of the first set of weight portions, such as diameter, depth, volume, or materials of construction may be determined to provide certain performance characteristics for the golf club head 4400. The leveraging of two separate and distinct weighting portions in a common weight port affords a greater degree of adjustability and customization in regard to the overall weight of the golf club head 4400 and corresponding properties such as, but not limited to, center of gravity (CG) and moment of inertia (MOI). The ability of each weight port to accommodate up to two separate and distinct weight portions (e.g., one weight portion from each of the first and second weight portions 4610 and 4710) may be more practical and cost effective than a single weight portion having the same desired weight. In the example of FIGS. 44-48, the first and second set of weight portions may be equal or different in number. The apparatus, methods, and articles of manufacture described herein are not limited in this regard.

Figure 49:
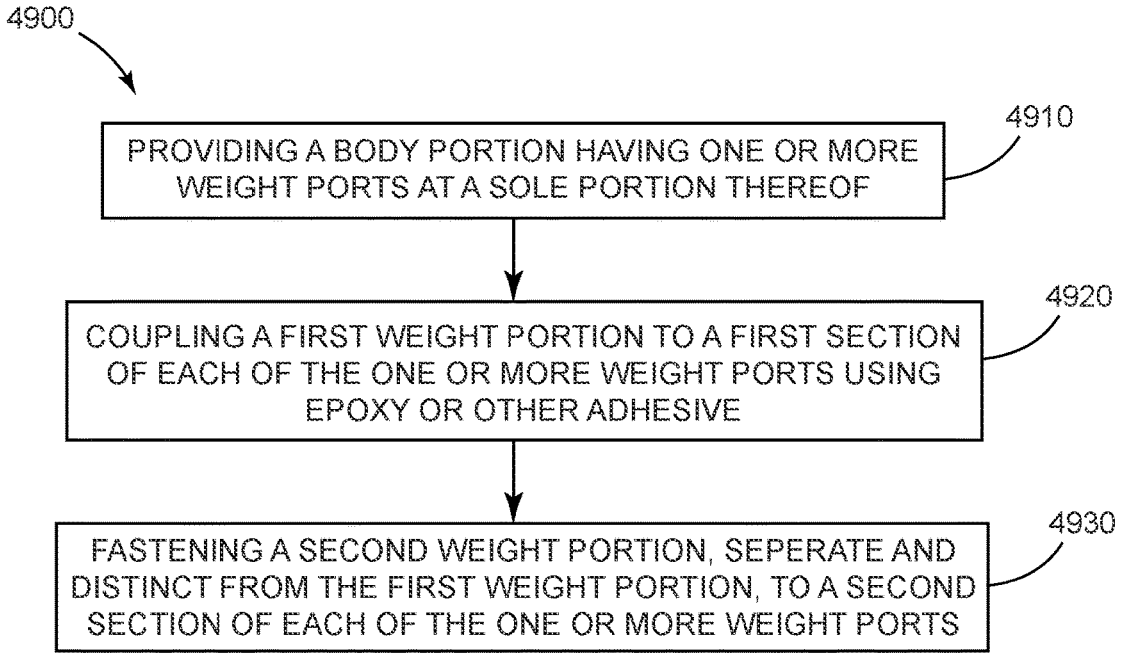
FIG. 49 depicts a method of manufacturing a golf club head according to an example of the apparatus, methods, and articles of manufacture described herein.

In the example of FIG. 49, a method 4900 of assembling a golf club head is provided. The process 4900 may be utilized to assemble the golf club head 4400 described with reference to FIGS. 44-48 and may include providing a body portion having one or more weight ports at a sole portion thereof (block portion 4910). The process 4900 may also include coupling a first weight portion to a first section of each of the one or more weight ports using an epoxy or other adhesive (block 4920). The process 4900 may further include fastening a second weight portion, separate and distinct from the first weight portion, to a second section of each of the one or more weight ports (block 4930). The first and second weight portions may be made of a material ranging from a low-density material to a high-density material including, but not limited to, a titanium-based material, a steel-based material, and a tungsten-based material. The particular density of the first and second weight portions may be determined based on the preferences of a player, thereby aiding to optimize his or her performance using the golf club head. The apparatus, methods, and articles of manufacture described herein are not limited in this regard.

The apparatus, methods, and articles of manufacture described herein may include one or more club identifiers (e.g., a serial number, a matrix barcode, a brand name, a model, a club number, a loft angle, a character, etc.). For example, any of the golf club heads described herein may include a visual indicator such as a club number to identify the type of golf club. In one example, the club number may correspond to the loft angle of the golf club head (e.g., 3, 4, 5, 6, 7, 8, or 9). In one example, a 7-iron type golf club head may be marked with "7". In another example, a 54-degree wedge type golf club head may be marked "54". In yet another example, a 10.5-degree driver type golf club head may be marked "10.5." Any marking(s) associated with a club identifier may be visually differentiated (e.g., different color, texture, pattern, etc.) from the rest of the golf club head. The club identifier may be a trademark to identify a brand or a model of the golf club head. The club identifier may be another type of visual indicator such as a product number or a serial number to identify the golf club head as authentic equipment, to track inventory, or to distinguish the golf club head from fake or counterfeit products. Alternatively, the club identifier may be a digital signature or a machine-readable optical representation of information or data about the golf club head (e.g., numeric character(s), alphanumeric character(s), byte(s), a one-dimensional barcode such as a Universal Product Code (UPC), a two-dimensional barcode such as a Quick Response (QR) code, etc.). The club identifier may be placed at various locations on the golf club head (e.g., the hosel portion the face portion the sole portion etc.) using various methods (e.g., laser etched, stamped, casted, or molded onto the golf club head). For example, the club identifier may be a serial number laser etched onto the hosel portion of the golf club head. Instead of being an integral part of the golf club head, the club identifier may be a separate component coupled to the golf club head (e.g., a label adhered via an adhesive or an epoxy).

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A putter-type golf club head comprising:

a body portion comprising a toe portion, a heel portion, a front portion, a rear portion, a top portion, and a sole portion;

a weight port in the body portion, the weight port comprising:

a threaded section extending from the sole portion to an internal annular ledge within the body portion; and a cylindrical section extending from the internal annular ledge toward the top portion, the cylindrical section having a first diameter that is less than a second diameter of the threaded section;

a first weight portion coupled to the cylindrical section by an epoxy; and a second weight portion threadingly fastened to the threaded section, the second weight portion having a protruding rim extending from a bottom end of the second weight portion and abutting the internal annular ledge, wherein the first weight portion includes a central through-bore to provide at least one of air relief or relief for the epoxy, wherein the second weight portion includes a recess in the bottom end defined in part by the protruding rim, the recess providing at least one of air relief or relief for the epoxy, and wherein the weight port is located a first distance of less than the second diameter from a perimeter edge of one of the toe portion or the heel portion.

2. A putter-type golf club head as defined in claim 1, wherein the central through-bore provides a passage from a central region of the cylindrical section to the recess.

3. A putter-type golf club head as defined in claim 1, wherein the protruding rim has an interior diameter that is greater than the first diameter of the cylindrical section.

4. A putter-type golf club head as defined in claim 1, wherein the weight port is located a second distance of less than the second diameter from a perimeter edge of the front portion.

5. A putter-type golf club head as defined in claim 1, wherein the second weight portion has a drive portion at a top end, the drive portion configured to receive a tool to facilitate removal of the second weight portion.

6. A putter-type golf club head as defined in claim 1, wherein the first weight portion comprises a first material having a first density, wherein the second weight portion comprises a second material having a second density, and wherein the first density is different from the second density.

7. A putter-type golf club head as defined in claim 1, further comprising a visual guide on the top portion, the visual guide extending from the front portion to the rear portion.

8. A putter-type golf club head comprising:

a body portion including a toe portion, a heel portion, a front portion, a rear portion, a top portion, and a sole portion;

a weight port in the body portion, the weight port comprising:

a threaded section extending from the sole portion to an internal annular ledge within the body portion;

an unthreaded section extending from the internal annular ledge toward the top portion, the unthreaded section having a first diameter that is less than a second diameter of the threaded section;

a first weight portion coupled to the unthreaded section by an epoxy; and a second weight portion threadingly fastened to the threaded section and being in contact with the internal annular ledge, wherein the first weight portion includes a central through-bore to provide at least one of air relief or relief for the epoxy, wherein a centerline of the threaded section is aligned with a centerline of the unthreaded section, and wherein the first weight portion comprises a first material having a first density, wherein the second weight portion comprises a second material having a second density, and wherein the first density is greater than the second density.

9. A putter-type golf club head as defined in claim 8, wherein the second weight portion further comprises a protruding rim extending from a bottom end of the second weight portion, the protruding rim being in contact with the internal annular ledge, and wherein the second weight portion includes a recess in the bottom end defined in part by the protruding rim, the recess being configured to provide at least one of air relief or relief for the epoxy.

10. A putter-type golf club head as defined in claim 8, wherein the second weight portion further comprises a top end, a bottom end opposite the top end, a protruding rim extending from the bottom end, wherein the protruding rim at least partially defines a recess, and wherein the protruding rim is in contact with the internal annular ledge, and wherein the recess is configured to provide at least one of air relief or relief for the epoxy.

11. A putter-type golf club head as defined in claim 8, wherein the unthreaded section is a cylindrical section.

12. A putter-type golf club head as defined in claim 8, wherein at least one of a group consisting of the first weight portion and the second weight portion bears indicia of a mass property.

13. A putter-type golf club head as defined in claim 8, wherein the first weight portion comprises a material selected from a group consisting of a titanium-based material, a steel-based material, and a tungsten-based material.

14. A putter-type golf club head as defined in claim 8, further comprising a visual guide on the top portion, the visual guide extending from the front portion to the rear portion.

15. A putter-type golf club head comprising:

a body portion including a toe portion, a heel portion, a rear portion, a top portion, a sole portion, and a front portion having a face portion;

a weight port in the body portion, the weight port comprising:

a threaded section extending from the sole portion to an internal annular ledge within the body portion;

a cylindrical section extending from the internal annular ledge toward the top portion, the cylindrical section having a first diameter that is less than a second diameter of the threaded section;

a first weight portion coupled to the cylindrical section by an adhesive; and a second weight portion coupled to the threaded section and being in contact with the internal annular ledge, wherein the first weight portion includes a central through-bore to provide at least one of air relief or relief for the adhesive, and wherein the weight port is located a distance of less than the second diameter from the face portion.

16. A putter-type golf club head as defined in claim 15, wherein the first weight portion is a cylindrical weight portion, and wherein the second weight portion is a threaded weight portion with a screw head.

17. A putter-type golf club head as defined in claim 15, wherein the cylindrical section is an unthreaded section.

18. A putter-type golf club head as defined in claim 15, wherein the first weight portion has a first mass, wherein the second weight portion has a second mass, and wherein the first mass is greater than the second mass.

19. A putter-type golf club head as defined in claim 15, further comprising a cavity in the top portion, wherein the cavity is configured to receive a hosel, and wherein the cavity is located closer to the front portion than the rear portion and closer to the heel portion than the toe portion.

20. A putter-type golf club head as defined in claim 15, further comprising a visual guide on the top portion, the visual guide extending from the front portion to the rear portion.

* * * * *